US010352263B2

(12) United States Patent
Koshi et al.

(10) Patent No.: US 10,352,263 B2
(45) Date of Patent: Jul. 16, 2019

(54) FUEL INJECTION AMOUNT CONTROL APPARATUS FOR AN INTERNAL COMBUSTION ENGINE

(75) Inventors: Yasuhiro Koshi, Susono (JP); Keiichiro Aoki, Shizuoka-ken (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 1474 days.

(21) Appl. No.: 13/810,139

(22) PCT Filed: Jul. 15, 2010

(86) PCT No.: PCT/JP2010/062395
§ 371 (c)(1),
(2), (4) Date: Aug. 22, 2013

(87) PCT Pub. No.: WO2012/008057
PCT Pub. Date: Jan. 19, 2012

(65) Prior Publication Data
US 2013/0325296 A1 Dec. 5, 2013

(51) Int. Cl.
*F02D 41/02* (2006.01)
*F02D 41/00* (2006.01)
*F02D 41/14* (2006.01)

(52) U.S. Cl.
CPC ..... *F02D 41/0235* (2013.01); *F02D 41/0085* (2013.01); *F02D 41/1454* (2013.01);
(Continued)

(58) Field of Classification Search
CPC ..... F02D 41/1476; F02D 41/1456; F02D 41/0085; F02D 41/0235; F02D 41/1454; F02D 41/1475; F02D 41/1441
(Continued)

(56) References Cited

U.S. PATENT DOCUMENTS 5,379,591 A * 1/1995 Iwata ..... F02D 41/1483 123/703
5,657,736 A * 8/1997 Maki ..... F02D 41/0085 123/673
(Continued)

FOREIGN PATENT DOCUMENTS

JP 05180040 A * 7/1993
JP 2000-220489 A 8/2000
(Continued)

*Primary Examiner* — Mahmoud Gimie
*Assistant Examiner* — Joshua Campbell
(74) *Attorney, Agent, or Firm* — Dinsmore & Shohl LLP

(57) ABSTRACT

A control apparatus comprising an air-fuel ratio sensor disposed between the exhaust gas aggregated portion and the three-way catalyst, and which outputs an output value corresponding to an amount of oxygen and an amount of unburnt substances that has reached the exhaust-gas-side electrode layer via the porous; an actual detected air-fuel ratio obtaining section which obtains an actual detected air-fuel ratio by converting an actual output value of the air-fuel ratio sensor into an air-fuel ratio; and an instructed fuel injection amount calculation section which corrects the amount of the fuel injected from a plurality of the fuel injection valves so that the actual detected air-fuel ratio coincides with a target air-fuel ratio; and an air-fuel ratio imbalance indicating value obtaining section which obtains an air-fuel ratio imbalance indicating value which becomes larger as a degree of a non-uniformity among a plurality of the cylinders of cylinder-by-cylinder air-fuel ratios.

19 Claims, 15 Drawing Sheets

(52) U.S. Cl.
CPC ..... *F02D 41/1475* (2013.01); *F02D 41/1441* (2013.01); *F02D 41/1456* (2013.01); *F02D 41/1476* (2013.01)

(58) Field of Classification Search
USPC ..... 701/104
See application file for complete search history.

(56) References Cited

U.S. PATENT DOCUMENTS

| | | | | |
|---|---|---|---|---|
| 5,715,796 | A * | 2/1998 | Suzuki | F02D 41/008 123/492 |
| 7,152,594 | B2 | 12/2006 | Anilovich et al. | |
| 2003/0150441 | A1 * | 8/2003 | Saga | F02D 41/1456 123/674 |
| 2004/0103890 | A1 * | 6/2004 | Yasui | F02D 41/0085 123/673 |
| 2006/0236990 | A1 * | 10/2006 | Annoura | F02D 41/008 123/673 |
| 2009/0056686 | A1 | 3/2009 | Suzuki | |

FOREIGN PATENT DOCUMENTS

| | | | | |
|---|---|---|---|---|
| JP | 2007-154840 | A | 6/2007 | |
| JP | 2007155605 | A | 6/2007 | |
| JP | WO 2009013600 | A2 * | 1/2009 | F02D 41/0085 |
| JP | 2009-030455 | A | 2/2009 | |
| JP | 2009-209747 | A | 9/2009 | |
| WO | WO 2009013600 | A2 * | 7/2008 | |
| WO | WO 2009013600 | A2 * | 1/2009 | F02D 41/0085 |

* cited by examiner

FUEL INJECTION AMOUNT CONTROL APPARATUS FOR AN INTERNAL COMBUSTION ENGINE

TECHNICAL FIELD

The present invention relates to a fuel injection amount control apparatus for a multi-cylinder internal combustion engine.

BACKGROUND ART

Conventionally, there has been widely known an air-fuel ratio control apparatus, which includes a three-way catalyst (43) disposed in an exhaust passage of an internal combustion engine, and an air-fuel ratio sensor (56) disposed upstream of the three-way catalyst (43), as shown in FIG. 1.

This air-fuel ratio control apparatus calculates an air-fuel ratio feedback amount (quantity) based on the output of the air-fuel ratio sensor (56) in such a manner that an air-fuel ratio (an air-fuel ratio of the engine, and thus, an air-fuel ratio of an exhaust gas) of an air-fuel mixture supplied to the engine coincides with a target air-fuel ratio, and feedback-controls the air-fuel ratio of the engine based on the air-fuel ratio feedback amount. The air-fuel ratio feedback amount used in such an air-fuel ratio control apparatus is a control amount commonly used for all of the cylinders. The target air-fuel ratio is set at a base (reference) air-fuel ratio which is within a window of the three way catalyst (43). The base air-fuel ratio is typically equal to a stoichiometric air-fuel ratio. The base air-fuel ratio may be changed to an air-fuel ratio in the vicinity of the stoichiometric air-fuel ratio base on an intake air amount of the engine, a deterioration degree of the three way catalyst (43), and so on.

Incidentally, in general, such an air-fuel ratio control apparatus is applied to an internal combustion engine using an electronic-control-fuel-injection apparatus. The internal combustion engine has at least one fuel injection valve (33) at each of cylinders or at each of intake ports communicating with the respective cylinders. Accordingly, when the characteristic/property of the fuel injection valve of a certain (specific) cylinder changes so as to inject fuel in an amount excessively larger than an injection amount to be injected according to an instruction (instructed fuel injection amount), only an air-fuel ratio of an air-fuel mixture supplied to that certain cylinder (the air-fuel ratio of the certain cylinder) greatly changes toward the rich side. That is, the degree of air-fuel ratio non-uniformity among the cylinders (inter-cylinder air-fuel ratio variation; inter-cylinder air-fuel ratio imbalance) increases. In other words, there arises an imbalance among "cylinder-by-cylinder air-fuel ratios", each of which is the air-fuel ratio of the air-fuel mixture supplied to each of the cylinders.

It should be noted that a cylinder corresponding to the fuel injection valve having the characteristic to inject the fuel in an amount excessively larger or excessively smaller than the instructed fuel injection amount is also referred to as an imbalanced cylinder, and each of the remaining cylinders (a cylinder corresponding to the fuel injection valve having the characteristic to inject the fuel in an amount equal to the instructed fuel injection amount) is also referred to as an un-imbalanced cylinder (or a normal cylinder).

When the characteristic/property of the fuel injection valve of the certain (specific) cylinder changes so as to inject fuel in the amount excessively larger than the instruction injection amount, an average of the air-fuel ratio of the air-fuel mixture supplied to the entire engine becomes richer than the target air-fuel ratio which is set at the base air-fuel ratio. Accordingly, by means of the air-fuel ratio feedback amount commonly used for all of the cylinders, the air-fuel ratio of the above-mentioned certain cylinder is changed toward the lean side so as to come closer to the base air-fuel ratio, and, at the same time, the air-fuel ratios of the remaining cylinders are changed toward the lean side so as to deviate more greatly from the base air-fuel ratio. As a result, the average (air-fuel ratio of the exhaust gas) of the air-fuel ratio of the air-fuel mixture supplied to the entire engine becomes equal to an air-fuel ratio in the vicinity of the base air-fuel ratio.

However, the air-fuel ratio of the certain cylinder is still in the rich side in relation to the base air-fuel ratio and the air-fuel ratios of the remaining cylinders are in the lean side in relation to the base air-fuel ratio. Consequently, an amount of emissions (an amount of unburned combustibles (substances) and/or an amount of nitrogen oxides) discharged from each of the cylinders increase, as compared to the case in which each of the air-fuel ratios of the cylinders is equal to the base air-fuel ratio. Therefore, even when the average of the air-fuel ratio of the mixture supplied to the engine is equal to the base air-fuel ratio, the increased emissions cannot be removed by the three-way catalyst. Consequently, the amount of emissions may increase.

Accordingly, in order to prevent the emissions from increasing, it is important to detect a state in which the degree of the non-uniformity among the cylinder-by-cylinder air-fuel ratios becomes excessively large (the non-uniformity of the air-fuel ratio among the cylinders becomes excessively large, that is, generation of an inter-cylinder air-fuel ratio imbalance state) and take some measures against the imbalance state. It should be noted that, the inter-cylinder air-fuel ratio imbalance also occurs, for example, in a case where the characteristic of the fuel injection valve of a certain cylinder changes to inject fuel in an amount excessively smaller than the instructed fuel injection amount.

One of conventional fuel injection amount control apparatuses obtains a trace/trajectory length of the output value (output signal) of the upstream air-fuel ratio sensor (56). Further, the control apparatus compares the trace length with a "reference value which changes in accordance with an engine rotational speed", and determines whether or not the inter-cylinder air-fuel ratio imbalance state has occurred based on the result of the comparison (see, for example, patent literature No. 1).

Another conventional fuel injection amount control apparatus analyzes the output value of the upstream air-fuel ratio sensor (56) so as to detect the cylinder-by-cylinder air-fuel ratios. Further, the control apparatus determines whether or not the inter-cylinder air-fuel ratio imbalance state has occurred, based on a difference between the detected cylinder-by-cylinder air-fuel ratios (see, for example, patent literature No. 2).

CITATION LIST

<Patent Literature No. 1> U.S. Pat. No. 7,152,594.

<Patent Literature No. 2> Japanese Patent Application Laid-Open (kokai) No. 2000-220489

Meanwhile, when the non-uniformity among the cylinder-by-cylinder air-fuel ratios occurs, there may be a case in which a true average of the air-fuel ratio of the engine is controlled so as to become an air-fuel ratio larger than the base air-fuel ratio (leaner than the base air-fuel ratio) by means of the feedback control (main feedback control) to have an air-fuel ratio represented by the output value of the air-fuel ratio sensor (56) coincide with the "target air-fuel ratio which is set at the base air-fuel ratio such as the stoichiometric air-fuel ratio." As a result, the discharge amount of the nitrogen oxides may increase. The reason for this will next be described.

The fuel supplied to the engine is a chemical compound of carbon and hydrogen. Accordingly, the unburnt substances such as "carbon hydride HC, carbon monoxide CO, and hydrogen $H_2$" are generated as intermediate products, when the air-fuel ratio of the mixture to be combusted is richer than the stoichiometric air-fuel ratio. In this case, as the air-fuel ratio of the mixture for the combustion becomes richer in relation to the stoichiometric air-fuel ratio and deviates more greatly from the stoichiometric air-fuel ratio, a probability that the intermediate products meet and bind to the oxygen molecules during the combustion becomes drastically smaller. Consequently, as shown in FIG. 2, an amount of the unburnt substances (HC, CO, and $H_2$) drastically (e.g., in a quadratic function fashion) increases, as the air-fuel ratio of the mixture supplied to the cylinder becomes richer.

It is now assumed that a non-uniformity among the cylinder-by-cylinder air-fuel ratios occurs where only the air-fuel ratio of a certain cylinder deviates greatly toward the rich side. Under this assumption, the air-fuel ratio (air-fuel ratio of the certain cylinder) of the air-fuel mixture supplied to that certain cylinder changes to a much richer (smaller) air-fuel ratio, compared to the air-fuel ratios (air-fuel ratios of the remaining cylinders) of the air-fuel mixtures supplied to the remaining cylinders. At this time, a great amount of unburnt substances (HC, CO, and $H_2$) are discharged from that certain cylinder.

In the mean time, the air-fuel ratio sensor (56) comprises a porous layer (e.g., a diffusion resistance layer, or a protective layer) that makes a "gas (gas after oxygen equilibrium) which is in a state where the unburnt substances and oxygen have chemically achieved equilibrium" reach the air-fuel ratio detection element. The air-fuel ratio sensor (56) outputs a value corresponding to "an amount of oxygen (oxygen partial pressure, oxygen concentration) or an amount of unburnt substance (unburnt substance partial pressure, unburnt substance concentration)" that has reached an exhaust-gas-side electrode layer (surface of the air-fuel ratio detection element) of the air-fuel ratio sensor (56) after passing through the diffusion resistance layer.

Meanwhile, hydrogen $H_2$ is a small molecule, compared with carbon hydride HC, carbon monoxide CO, and the like. Accordingly, hydrogen $H_2$ rapidly diffuses through the porous layer of the air-fuel ratio sensor (56), compared to the other unburnt substances (HC, CO). That is, a preferential diffusion of hydrogen $H_2$ occurs in the porous layer.

Due to the preferential diffusion of hydrogen when the non-uniformity among the cylinder-by-cylinder air-fuel ratios (air-fuel ratio imbalance among the cylinders) is occurring, the output value of the air-fuel ratio sensor (56) shifts to a value in a richer side. Thus, the air-fuel ratio represented by the output value of the air-fuel ratio sensor (56) becomes an "air-fuel ratio in the richer side" with respect to a true air-fuel ratio of the engine.

More specifically, for example, it is assumed that an air-fuel ratio A0/F0 is equal to the stoichiometric air-fuel ratio (e.g., 14.6), when the intake air amount (weight) introduced into each of the cylinders of the 4-cylinder engine is A0, and the fuel amount (weight) supplied to each of the cylinders is F0. Further, it is assumed that the target air-fuel ratio is the stoichiometric air-fuel ratio, for convenience of description.

Under this assumption, it is further assumed that an amount of the fuel supplied (injected) to each of the cylinders becomes uniformly excessive in (or by) 10%. That is, it is assumed that the fuel of 1.1·F0 is supplied to each of the cylinders. Here, a total amount of the intake air supplied to the four cylinders (i.e., an amount of intake air supplied to the entire engine during a period in which each and every cylinder completes one combustion stroke) is equal to 4·A0, and a total amount of the fuel supplied to the four cylinders (i.e., an amount of fuel supplied to the entire engine during the period in which each and every cylinder completes one combustion stroke) is equal to 4.4·F0 (=1.1·F0+1.1·F0+1.1·F0+1.1·F0). Accordingly, a true average of the air-fuel ratio of the engine is equal to 4·A0/(4.4·F0)=A0/(1.1·F0).

The air-fuel ratio control apparatus stores (memorizes) a "relationship between the output value of the air-fuel ratio sensor (56) and the true air-fuel ratio" when the non-uniformity of the cylinder-by-cylinder air-fuel ratios is not occurring, in advance. Hereinafter, the "relationship between the output value of the air-fuel ratio sensor (56) and the true air-fuel ratio" in this case is referred to as a "base relationship." The air-fuel ratio control apparatus detects the air-fuel ratio based on the base relationship and the actual output value of the air-fuel ratio sensor (56). Accordingly, the detected air-fuel ratio based on the output value of the air-fuel ratio sensor (56) becomes equal to A0/(1.1·F0).

Consequently, due to the main feedback control, the air-fuel ratio of the mixture supplied to the entire engine is caused to coincide with the "stoichiometric air-fuel ratio A0/F0 serving as the target air-fuel ratio." That is, the amount of the fuel supplied to each of the cylinders is decreased in (by) 10% based on the air-fuel ratio feedback amount calculated by the main feedback control. As a result, the fuel of 1·F0 is supplied to the each of the cylinders. That is, the air-fuel ratio of each of the cylinders becomes equal to the stoichiometric air-fuel ratio A0/F0 in each of the cylinders.

Next, it is assumed that an amount of the fuel supplied to one certain specific cylinder is excessive in (by) 40% (i.e., 1.4·F0), and an amount of the fuel supplied to each of the remaining three cylinders is equal to an appropriate amount (a fuel amount required to have each of the air-fuel ratios of the cylinders coincide with the stoichiometric air-fuel ratio (i.e., F0)).

Under this assumption, a total amount of the air supplied to the four cylinders is equal to 4·A0. A total amount of the fuel supplied to the four cylinders is equal to 4.4·F0 (=1.4·F0+F0+F0+F0). Accordingly, the true average of the air-fuel ratio of the engine is equal to 4·A0/(4.4·F0)=A0/(1.1·F0). That is, the true average of the air-fuel ratio of the engine in this case is equal to the value obtained "when the amount of the fuel supplied to each of the cylinders is uniformly excessive in (by) 10%" as described above.

However, as described above, an amount of the unburnt substances (HC, CO, and $H_2$) in the exhaust gas drastically increases, as the air-fuel ratio of the mixture supplied to the cylinder becomes richer. Accordingly, an "amount of hydrogen $H_2$ included in the exhaust gas discharged from the four cylinders in the case in which only the amount of the fuel supplied to the certain cylinder becomes excessive in (by) 40%" becomes prominently greater than an "amount of hydrogen $H_2$ included in the exhaust gas discharged from the four cylinders in the case in which the amount of the fuel supplied to each of the cylinders is uniformly excessive in (by) 10%."

Consequently, due to the "preferential diffusion of hydrogen" described above, the output value of the air-fuel ratio sensor (56) becomes a value corresponding to an air-fuel ratio richer than the "true air-fuel ratio (A0/(1.1·F0)) of the engine." That is, even when the average of the air-fuel ratio of the exhaust gas is a "certain air-fuel ratio in the rich side", a concentration of hydrogen $H_2$ reaching the exhaust-gas-side electrode layer of the air-fuel ratio sensor (56) when the degree of the non-uniformity among the cylinder-by-cylinder air-fuel ratios is large is prominently higher than that when the degree of the non-uniformity among the cylinder-by-cylinder air-fuel ratios is small. Accordingly, the air-fuel ratio detected based on the output value of the air-fuel ratio sensor (56) and the base relationship becomes an air-fuel ratio richer than the true air-fuel ratio of the engine.

Consequently, by the main feedback control based on the output value of the air-fuel ratio sensor (56), the true average of the air-fuel ratio of the engine is caused to be leaner than the stoichiometric air-fuel ratio. This is the reason why the true average of the air-fuel ratio of the engine is controlled to be an "air-fuel ratio in the lean side with respect to (leaner than) the target air-fuel ratio", when the non-uniformity among the cylinder-by-cylinder air-fuel ratios (air-fuel ratio imbalance among the cylinders) occurs. It should be noted that such a "deviation/shift of the air-fuel ratio toward the lean side due to the preferential diffusion of hydrogen and the main feedback control" is simply referred to as a "erroneous lean correction."

The "erroneous lean correction" also similarly occurs when the air-fuel ratio of the imbalanced cylinder becomes leaner than the air-fuel ratio of the un-imbalanced cylinder. The reason for this will be described later.

When the erroneous lean correction occurs, there is a case in which the true average air-fuel ratio of the engine (and thus, a true average of the air-fuel ratio of the exhaust gas) becomes an air-fuel ratio leaner (larger) than the air-fuel ratio which is within the "window of the catalyst." Accordingly, there may be a case in which a purification efficiency of the NOx (nitrogen oxides) of the catalyst lowers, so that the discharge amount of NOx increases.

SUMMARY OF THE INVENTION

One of the objects of the present invention is to provide a fuel injection amount control apparatus (hereinafter, simply referred to as a "present invention apparatus") for an internal combustion engine, which can avoid the "increase of the discharge amount of NOx due to the erroneous lean correction which occurs when the non-uniformity among the cylinder-by-cylinder air-fuel ratios occurs."

The present invention apparatus is the fuel injection amount control apparatus for a multi-cylinder internal combustion engine, which comprises a three way catalyst, an air-fuel ratio sensor, a plurality of fuel injection valves, an actual detected air-fuel ratio obtaining section, an instructed fuel injection amount calculation section.

The three way catalyst is disposed in an exhaust passage of the engine and at a position downstream of an "exhaust gas aggregated portion" into which exhaust gases discharged from a plurality of the cylinders merge.

The air-fuel ratio sensor is disposed in the exhaust passage and at a "position between the exhaust gas aggregated portion and the catalyst." The air-fuel ratio sensor includes an air-fuel ratio detection element; an exhaust-gas-side electrode layer and a reference-gas-side electrode layer, that are formed so as to face to each other across the air-fuel ratio detection element; and a porous layer which covers the exhaust-gas-side electrode layer. The air-fuel ratio sensor outputs an output value corresponding to "an amount of oxygen (oxygen partial pressure, oxygen concentration) and an amount of unburnt substance (unburnt substance partial pressure, unburnt substance concentration)" contained in an "exhaust gas that has reached the exhaust-gas-side electrode layer via the porous layer" in an "exhaust gas passing through the position at which the air-fuel ratio sensor is disposed."

Each of the fuel injection valves is configured so as to inject a fuel to be contained in a mixture supplied to each of combustion chambers of a plurality of the cylinders in an amount corresponding to an instructed fuel injection amount. One or more of the fuel injectors is provided for each one of the cylinders.

The actual detected air-fuel ratio obtaining section obtains an actual detected air-fuel ratio by converting an actual output value of the air-fuel ratio sensor into an air-fuel ratio.

The instructed fuel injection amount calculation section calculates the instructed fuel injection amount by performing, based on the actual detected air-fuel ratio, a feedback correction on the "amount of fuel injected from a plurality of the fuel injection valves" in such a manner that the actual detected air-fuel ratio coincides with a target air-fuel ratio.

Further, the present invention apparatus comprises an air-fuel ratio imbalance indicating value obtaining section. The air-fuel ratio imbalance indicating value obtaining section obtains an air-fuel ratio imbalance indicating value, which becomes larger as a "degree of a non-uniformity among a plurality of the cylinders" of an "air-fuel ratio (that is, cylinder-by-cylinder air-fuel ratio) of each of mixtures supplied to each of combustion chambers of a plurality of the cylinders" becomes larger.

Further, the actual detected air-fuel ratio obtaining section is configured so as to obtain the actual detected air-fuel ratio by converting the actual output value of the air-fuel ratio sensor into an "air-fuel ratio which becomes leaner (larger)" as the obtained air-fuel ratio imbalance indicating value becomes larger.

According to the configuration described above, the actual output value of the air-fuel ratio sensor is converted into the air-fuel ratio which becomes leaner (larger) as the degree of the non-uniformity of the cylinder-by-cylinder air-fuel ratio among a plurality of the cylinders becomes larger. For example, in a case in which the actual output value of the air-fuel ratio sensor is a specific value, if the actual output value of the air-fuel ratio sensor is converted into a "first air-fuel ratio" when the non-uniformity of the cylinder-by-cylinder air-fuel ratio is a first degree, the actual output value of the air-fuel ratio sensor is converted into a "second value larger (leaner) than first air-fuel ratio" when the non-uniformity of the cylinder-by-cylinder air-fuel ratio is a "second degree larger than the first degree." This can compensate for the "shift of the output value of the air-fuel ratio sensor toward the rich side" caused by the non-uniformity of the cylinder-by-cylinder air-fuel ratio and the preferential diffusion of hydrogen, and therefore, the actual detected air-fuel ratio is made closer to the true air-fuel ratio. Thereafter, the amount of the fuel injected from a plurality of the fuel injection valves is feedback controlled in such a manner that the thus converted detected air-fuel ratio becomes equal to the target air-fuel ratio. Consequently, the degree of the erroneous lean correction is reduced, so that the increase of the discharge amount of NOx can be avoided.

It should be noted that the actual detected air-fuel ratio obtaining section is preferably configured so as to convert the actual output value of the air-fuel ratio sensor into the "much leaner air-fuel ratio" as the obtained air-fuel ratio imbalance indicating value becomes larger, in such a manner that the actual detected air-fuel ratio coincides with the "true air-fuel ratio of the exhaust gas discharged from a plurality of the cylinders."

In one of aspects of the present invention apparatus, the instructed fuel injection amount calculation section is configured so as to calculate a feedback correction term by multiplying a "value correlated to a difference between the actual detected air-fuel ratio and the target air-fuel ratio" by a "predetermined gain (feedback gain)", and so as to carry out the feedback correction using (based on) the feedback term. In this case, the instructed fuel injection amount calculation section is configured so as to set the gain to a larger value in a period after rich-lean inversion time point than one in a period after lean-rich inversion time point, the period after rich-lean inversion time point being a time period until a predetermined time elapses from a rich-lean inversion time point at which the actual detected air-fuel ratio has changed from an "air-fuel ratio richer than the stoichiometric air-fuel ratio" to an "air-fuel ratio leaner than the stoichiometric air-fuel ratio", and the period after lean-rich inversion time point being a time period until a predetermined time elapses from a lean-rich inversion time point at which the actual detected air-fuel ratio has changed from an "air-fuel ratio leaner than the stoichiometric air-fuel ratio" to an "air-fuel ratio richer than the stoichiometric air-fuel ratio".

According to the present invention apparatus, the actual detected air-fuel ratio is calculated in such a manner that the actual detected air-fuel ratio comes closer to the true air-fuel ratio. However, in a case in which the non-uniformity among cylinder-by-cylinder air-fuel ratios is occurring, a "change rate of the output value of the air-fuel ratio sensor (rich-lean inversion responsivity)" when the true air-fuel ratio of the exhaust gas has changed from the "air-fuel ratio richer than the stoichiometric air-fuel ratio" to the "air-fuel ratio leaner than the stoichiometric air-fuel ratio" is smaller than a change rate of the output value of the air-fuel ratio sensor (lean-rich inversion responsivity) when the true air-fuel ratio of the exhaust gas has changed from "air-fuel ratio leaner than the stoichiometric air-fuel ratio" to the "air-fuel ratio richer than the stoichiometric air-fuel ratio."

This is because, the output value of the air-fuel ratio sensor is affected by hydrogen which is produced in a great amount due to the occurrence of the non-uniformity among cylinder-by-cylinder air-fuel ratios. More specifically, even in a case in which the true air-fuel ratio of the exhaust gas is in the vicinity of the stoichiometric air-fuel ratio, since a "larger amount of hydrogen" is present in the vicinity of the upstream air-fuel ratio sensor as the non-uniformity among cylinder-by-cylinder air-fuel ratios becomes larger, the output value rapidly changes upon the lean-rich inversion time point, but the output value more gradually changes upon the rich-lean inversion time point. That is, the responsivity of the air-fuel ratio sensor becomes asymmetric.

Accordingly, if the feedback gain in the period after rich-lean inversion time point is the same as the feedback gain in the period after lean-rich inversion time point in the air-fuel ratio feedback control, a center of the feedback control (an average of the air-fuel ratio of the exhaust gas obtained as a result of the feedback control) may deviate from the target air-fuel ratio.

In view of the above, as the aspect described above, if the feedback gain in the period after rich-lean inversion time point is set a value larger than the feedback gain in the period after lean-rich inversion time point, it can be avoided that the center of the feedback control deviates from the target air-fuel ratio due to the asymmetric responsivity of the air-fuel ratio sensor.

The asymmetric responsivity of the air-fuel ratio sensor depends on an amount of the excessive hydrogen, and therefore, becomes stronger (greater) as the non-uniformity among the cylinder-by-cylinder air-fuel ratios becomes larger.

In view of the above, it is preferable that the instructed fuel injection amount calculation section be configured so as to set the gain in such a manner that a difference (magnitude of a difference) between the gain set in the period after rich-lean inversion time point and the gain set in the period after lean-rich inversion time point becomes larger as the air-fuel ratio imbalance indicating value becomes larger.

According to this aspect, it can be avoided that the center of the feedback control deviates from the target air-fuel ratio due to the asymmetric responsivity of the air-fuel ratio sensor, regardless of the degree of the non-uniformity among the cylinder-by-cylinder air-fuel ratios.

In one of aspects of the present invention apparatus, the actual detected air-fuel ratio obtaining section may, include a plurality of tables or functions, each defining a "relationship between the output value of the air-fuel ratio sensor and the true air-fuel ratio" for each of a plurality of the air-fuel ratio imbalance indicating values;

select a table or a function, corresponding to the obtained air-fuel ratio imbalance indicating value, out of a plurality of tables or functions; and obtain the actual detected air-fuel ratio by applying the actual output value of the air-fuel ratio sensor to the selected table or the selected function.

That is, the above described aspect obtains, in advance, the "relationship between the output value of the air-fuel ratio sensor and the true air-fuel ratio" for each of various air-fuel ratio imbalance indicating values according to experiments or the like, and stores in the storage device each obtained relationship between the output value of the air-fuel ratio sensor and the true air-fuel ratio, with linking the air-fuel ratio imbalance indicating value when the relationship was obtained. Further, when the actual air-fuel ratio imbalance indicating value is obtained, the above aspect selects the best matching table or function with respect to the obtained actual air-fuel ratio imbalance indicating value among the stored tables or functions, and obtains the detected air-fuel ratio using (based on) the selected table or function. In other words, the "output value-air-fuel ratio conversion table (or function)" corresponding the air-fuel ratio imbalance indicating value is prepared for each of the various air-fuel ratio imbalance indicating values in advance, the conversion table (or function) is selected which is in accordance with the actual air-fuel ratio imbalance indicating value, and the actual detected air-fuel ratio is obtained by applying the actual output value of the air-fuel ratio sensor to the selected conversion table (or function).

In contrast, in another aspect of the present invention apparatus, the actual detected air-fuel ratio obtaining section may be configured so as to:

include "a base table or a base function" which defines the "relationship between the output value of the air-fuel ratio sensor and the true air-fuel ratio" when "there is no non-uniformity among the cylinder-by-cylinder air-fuel ratios";

obtain, based on the obtained air-fuel ratio imbalance indicating value and the actual output value of the air-fuel ratio sensor, an output correction amount for correcting the actual output value of the air-fuel ratio sensor to be an leaner output value as the air-fuel ratio imbalance indicating value becomes larger, and for correcting the actual output value of the air-fuel ratio sensor to be an output value when there is no non-uniformity of the cylinder-by-cylinder air-fuel ratio among a plurality of the cylinders;

obtain a corrected output value by correcting the actual output value of the air-fuel ratio sensor based on the obtained output correction amount; and obtain the actual detected air-fuel ratio by applying the obtained corrected output value to the base table or the base function.

According to the aspect described above, the output value of the air-fuel ratio sensor is converted into the output value in the case in which no non-uniformity among the cylinder-by-cylinder air-fuel ratios is present, with the output correction amount which is obtained based on "the actual air-fuel ratio imbalance indicating value and the actual output value", and the converted output value is converted into the actual detected air-fuel ratio based on the "base table (or the base function) which defines the "relationship between the output value of the air-fuel ratio sensor and the true air-fuel ratio when no non-uniformity among the cylinder-by-cylinder air-fuel ratios is present."

Meanwhile, a difference between the air-fuel ratio of the imbalanced cylinder and the air-fuel ratio of the un-imbalanced cylinder becomes larger as the degree of the non-uniformity among the cylinder-by-cylinder air-fuel ratios becomes larger. Accordingly, the air-fuel ratio of the exhaust gas varies/fluctuates more greatly as the degree of the non-uniformity among the cylinder-by-cylinder air-fuel ratios becomes larger. In view of this fact, the air-fuel ratio imbalance indicating value can be obtained based on a "value which becomes larger as the fluctuation of the air-fuel ratio of the exhaust gas becomes larger." The "value which becomes larger as the fluctuation of the air-fuel ratio of the exhaust gas becomes larger" is, for example, a differential value d(abyfs)/dt of the air-fuel ratio (detected air-fuel ratio abyfs) represented by the output value of the air-fuel ratio sensor with respect to time, a second order differential value $d^2(abyfs)/dt^2$ of the detected air-fuel ratio abyfs with respect to time, a trace/trajectory length of the detected air-fuel ratio abyfs, and the like.

It is now assumed that the degree of the non-uniformity among the cylinder-by-cylinder air-fuel ratios becomes a "certain degree." In this case, in a period until the air-fuel ratio imbalance indicating value is obtained, the "actual detected air-fuel ratio" is obtained by converting the "actual output value of the air-fuel ratio sensor" into the air-fuel ratio under the assumption that the non-uniformity among the cylinder-by-cylinder air-fuel ratios is not present Here, it is assumed that the air-fuel ratio imbalance indicating value is a "specific value" based on the actual detected air-fuel ratio. Subsequently, when the air-fuel ratio imbalance indicating value is obtained, the "actual detected air-fuel ratio" is obtained by converting the "actual output value of the air-fuel ratio sensor" into the air-fuel ratio under a assumption (state) different from the assumption described above. Accordingly, the variation state of the actual detected air-fuel ratio changes if the air-fuel ratio imbalance indicating value varies, even when the variation state of the true air-fuel ratio of the exhaust gas remains unchanged. As is apparent from the above, if the air-fuel ratio imbalance indicating value is obtained based on the actual detected air-fuel ratio, the air-fuel ratio imbalance indicating value may not be a value which accurately represents the "degree of the non-uniformity among the cylinder-by-cylinder air-fuel ratios."

In view of the above, in one of aspects of the present invention apparatus, the air-fuel ratio imbalance indicating value obtaining section is configured so as to obtain, regardless of the air-fuel ratio imbalance indicating value, a virtual detected air-fuel ratio (abyfsvir) by converting the actual output value (Vabyfs) into an air-fuel ratio based on the "relationship between the output value of the air-fuel ratio sensor and the true air-fuel ratio when there is no non-uniformity of the cylinder-by-cylinder air-fuel ratio among a plurality of the cylinders", and so as to obtain the air-fuel ratio imbalance indicating value using the obtained virtual detected air-fuel ratio (abyfsvir).

According to the aspect described above, as long as the state of the variation of the true air-fuel ratio of the exhaust gas remains unchanged, the state of the variation of the virtual detected air-fuel ratio abyfsvir does not substantially change even when the obtained air-fuel ratio imbalance indicating value changes. Consequently, the air-fuel ratio imbalance indicating value which accurately represents the "degree of the non-uniformity among the cylinder-by-cylinder air-fuel ratios" can be obtained.

Because of the similar reason, in another aspect of the present invention apparatus, the air-fuel ratio imbalance indicating value obtaining section is configured so as to obtain the air-fuel ratio imbalance indicating value using an actual output proportional value (k·Vabyfs) which is directly proportional to the actual output value (Vabyfs) of the air-fuel ratio sensor. That is, the air-fuel ratio imbalance indicating value may be obtained based on a differential value d(k·Vabyfs)/dt of the actual output proportional value (k·Vabyfs) with respect to time, a second order differential value $d^2(k \cdot Vabyfs)/dt^2$ of the actual output proportional value (k·Vabyfs) with respect to time, a trace/trajectory length of the actual output proportional value (k·Vabyfs) in a predetermined period, or the like.

As long as the state of the variation of the true air-fuel ratio of the exhaust gas remains unchanged, the state of the variation of the value (e.g., the output value Vabyfs itself) proportional to the actual output value (Vabyfs) of the air-fuel ratio sensor does not substantially change even when the obtained air-fuel ratio imbalance indicating value changes. Consequently, according to the configuration described above, the air-fuel ratio imbalance indicating value which accurately represents the "degree of the non-uniformity among the cylinder-by-cylinder air-fuel ratios" can be obtained.

In the mean time, the instructed fuel injection amount calculation section in the present invention apparatus may be configured so as to calculate the instructed fuel injection amount by feedback controls the amount of the fuel to be injected from a plurality of the fuel injection valves based to the actual output value of the air-fuel ratio sensor in such a manner that a "value which is based on the actual output value of the air-fuel ratio sensor" coincides with a "target value." In other words, the feedback control is carried out without converting the value which is based on the actual output value into the air-fuel ratio.

In this case, the instructed fuel injection amount calculation section is configured so as to obtain a corrected output value by correcting the actual output value of the air-fuel ratio sensor in such a manner that the actual output value of the air-fuel ratio sensor becomes a leaner value (a value equal to the output value of the air-fuel ratio sensor when the air-fuel ratio of the exhaust gas becomes leaner) as the air-fuel ratio imbalance indicating value becomes larger, and so as to perform the feedback control based on the corrected output value.

As described before, the actual output value of the air-fuel ratio sensor becomes the value in the richer side as the degree of the non-uniformity among the cylinder-by-cylinder air-fuel ratios becomes larger. Accordingly, by obtaining the corrected output value by means of the above configuration, the "shift of the output value of the air-fuel ratio sensor toward the richer side" caused by the non-uniformity among the cylinder-by-cylinder air-fuel ratios and the preferential diffusion of hydrogen can be compensated. That is, the output value of the air-fuel ratio sensor is corrected so as to come closer to the "output value of the air-fuel ratio sensor corresponding to the true air-fuel ratio" when the non-uniformity among the cylinder-by-cylinder air-fuel ratios is not occurring. Thereafter, the above configuration carries out the feedback correction based on the corrected output value. Consequently, the degree of the erroneous lean correction is reduced, so that the increase of the discharge amount of NOx can be avoided.

In this case, it is preferable that the air-fuel ratio imbalance indicating value obtaining section be configured so as to obtain the air-fuel ratio imbalance indicating value based on the actual output proportional value (k·Vabyfs) which is a value directly proportional to the actual output value (Vabyfs) of the air-fuel ratio sensor, in place of the corrected output value.

The state of the variation of the corrected output value changes when the obtained air-fuel ratio imbalance indicating value changes, even in the case in which the true air-fuel ratio of the exhaust gas remains unchanged. In contrast, the state of the variation of the value directly proportional to the actual output value of the air-fuel ratio sensor (e.g., the output value itself) does not substantially change as long as the state of the variation of the true air-fuel ratio of the exhaust gas remains unchanged, even when the obtained air-fuel ratio imbalance indicating value changes. Accordingly, the configuration described above can obtain the air-fuel ratio imbalance indicating value which accurately represents the "degree of the non-uniformity among the cylinder-by-cylinder air-fuel ratios."

Other objects, features, and advantages of the present invention apparatus will be readily understood from the following description of each of embodiments of the present invention apparatus with reference to the accompanying drawings.

DESCRIPTION OF EMBODIMENTS

A fuel injection amount control apparatus (hereinafter, simply referred to as a "control apparatus") for an internal combustion engine according to each of embodiments of the present invention will be described with reference to the drawings. This control apparatus is a portion of an air-fuel ratio control apparatus for controlling an air-fuel ratio of a mixture supplied to the internal combustion engine (air-fuel ratio of the engine), and is also a portion of an inter-cylinder air-fuel ratio imbalance determining apparatus.

<First Embodiment>

(Configuration)

Figure 1:
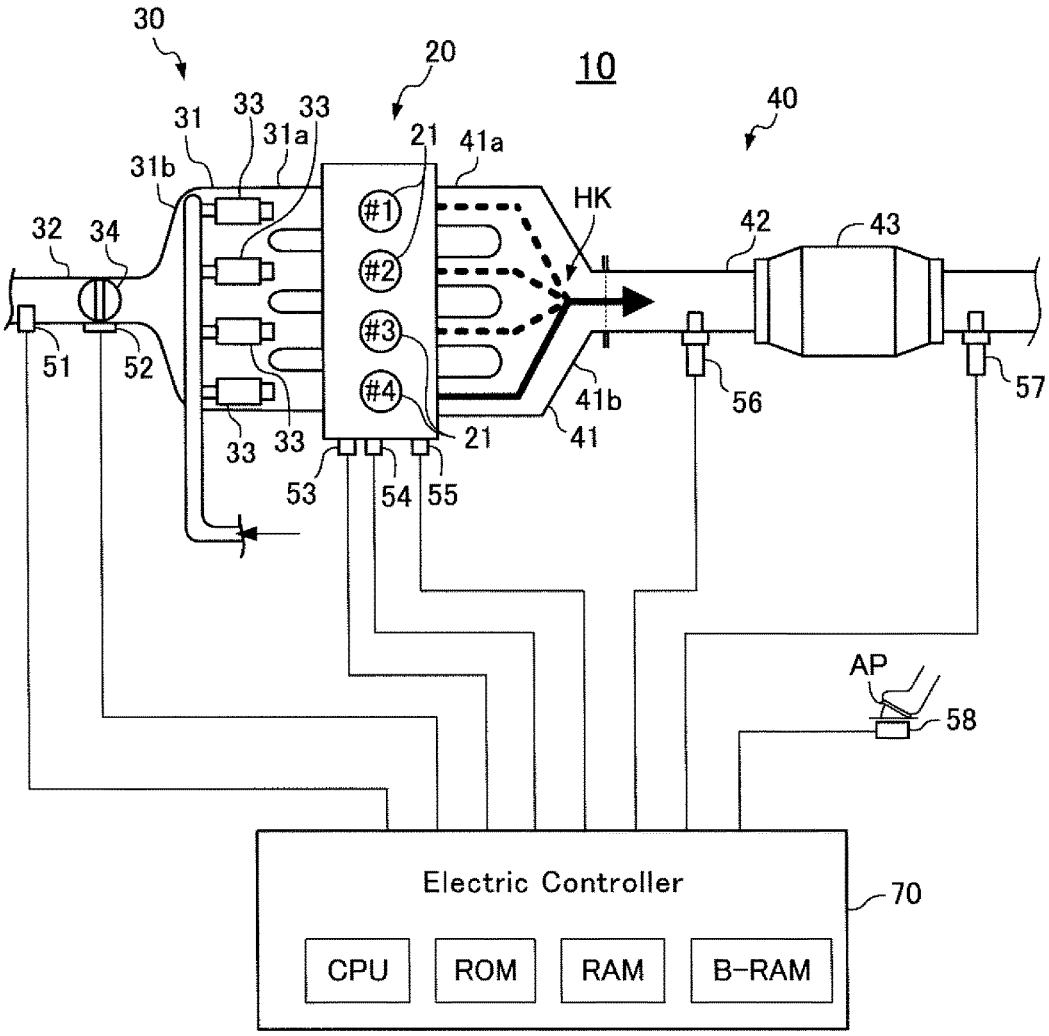
FIG. 1 is a schematic view of an internal combustion engine to which a fuel injection amount control apparatus according to each of embodiments of the present invention is applied.

FIG. 1 schematically shows a configuration of a system configured such that a control apparatus (hereinafter, referred to as a "first control apparatus") according to a first embodiment is applied to a spark-ignition multi-cylinder (straight 4-cylinder) four-cycle internal combustion engine 10.

This internal combustion engine 10 includes a main body section 20, an intake system 30, and an exhaust system 40.

The main body section 20 includes a cylinder block section and a cylinder head section. The main body section 20 has a plurality of cylinders (combustion chambers) 21. Each of the cylinders communicates with unillustrated "intake ports and exhaust ports." The communicating portions between the intake ports and the combustion chambers are opened and closed by unillustrated intake valves. The communicating portions between the exhaust ports and the combustion chambers are opened and closed by unillustrated exhaust valves. Each of the combustion chambers 21 is provided with an unillustrated spark plug.

The intake system 30 comprises an intake manifold 31, an intake pipe 32, a plurality of fuel injection valves 33, and a throttle valve 34.

The intake manifold 31 includes a plurality of branch portions 31*a* and a surge tank 31*b*. An end of each of a plurality of the branch portions 31*a* is connected to each of a plurality of the intake ports. The other end of each of a plurality of the branch portions 31*a* is connected to the surge tank 31*b*.

An end of the intake pipe 32 is connected to the surge tank 31*b*. An unillustrated air filter is provided at the other end of the intake pipe 32.

Each of the fuel injection valves 33 is provided for each of the cylinders (combustion chambers) 21. The fuel injection valve 33 is disposed in the intake port. That is, each of a plurality of the cylinders comprises the fuel injection valve 33 for supplying the fuel independently from the other cylinders. The fuel injection valve 33 is configured so as to inject, in response to an injection instruction signal, a "fuel of an instructed injection amount included in the injection instruction signal" into a corresponding intake port (and thus, to a cylinder corresponding to the fuel injection valve 33), when the fuel injection valve 33 is normal.

More specifically, the fuel injection valve 33 opens for a time period corresponding to the instructed fuel injection amount. A pressure of the fuel supplied to the fuel injection valve 33 is adjusted in such a manner that a difference between the pressure of the fuel and a pressure in the intake port is constant. Accordingly, when the fuel injection valve 33 is normal, the fuel injection valve 33 injects the fuel of the instructed fuel injection amount. However, when an abnormality occurs in the fuel injection valve 33, the fuel injection valve 33 injects the fuel of an amount different from the instructed fuel injection amount. This causes a non-uniformity of the cylinder-by-cylinder air-fuel ratio among the cylinders.

The throttle valve 34 is provided within the intake pipe 32. The throttle valve 34 is adapted to change the opening cross sectional area of the intake passage. The throttle valve 34 is rotated within the intake pipe 32 by an unillustrated throttle valve actuator.

The exhaust system 40 includes an exhaust manifold 41, an exhaust pipe 42, an upstream-side catalytic converter (catalyst) 43 disposed in the exhaust pipe 42, and an "unillustrated downstream-side catalytic converter (catalyst)" disposed in the exhaust pipe 42 at a position downstream of the upstream-side catalyst 43.

The exhaust manifold 41 comprises a plurality of branch portions 41*a* and an aggregated (merging) portion 41*b*. An end of each of a plurality of branch portions 41*a* is connected to each of a plurality of the exhaust ports. The other end of each of a plurality of branch portions 41*a* is connected to the aggregated portion 41*b*. This aggregated portion 41*b* is a portion into which the exhaust gases discharged from a plurality of (two or more of, and in the present example, four of) the cylinders aggregate (merge), and therefore, is referred to as an exhaust gas aggregated portion HK.

The exhaust pipe 42 is connected to the aggregated portion 41*b*. The exhaust ports, the exhaust manifold 41, and the exhaust pipe 42 constitute an exhaust passage.

Each of the upstream catalyst 43 and the downstream catalyst is a so-called three-way catalyst unit (exhaust purifying catalyst) carrying an active component formed of a so-called noble metal (catalytic substance) such as platinum, rhodium, and palladium. Each of the catalysts has a function of oxidizing unburned combustibles (substances) such as HC, CO, and $H_2$ and reducing nitrogen oxides (NOx) when the air-fuel ratio of a gas flowing into each of the catalysts is an "air-fuel ratio within a window of the three-way catalyst (e.g., stoichiometric air-fuel ratio)." This function is also called a "catalytic function." Furthermore, each of the catalysts has an oxygen storage function of occluding (storing) oxygen. Each of the catalysts can purify the unburned combustibles and the nitrogen oxides even when the air-fuel ratio deviates from the stoichiometric air-fuel ratio, owing to the oxygen storage function. That is, the oxygen storage function expands the width of the window. The oxygen storage function is realized by an oxygen occluding (storing) substances such as ceria ($CeO_2$) carried by the catalyst.

This system includes a hot-wire air-flow meter 51, a throttle position sensor 52, a water temperature sensor 53, a crank position sensor 54, an intake-cam position sensor 55, an upstream air-fuel ratio sensor 56, a downstream air-fuel ratio sensor 57, and an accelerator opening sensor 58.

The air-flow meter 51 outputs a signal corresponding to a mass flow rate (intake air flow rate) Ga of an intake air flowing through the intake pipe 32. That is, the intake air flow rate Ga represents an intake air amount taken into the engine 10 per unit time.

The throttle position sensor 52 detects an opening of the throttle valve 34 (throttle valve opening), and outputs a signal representing the detected throttle valve opening TA.

The water temperature sensor 53 detects a temperature of a cooling water of the internal combustion engine 10, and outputs a signal representing the detected cooling water temperature THW. The cooling water temperature THW is a parameter representing a warming state of the engine 10 (temperature of the engine 10).

The crank position sensor 54 outputs a signal including a narrow pulse generated every time the crankshaft rotates 10° and a wide pulse generated every time the crankshaft rotates 360°. This signal is converted to an engine rotational speed NE by an electric controller 70, which will be described later.

The intake-cam position sensor 55 outputs a single pulse when the intake camshaft rotates 90 degrees from a predetermined angle, when the intake camshaft rotates 90 degrees after that, and when the intake camshaft further rotates 180 degrees after that. Based on the signals from the crank position sensor 54 and the intake-cam position sensor 55, the electric controller 70, which will be described later, obtains an absolute crank angle CA, while using, as a reference, a compression top dead center of a reference cylinder (e.g., the first cylinder). This absolute crank angle CA is set to "0° crank angle" at the compression top dead center of the reference cylinder, increases up to 720° crank angle in accordance with the rotational angle of the crank shaft, and is again set to 0° crank angle at that point in time.

The upstream air-fuel ratio sensor 56 is disposed in "either one of the exhaust manifold 41 and the exhaust pipe 42" and at a position between the aggregated portion 41*b* (exhaust gas merging/aggregated portion HK) of the exhaust manifold 41 and the upstream catalyst 43. The upstream air-fuel ratio sensor 56 corresponds to an air-fuel ratio sensor in the present invention.

The air-fuel ratio sensor 56 is a "limiting-current-type wide range air-fuel ratio sensor including a diffusion resistance layer" disclosed in, for example, Japanese Patent Application Laid-Open (kokai) Nos. H11-72473, 2000-65782, and 2004-69547.

Figure 3:
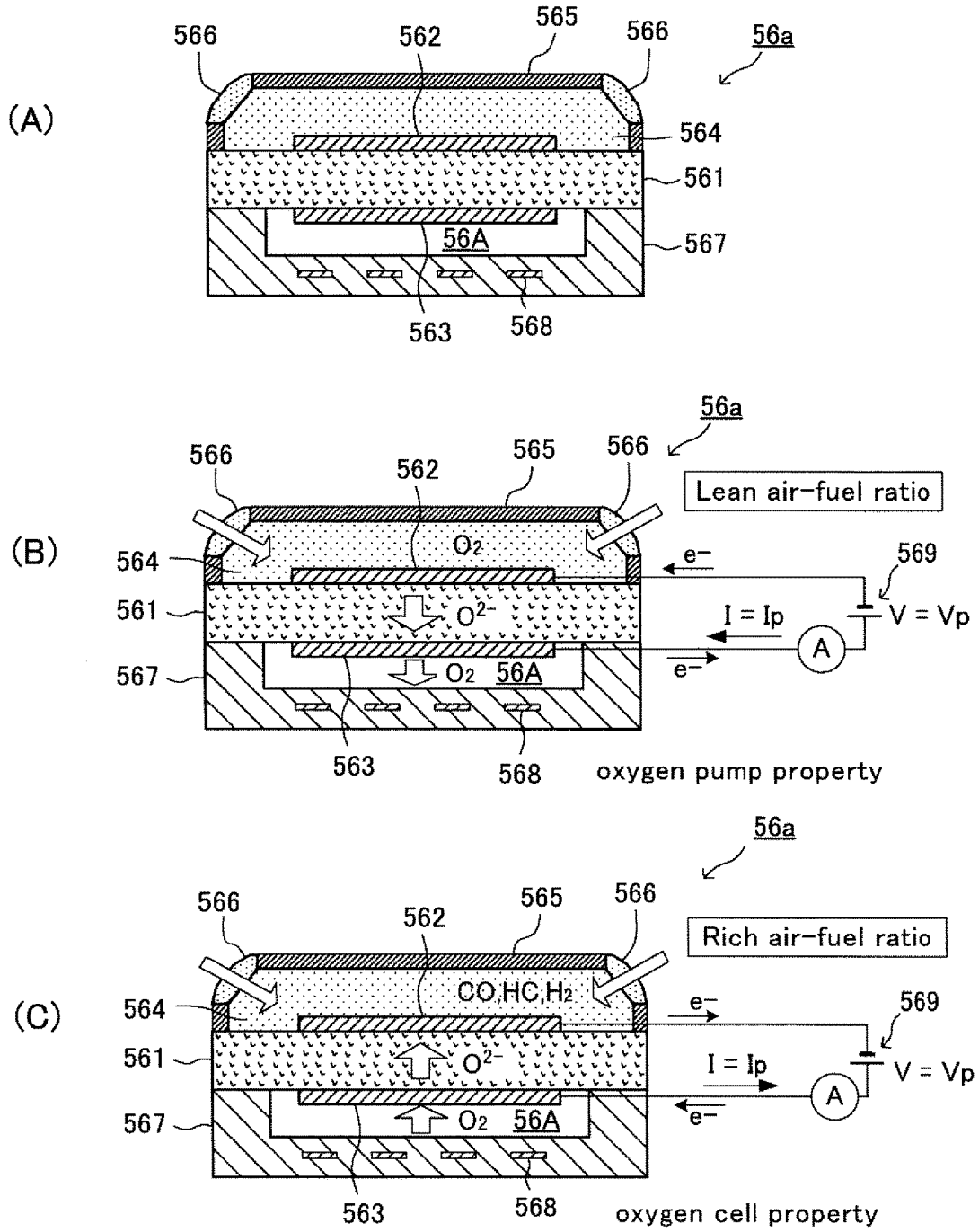
FIG. 3 Each of (A) to (C) of FIG. 3 is a schematic sectional view of an air-fuel ratio detection section of the air-fuel ratio sensor (upstream air-fuel ratio sensor) shown in FIG. 1.

As shown in FIG. 3, the upstream air-fuel ratio sensor 56 includes an air-fuel ratio detection section 56*a*. The air-fuel ratio detection section 56*a* is accommodated in an unillustrated "protective cover which is a hollow cylinder formed of metal." Through holes are formed in its peripheral wall and in its bottom wall. The exhaust gas flows into the protective cover through the through holes formed in the peripheral wall, reaches the air-fuel ratio detection section 56*a*, and thereafter, flows out to the outside of the protective cover through the through holes formed in the bottom wall.

That is, the exhaust gas reaching the protective cover is sucked into the inside of the protective cover owing to the flow (stream) of the exhaust gas flowing in the vicinity of the through holes formed in the bottom wall of the protective cover. Thus, a flow rate of the exhaust gas in the protective cover varies depending on the flow rate of the exhaust gas flowing in the vicinity of the through holes formed in the bottom wall of the protective cover (and accordingly, depending on the intake air-flow amount (rate) Ga which is the intake air amount per unit time). Accordingly, the output responsivity (responsivity) of the upstream air-fuel ratio sensor 56 with respect to the "air-fuel ratio of the exhaust gas flowing through the exhaust passage" becomes higher (better) as the intake air amount Ga becomes greater, but the output responsivity does not vary depending on the engine rotational speed NE.

As shown in (A) to (C) of FIG. 3, the air-fuel ratio detection section 56*a* includes a solid electrolyte layer 561 an exhaust-gas-side electrode layer 562, an atmosphere-side electrode layer (reference-gas-side electrode layer) 563, a diffusion resistance layer 564, a first partition 565, a catalytic section 566, a second partition section 567, and a heater 568.

The solid electrolyte layer 561 is formed of an oxygen-ion-conductive sintered oxide. In this embodiment, the solid electrolyte layer 561 is a "stabilized zirconia element" which is a solid solution of $ZrO_2$ (zirconia) and CaO (stabilizer). The solid electrolyte layer 561 exhibits an "oxygen cell property" and an "oxygen pump property," which are well known, when its temperature is equal to or higher than an activation temperature.

The exhaust-gas-side electrode layer 562 is formed of a noble metal having a high catalytic activity, such as platinum (Pt). The exhaust-gas-side electrode layer 562 is formed on one of surfaces of the solid electrolyte layer 561. The exhaust-gas-side electrode layer 562 is formed through chemical plating, etc. so as to exhibit an adequate permeability (that is, it is formed into a porous layer).

The atmosphere-side electrode layer 563 is formed of a noble metal having a high catalytic activity, such as platinum (Pt). The atmosphere-side electrode layer 563 is formed on the other one of surfaces of the solid electrolyte layer 561 in such a manner it faces the exhaust-gas-side electrode layer 562 across the solid electrolyte layer 561. The atmosphere-side electrode layer 563 is formed through chemical plating, etc. so as to exhibit an adequate permeability (that is, it is formed into a porous layer). The atmosphere-side electrode layer 563 is also referred to as a reference-gas-side electrode layer.

The diffusion resistance layer (diffusion-controlling layer) 564 is a porous layer formed of a porous ceramic material (heat-resistant inorganic material). The diffusion resistance layer 564 is formed through, for example, plasma spraying in such a manner that it covers the outer surface of the exhaust-gas-side electrode layer 562.

The first partition section 565 is formed of dense and gas-nonpermeable alumina ceramic. The first partition section 565 is formed so as to cover the diffusion resistance layer 564 except corners (portions) of the diffusion resistance layer 564. That is, the first partition section 565 has pass-through portions which expose portions of the diffusion resistance layer 564 to outside.

The catalytic section 566 is formed in the pass-through portions of the first partition section 565 so as to close the pass-through portions. The catalytic section 566 includes the catalytic substance which facilitates an oxidation-reduction reaction and a substance for storing oxygen which exerts the oxygen storage function, similarly to the upstream catalyst 43. The catalytic section 566 is porous. Accordingly, as shown by a white painted arrows in (B) and (C) of FIG. 3, the exhaust gas (the above described exhaust gas flowing into the inside of the protective cover) reaches the diffusion resistance layer 564 through the catalytic section 566, and then further reaches the exhaust-gas-side electrode layer 562 through the diffusion resistance layer 564.

The second partition section 567 is formed of dense and gas-nonpermeable alumina ceramic. The second partition section 567 is configured so as to form an "atmosphere chamber 56A" which is a space that accommodates the atmosphere-side electrode layer 563. Air is introduced into the atmosphere chamber 56A.

A power supply 569 is connected to the upstream air-fuel ratio sensor 56. The power supply 569 applies a voltage V (=Vp) in such a manner that the atmosphere-side electrode layer 563 is held at a high potential and the exhaust-gas-side electrode layer 562 is held at a low potential.

The heater 568 is buried in the second partition section 567. The heater 568 generates heat when energized by the electric controller 70 described later so as to heat up the solid electrolyte layer 561, the exhaust-gas-side electrode layer 562, and the atmosphere-side electrode layer 563 in order to control temperatures of those layers.

Figure 4:
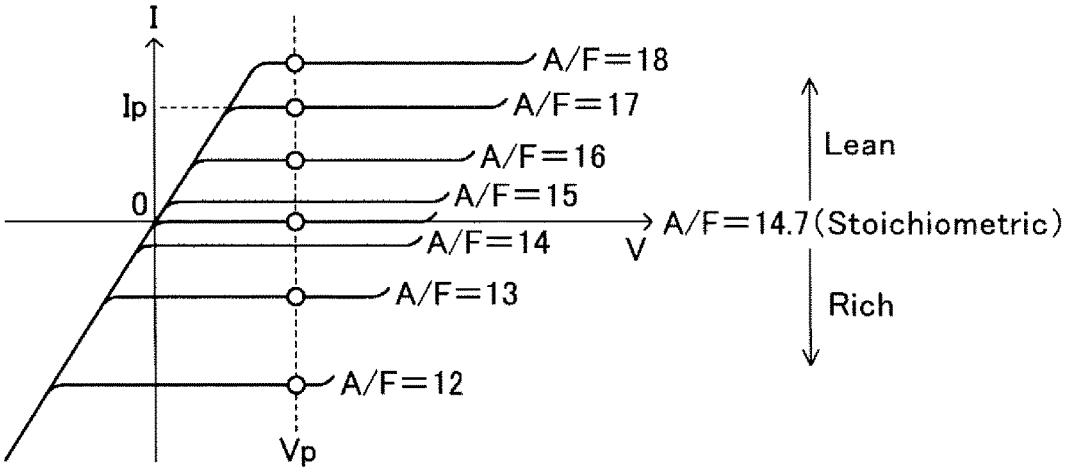
FIG. 4 is a graph showing a relationship between an air-fuel ratio of an exhaust gas and a limiting current value of the air-fuel ratio sensor.

As shown in (B) of FIG. 3, when the air-fuel ratio of the exhaust gas is leaner than the stoichiometric air-fuel ratio, the thus configured upstream air-fuel ratio sensor 56 ionizes oxygen which has reached the exhaust-gas-side electrode layer 562 through the diffusion resistance layer 564, and makes the ionized oxygen reach the atmosphere-side electrode layer 563. As a result, an electrical current I flows from a positive electrode of the electric power supply 569 to a negative electrode of the electric power supply 569. As shown in FIG. 4, the magnitude of the electrical current I becomes a constant value which is proportional to an amount of oxygen arriving at the exhaust-gas-side electrode layer 562 (or an oxygen partial pressure, an oxygen concentration, and thus, the air-fuel ratio of the exhaust gas), when the electric voltage V is set at a predetermined value Vp or higher. The upstream air-fuel ratio sensor 56 outputs a voltage value into which this electrical current (i.e., the limiting current Ip) is converted, as its output value Vabyfs.

To the contrary, as shown in (C) of FIG. 3, when the air-fuel ratio of the exhaust gas is richer than the stoichiometric air-fuel ratio, the upstream air-fuel ratio sensor 56 ionizes oxygen which is present in the atmosphere chamber 56A and makes the ionized oxygen reach the exhaust-gas-side electrode layer 562 so as to oxide the unburned substances (combustibles) (HC, CO, and $H_2$, etc.) reaching the exhaust-gas-side electrode layer 562 through the diffusion resistance layer 564. As a result, an electrical current I flows from the negative electrode of the electric power supply 569 to the positive electrode of the electric power supply 569. As shown in FIG. 4, the magnitude of the electrical current I also becomes a constant value which is proportional to an amount of the unburned combustibles arriving at the exhaust-gas-side electrode layer 562 (a partial pressure of the unburned combustibles, a concentration of the unburned combustibles, and thus, the air-fuel ratio of the exhaust gas), when the electric voltage V is set at the predetermined value Vp or higher. The upstream air-fuel ratio sensor 56 outputs a voltage value into which the electrical current (i.e., the limiting current Ip) is converted, as its output value Vabyfs.

Figure 5:
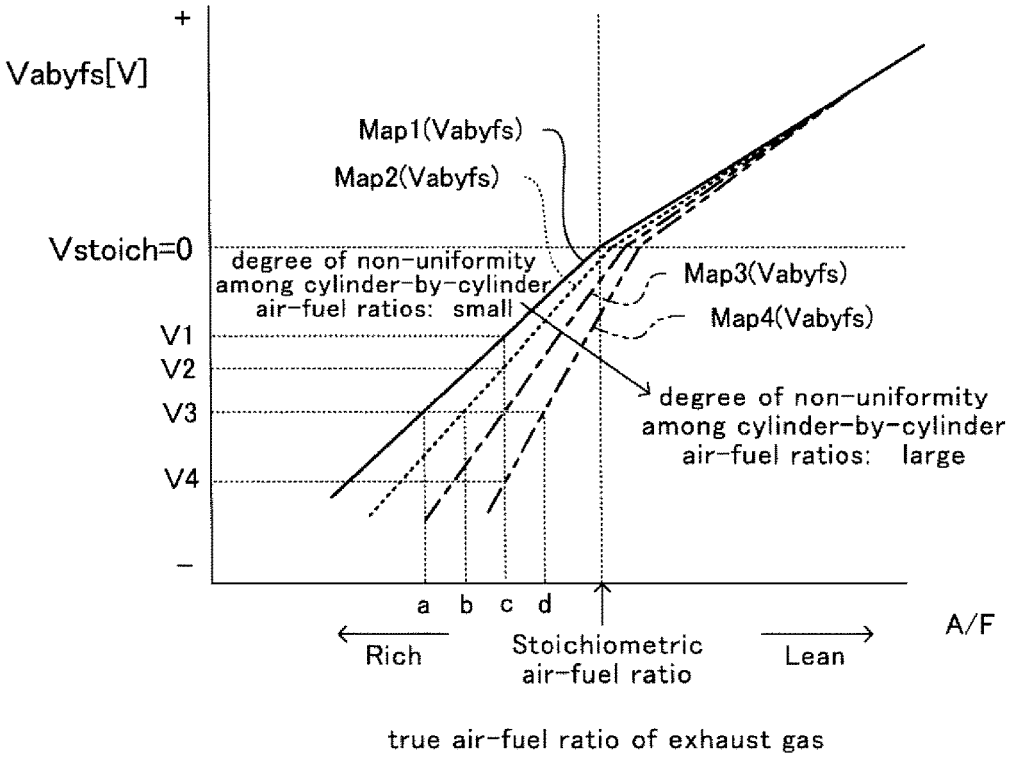
FIG. 5 is a graph showing a relationship between the air-fuel ratio of the exhaust gas and an output value of the air-fuel ratio sensor.

That is, the air-fuel detection section 56*a*, as shown in FIG. 5, outputs, as an "air-fuel ratio sensor output", the output value Vabyfs which corresponds to the air-fuel ratio of the gas which is flowing at the position at which the upstream air-fuel ratio sensor 56 is disposed and is reaching the air-fuel detection section 56*a* through the through holes of the protective cover. In other words, the upstream air-fuel ratio sensor 56 outputs the output value Vabyfs which varies depending on "the oxygen partial pressure (oxygen concentration, oxygen amount) and the unburnt substance partial pressure (unburnt substance concentration, unburnt substance amount)" of the gas reaching the exhaust-gas-side electrode layer 562 which has passed through the diffusion resistance layer 564 of the air-fuel detection section 56*a*.

This output value Vabyfs becomes larger as the air-fuel ratio of the gas reaching the air-fuel ratio detection section 56*a* becomes larger (leaner). That is, the output value Vabyfs changes as shown by a solid line in FIG. 5, when the non-uniformity among the cylinder-by-cylinder air-fuel ratios is not present (i.e., when the air-fuel ratios of the cylinders are the same as each other among the cylinders). The output value Vabyfs becomes equal to a stoichiometric air-fuel ratio corresponding value Vstoich, when the air-fuel ratio of the gas reaching the air-fuel ratio detection section 56*a* is equal to the stoichiometric air-fuel ratio.

As is apparent from the above, it can be said that "the upstream air-fuel ratio sensor 56 is an air-fuel ratio sensor, which is disposed in the exhaust passage and at the position between the exhaust gas aggregated portion HK and the catalyst (upstream catalyst 43); and which comprises the air-fuel ratio detection section (solid electrolyte layer) 561, the exhaust-gas-side electrode layer 562 and the reference-gas-side electrode layer (atmosphere-side electrode layer) 563 which are formed so as to face each other across the air-fuel ratio detection section." Further, the upstream air-fuel ratio sensor 56 outputs the output value Vabyfs which is indicative of "the oxygen amount and the unburnt substance amount" contained in the "exhaust gas reaching the exhaust-gas-side electrode layer 562 after passing through the porous layer (diffusion resistance layer) 564" among the "exhaust gas passing through the position at which the upstream air-fuel ratio sensor 56 is disposed."

Furthermore, it can be said that "the upstream air-fuel ratio sensor 56 is an "air-fuel ratio sensor, which includes the air-fuel ratio detection section 56*a* comprising the solid electrolyte layer 561, the exhaust-gas-side electrode layer 562 formed on one of surfaces of the solid electrolyte layer 561, the diffusion resistance layer 564 which covers the exhaust-gas-side electrode layer 562 and the exhaust gas reaches, and the atmosphere-side electrode layer 563 which is formed on the other surfaces of the solid electrolyte layer 561 and is exposed in the atmosphere chamber 56A; and which outputs the output values Vabyfs being in accordance with (indicative of) the air-fuel ratio of the exhaust gas passing through the position at which the air-fuel ratio sensor 56 is disposed."

Meanwhile, the unburnt substances including hydrogen that are contained in the exhaust gas are purified in the catalytic section 566 to some degree. However, the catalytic section 566 can not completely purify the unburnt substances when a great amount of the unburnt substances are contained in the exhaust gas. As a result, there may be a case in which "the oxygen and the unburnt substances that are excessive with respect to the oxygen" reach the outer surface of the diffusion resistance layer 564. Further, as described above, a molecule size of hydrogen is smaller than a molecule size of the other unburnt substances, and thus, the hydrogen preferentially diffuses through the diffusion resistance layer 564 as compared with the other unburnt substances.

Meanwhile, as described above, the greater amount of the unburnt substances are produced as the non-uniformity among the cylinder-by-cylinder air-fuel ratios becomes larger. Accordingly, an amount of hydrogen which reaches the outer surface of the diffusion resistance layer 564 becomes larger. Consequently, the concentration (partial pressure) of hydrogen reaching the exhaust-gas-side electrode layer 562 when the non-uniformity among the cylinder-by-cylinder air-fuel ratios is large is prominently larger than one when the non-uniformity among the cylinder-by-cylinder air-fuel ratios is small. Therefore, as the non-uniformity among the cylinder-by-cylinder air-fuel ratios becomes larger, the output value of the upstream air-fuel ratio sensor 56 shifts toward a value corresponding an richer air-fuel ratio with respect to the true air-fuel ratio of the engine 10 (true air-fuel ratio of the exhaust gas).

That is, as shown in FIG. 5, as the non-uniformity among the cylinder-by-cylinder air-fuel ratios becomes larger, the output value Vabyfs of the upstream air-fuel ratio sensor 56 becomes a value corresponding to an air-fuel ratio which becomes richer (smaller) with respect the true air-fuel ratio of the exhaust gas. In other words, the output value Vabyfs becomes smaller as the non-uniformity among the cylinder-by-cylinder air-fuel ratios becomes larger. It should be noted that each of the lines shown in FIG. 5 indicates a "relationship between the output value Vabyfs and the true air-fuel ratio" in the following cases.

Solid line: A case in which the non-uniformity among the cylinder-by-cylinder air-fuel ratios is not present. In this case, the degree of the non-uniformity among the cylinder-by-cylinder air-fuel ratios is expressed as a "first degree".

Broken line: A case in which the non-uniformity among the cylinder-by-cylinder air-fuel ratios is present, and the degree of the non-uniformity among the cylinder-by-cylinder air-fuel ratios is a "second degree larger than the first degree."

Alternate long and short dash line: A case in which the non-uniformity among the cylinder-by-cylinder air-fuel ratios is present, and the degree of the non-uniformity among the cylinder-by-cylinder air-fuel ratios is a "third degree larger than the second degree."

Alternate long and two short dashes line: A case in which the non-uniformity among the cylinder-by-cylinder air-fuel ratios is present, and the degree of the non-uniformity among the cylinder-by-cylinder air-fuel ratios is a "fourth degree larger than the third degree."

It is assumed that the true air-fuel ratio of the exhaust gas is equal to a "value c shown in FIG. 5." In this case, the output value Vabyfs becomes equal to V1, V2, V3, and V4 (V1 >V2 >V3 >V4) when the degree of the non-uniformity among the cylinder-by-cylinder air-fuel ratios is equal to the first, second, third, and fourth degree, respectively. That is, as described above, the output value Vabyfs becomes smaller as the degree of the non-uniformity among the cylinder-by-cylinder air-fuel ratios becomes larger.

It is assumed that the electric controller 70 is configured so as to store, as the "air-fuel ratio conversion table Map1 (Vabyfs)", the "relationship shown by the solid line in FIG. 5" only, and so as to convert the actual output value Vabyfs into an air-fuel ratio using the air-fuel ratio conversion table Map1 (Vabyfs).

Under this assumption, when the actual output value Vabyfs is equal to the "value V3 shown in FIG. 5", for example, the converted air-fuel ratio by the air-fuel ratio conversion table Map1 (Vabyfs) is an air-fuel ratio a. However, the true air-fuel ratio of the exhaust gas is b (b>a) if the non-uniformity among the cylinder-by-cylinder air-fuel ratios is the second degree, the true air-fuel ratio of the exhaust gas is c (c>b) if the non-uniformity among the cylinder-by-cylinder air-fuel ratios is the third degree, and the true air-fuel ratio of the exhaust gas is d (d>c) if the non-uniformity among the cylinder-by-cylinder air-fuel ratios is the fourth degree. In this manner, when the actual output value Vabyfs is a "certain constant value", the "air-fuel ratio obtained by the air-fuel ratio conversion table Map1 (Vabyfs)" becomes an air-fuel ratio in the richer side (smaller air-fuel ratio) in relation to the "true air-fuel ratio of the exhaust gas", as the degree of the non-uniformity among the cylinder-by-cylinder air-fuel ratios becomes larger. This is the reason why the erroneous lean correction occurs.

In view of the above, the electric controller 70 stores, as the air-fuel ratio conversion tables, the relationships shown by the lines in FIG. 5 with (making a connection with, or linking to) the "air-fuel ratio imbalance indicating values RIMB", each of which becomes larger as the "degree of the non-uniformity among the cylinder-by-cylinder air-fuel ratios" become larger. More specifically, the electric controller 70 stores, in the ROM, an air-fuel ratio conversion table Map1 (Vabyfs) when the air-fuel ratio imbalance indicating value RIMB is equal to a value R1 (=0), an air-fuel ratio conversion table Map2 (Vabyfs) when the air-fuel ratio imbalance indicating value RIMB is equal to a value R2 (R2>R1), an air-fuel ratio conversion table Map3 (Vabyfs) when the air-fuel ratio imbalance indicating value RIMB is equal to a value R3 (R3>R2), and an air-fuel ratio conversion table Map4 (Vabyfs) when the air-fuel ratio imbalance indicating value RIMB is equal to a value R4 (R4>R3).

Further, the electric controller 70 obtains the air-fuel ratio imbalance indicating value RIMB. The electric controller 70 selects a single (one) air-fuel ratio conversion table being made a connection with the air-fuel ratio imbalance indicating value RIMB which is the closest to the obtained air-fuel ratio imbalance indicating value RIMB, among (out of) the air-fuel ratio conversion table Map1 (Vabyfs) to the air-fuel ratio conversion table Map4 (Vabyfs). The electric controller 70 obtains an actual detected air-fuel ratio abyfsact by applying the actual output value Vabyfs to the selected air-fuel ratio conversion table. Thereafter, the electric controller 70 performs a feedback control of the air-fuel ratio in such a manner that the actual detected air-fuel ratio abyfsact coincides with a target air-fuel ratio abyfr.

Referring back to FIG. 1, the downstream air-fuel ratio sensor 57 is disposed in the exhaust pipe 42. A position at which the downstream air-fuel ratio sensor 57 is disposed is downstream of the upstream catalyst 43 and upstream of the downstream catalyst (i.e., in the exhaust passage between the upstream catalyst 43 and the downstream catalyst). The downstream air-fuel ratio sensor 57 is a well-known electromotive-force-type oxygen concentration sensor (a well-known concentration-cell-type oxygen concentration sensor using stabilized zirconia). The downstream air-fuel ratio sensor 57 is designed to generate an output value Voxs corresponding to the air-fuel ratio of a gas to be detected, the gas flowing through a portion of the exhaust passage where the downstream air-fuel ratio sensor 57 is disposed. In other words, the output value Voxs is a value corresponding to the air-fuel ratio of the gas which flows out of the upstream catalyst 43 and flows into the downstream catalyst.

Figure 6:
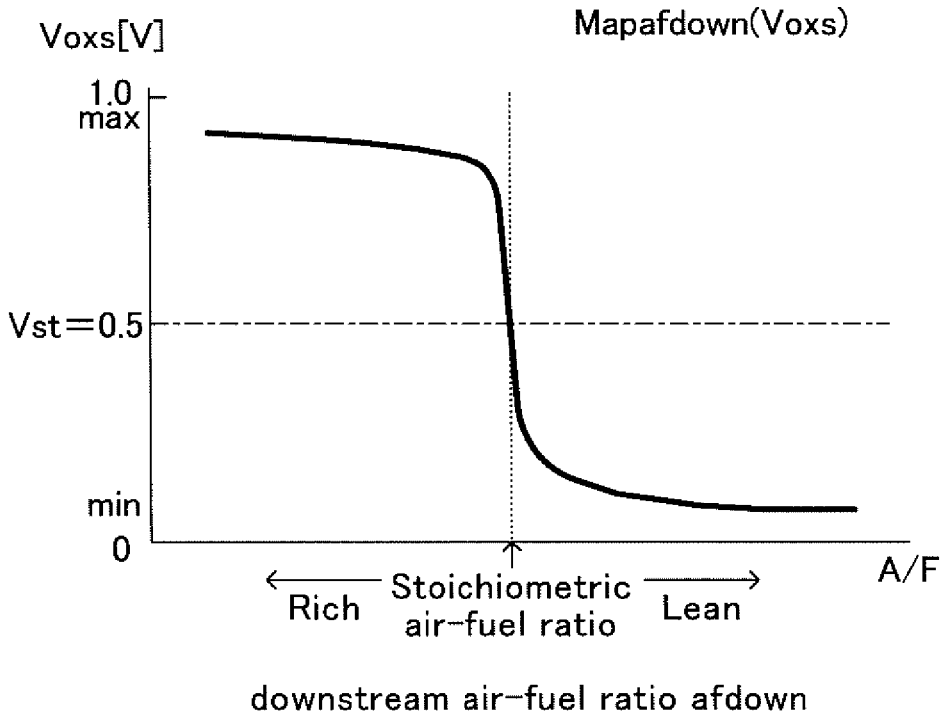
FIG. 6 is a graph showing a relationship between an air-fuel ratio of an exhaust gas and an output value of a downstream air-fuel ratio sensor shown in FIG. 1.

As shown in FIG. 6, this output value Voxs becomes a maximum output value max (e.g., about 0.9 V to 1.0 V) when the air-fuel ratio of the gas to be detected is richer than the stoichiometric air-fuel ratio. The output value Voxs becomes a minimum output value min (e.g., about 0.1 V to 0 V) when the air-fuel ratio of the gas to be detected is leaner than the stoichiometric air-fuel ratio. Further, the output value Voxs becomes a voltage Vst (midpoint voltage Vst, e.g., about 0.5 V) which is approximately the midpoint value between the maximum output value max and the minimum output value min when the air-fuel ratio of the gas to be detected is equal to the stoichiometric air-fuel ratio. The output value Vox drastically changes from the maximum output value max to the minimum output value min when the air-fuel ratio of the gas to be detected changes from the air-fuel ratio richer than the stoichiometric air-fuel ratio to the air-fuel ratio leaner than the stoichiometric air-fuel ratio. Similarly, the output value Vox drastically changes from the minimum output value min to the maximum output value max when the air-fuel ratio of the gas to be detected changes from the air-fuel ratio leaner than the stoichiometric air-fuel ratio to the air-fuel ratio richer than the stoichiometric air-fuel ratio.

It should be noted that the downstream air-fuel ratio sensor 57 also comprises a solid electrolyte layer, "an exhaust-gas-side electrode layer and an atmosphere-side electrode layer (a reference-gas-side electrode layer)" which are formed so as to face each other across the solid electrolyte layer. In addition, the exhaust-gas-side electrode layer is covered with a porous layer (protective layer). Accordingly, the gas to be detected changes into a gas after oxygen equilibrium (gas produced after oxygen and unburnt substances are reacted with each other) when the gas to be detected passes through the porous layer, and reach the exhaust-gas-side electrode layer. Hydrogen passes the porous layer more easily than the other unburnt substances. Note, however, that the "excessive hydrogen produced upon the occurrence of the non-uniformity among the cylinder-by-cylinder air-fuel ratios" is eliminated by the upstream catalyst 43 except a specific case. Accordingly, the output value Voxs of the downstream air-fuel ratio sensor 57 does not vary depending on the degree of the non-uniformity among the cylinder-by-cylinder air-fuel ratios except the specific case.

The accelerator opening sensor 58 shown in FIG. 1 is designed to output a signal which indicates the operation amount Accp of the accelerator pedal AP operated by the driver (accelerator pedal operation amount Accp, opening degree of the accelerator pedal AP). The accelerator pedal operation amount Accp increases as the operation amount of the accelerator pedal AP becomes larger.

The electric controller 70 is a well-known microcomputer which includes "a CPU; a ROM in which programs executed by the CPU, tables (maps and/or functions), constants, etc. are stored in advance; a RAM in which the CPU temporarily stores data as needed; a backup RAM; and an interface which includes an AD converter, etc."

The backup RAM is supplied with an electric power from a battery mounted on a vehicle on which the engine 10 is mounted, regardless of a position (off-position, start position, on-position, and so on) of an unillustrated ignition key switch of the vehicle. While the electric power is supplied to the backup RAM, data is stored in (written into) the backup RAM according to an instruction of the CPU, and the backup RAM holds (retains, stores) the data in such a manner that the data can be read out. Accordingly, the backup RAM can keep the data while the engine 10 is stopped.

When the battery is taken out from the vehicle, for example, and thus, when the backup RAM is not supplied with the electric power, the backup RAM can not hold the data. Accordingly, the CPU initializes the data to be stored (sets the data to default values) in the backup RAM when the electric power starts to be supplied to the backup RAM again. The backup RAM may be replaced with a nonvolatile readable and writable memory such as an EEPROM.

The electric controller 70 is connected to sensors described above so as to send signals from those sensors to the CPU. In addition, the electric controller 70 is designed to send drive signals (instruction signals) to each of the spark plugs (in actuality, the igniters) provided for each of the cylinders, each of the fuel injection valves 33 provided for each of the cylinders, the throttle valve actuator, and the like, in response to instructions from the CPU.

The electric controller 70 is designed to send the instruction signal to the throttle valve actuator so that the throttle valve opening TA increases as the obtained accelerator pedal operation amount Accp increases. That is, the electric controller 70 has a throttle valve drive section for changing the opening of the "throttle valve 34 disposed in the intake passage of the engine 10" in accordance with the acceleration operation amount (accelerator pedal operation amount Accp) of the engine 10 which is changed by the driver.

(An Outline of the Air-Fuel Ratio Control by the First Control Apparatus)

When an air-fuel ratio of the imbalanced cylinder becomes richer than an air-fuel ratio of the un-imbalanced cylinder, the erroneous lean correction occurs due to the feedback control (main feedback control) based on the output value Vabyfs of the upstream air-fuel ratio sensor 56. The reason for this has already been described.

The erroneous lean correction also occurs when the air-fuel ratio of the imbalanced cylinder deviates toward the lean side compared to the air-fuel ratio of the un-imbalanced cylinder. This state occurs, for example, when the fuel injection characteristic of the fuel injection valve 33 provided for the specific cylinder changes to inject the fuel in (by) an amount which is considerable smaller than the instructed fuel injection amount.

Here, it is assumed that an amount (weight) of the intake air introduced into each of the cylinders of the engine 10 is A0. Further, it is assumed here that an air-fuel ratio A0/F0 is equal to the stoichiometric air-fuel ratio, when an amount (weight) of a fuel supplied to each of the cylinders is F0. Furthermore, it is assumed that an amount of the fuel supplied to one specific cylinder (the first cylinder, for convenience) is small in (by) 40% (i.e., 0.6·F0), and an amount of the fuel supplied to each of the other three cylinders (the second, the third, and the fourth cylinder) is a fuel amount required to have each of the air-fuel ratios of the other three cylinders coincide with the stoichiometric air-fuel ratio (i.e., F0). It should be noted it is assumed that a misfiring does not occur.

In this case, by the main feedback control, it is further assumed that the amount of the fuel supplied to each of the first to fourth cylinders is increased in the same amount (10%) to each other. At this time, the amount of the fuel supplied to the first cylinder is equal to 0.7·F0, and the amount of the fuel supplied to each of the second to fourth cylinders is equal to 1.1·F0.

Under this assumption, a total amount of the air supplied to the engine 10 which is the four cylinder engine (an amount of air supplied to the entire engine 10 during the period in which each and every cylinder completes one combustion stroke) is equal to 4·A0. A total amount of the fuel supplied to the engine 10 (an amount of fuel supplied to the entire engine 10 during the period in which each and every cylinder completes one combustion stroke) is equal to 4.0·F0 (=0.7·F0+1.1·F0+1.1·F0+1.1·F0), as a result of the main feedback control. Consequently, the true average of the air-fuel ratio of the mixture supplied to the entire engine 10 is equal to 4·A0/(4·F0)=A0/F0, that is the stoichiometric air-fuel ratio.

Figure 2:
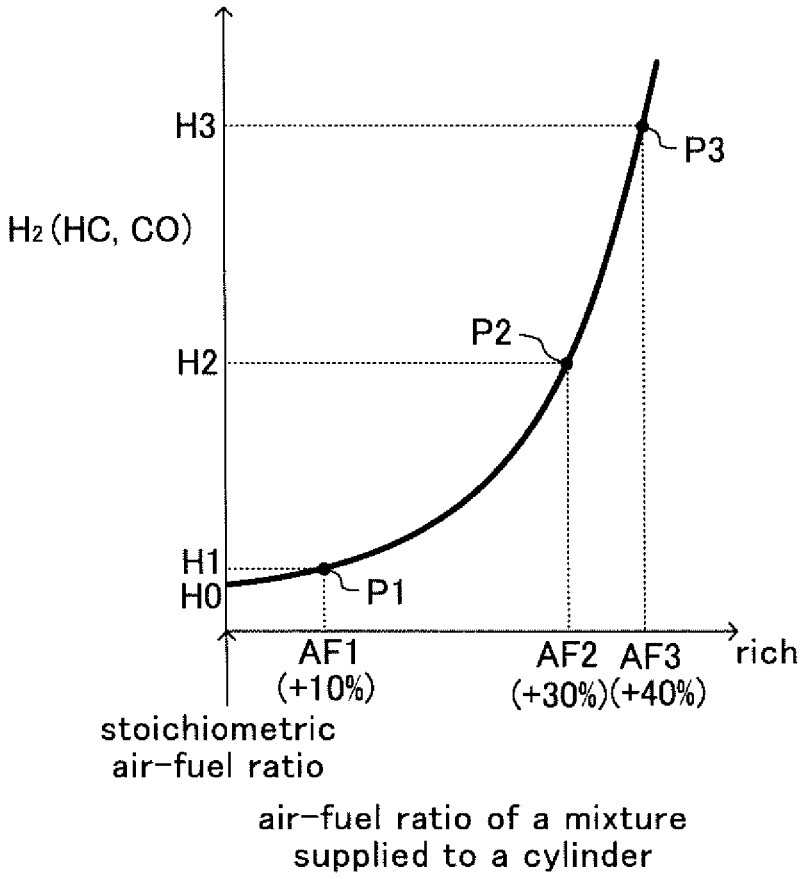
FIG. 2 is a graph showing a relationship between an air-fuel ratio of a mixture supplied to a cylinder and an amount of unburnt substances discharged from that cylinder.

However, in actuality, a "total amount S1 of hydrogen $H_2$ included in the exhaust gas" in this case is equal to S1 =H4+H1 +H1 +H1 =H4+3·H1 (refer to FIG. 2). H4 is an amount of hydrogen generated when the air-fuel ratio is equal to A0/(0.7·F0), and is roughly equal to H0 (which is an amount of hydrogen generated when the air-fuel ratio is equal to the stoichiometric air-fuel ratio).

In contrast, when the inter-cylinder air-fuel ratio imbalance is not occurring, and therefore, the air-fuel ratio of each cylinder is equal to the stoichiometric air-fuel ratio, a "total amount S2 of hydrogen $H_2$ included in the exhaust gas" is S2 =H0 +H0 +H0 +H0=4·H0. Accordingly, the total amount S1l (=H4+3·H1)=H0+3·H1 >the total amount S2 (=4·H0) is satisfied. Accordingly, even when the average of the true air-fuel ratio of the exhaust gas is equal to the stoichiometric air-fuel ratio, the output value Vabyfs becomes an air-fuel ratio in the richer side with respect to the stoichiometric air-fuel ratio due to the preferential diffusion of hydrogen when the non-uniformity among the cylinder-by-cylinder air-fuel ratios occurs. Consequently, the erroneous lean correction occurs.

In this manner, the erroneous lean correction occurs when the air-fuel ratio of the imbalanced cylinder deviates toward the rich side or the lean side with respect to the air-fuel ratio of the un-imbalanced cylinder. In view of the above, the first control apparatus decreases the degree of the erroneous lean correction by converting the output value Vabyfs of the upstream air-fuel ratio sensor 56 into an air-fuel ratio which becomes leaner as the degree of the non-uniformity among the cylinder-by-cylinder air-fuel ratios becomes larger, when converting the output value Vabyfs into an air-fuel ratio (actual detected air-fuel ratio abyfsact) used in the main feedback control. That is, the first control apparatus sets the "air-fuel ratio obtained by converting the output value Vabyfs into the air-fuel ratio" to a value which becomes larger (air-fuel ratio which becomes leaner) as the degree of the non-uniformity among the cylinder-by-cylinder air-fuel ratios becomes larger, with respect to (as compared with) the "air-fuel ratio obtained by converting the output value Vabyfs into the air-fuel ratio" when the non-uniformity among the cylinder-by-cylinder air-fuel ratios is not present.

More specifically, the first control apparatus has/makes the converted air-fuel ratio (actual detected air-fuel ratio abyfsact) coincide with the true air-fuel ratio of the exhaust gas by converting the output value Vabyfs into the air-fuel ratio in consideration of the air-fuel ratio imbalance indicating value RIMB. That is, as described above, the first control apparatus selects a "single (one) air-fuel ratio conversion table being made a connection with (linking to) the air-fuel ratio imbalance indicating value RIMB which is the closest to the actually obtained air-fuel ratio imbalance indicating value RIMB", among (out of) the air-fuel ratio conversion table Map1(Vabyfs) to the air-fuel ratio conversion table Map4(Vabyfs), and obtains the actual detected air-fuel ratio abyfsact by applying the actual output value Vabyfs to the selected air-fuel ratio conversion table.

It should be noted that the air-fuel ratio conversion table MapP(Vabyfs) (P is an integer from 1 to 4) may be replaced with a function which defines the "relationship between the output value Vabyfs and the actual detected air-fuel ratio abyfsact which is obtained by the conversion using the air-fuel ratio conversion table MapP(Vabyfs)." Furthermore, the number of "the air-fuel ratio conversion table MapP (Vabyfs) or the function" may be any number (i.e., is not limited to four kinds).

As described above, the first control apparatus obtains the actual detected air-fuel ratio abyfsact which represents (is indicative of) the true air-fuel ratio of the exhaust gas. Thereafter, the first control apparatus performs the main feedback control to have the actual detected air-fuel ratio abyfsact become equal to the target air-fuel ratio abyfr. Consequently, the air-fuel ratio obtained by the main feedback control comes closer to the target air-fuel ratio abyfr.

(an Outline of Obtaining the Air-Fuel Ratio Imbalance Indicating Value, and an Outline of Determining the Inter-Cylinder Air-Fuel Ratio Imbalance)

Next, methods for obtaining the air-fuel ratio imbalance indicating value and for determining the inter-cylinder air-fuel ratio imbalance, that the first control apparatus adopts, will be described. The air-fuel ratio imbalance indicating value is a parameter indicating/representing the "degree of the non-uniformity among the cylinder-by-cylinder air-fuel ratios (degree of air-fuel ratio non-uniformity among the cylinders)" caused by a change in the characteristic of the fuel injection valve 33, or the like.

The determination of the inter-cylinder air-fuel ratio imbalance is to determine whether or not the degree of the non-uniformity among the cylinder-by-cylinder air-fuel ratios becomes equal to or greater than a degree that requires a warning (degree which is not permissible in view of emissions). The first control apparatus determines whether or not the air-fuel ratio imbalance indicating value becomes equal to or larger than an imbalance determination threshold, and determines that the inter-cylinder air-fuel ratio imbalance has occurred when the air-fuel ratio imbalance indicating value becomes equal to or larger than the imbalance determination threshold.

The first control apparatus obtains the imbalance indicating value as follows.

(1) The first control apparatus obtains an "amount of change per unit time (predetermined constant sampling interval ts)" of the "air-fuel ratio (detected air-fuel ratio abyfs) obtained by applying the output value Vabyfs of the air-fuel ratio sensor 56 to the air-fuel ratio conversion table Map1(Vabyfs)", when a predetermined parameter obtaining condition (air-fuel ratio imbalance indicating value obtaining condition) is satisfied. It should be noted that the thus obtained detected air-fuel ratio abyfs is a value obtained by converting the output value Vabyfs into the air-fuel ratio using the air-fuel ratio conversion table Map1(Vabyfs) regardless of the air-fuel ratio imbalance indicating value RIMB, and is also referred to as a virtual detected air-fuel ratio abyfsvir, for convenience.

If the unit time ts is very short, e.g., about 4 ms, the "amount of change per unit time of the detected air-fuel ratio abyfs" can also be said as a differential value of the detected air-fuel ratio abyfs with respect to time (i.e., temporal differential value d(abyfs)/dt, first-order differential value d(abyfs)/dt). Accordingly, the "amount of change per unit time of the detected air-fuel ratio abyfs" is also referred to as a "detected air-fuel ratio changing rate ΔAF." Further, the detected air-fuel ratio changing rate ΔAF is also referred to as a "base indicating amount."

(2) The first control apparatus obtains an average (average value) AveΔAF of an absolute values |ΔAF| of a plurality of the detected air-fuel ratio changing rates ΔAF that are obtained in one unit combustion cycle period. The unit combustion cycle period is a period corresponding to an elapse of a crank angle required for all of the cylinders, each of which discharges the exhaust gas reaching the single air-fuel ratio sensor 56, to complete their single-time combustion strokes. The engine 10 of the present example is the straight 4-cylinder four-cycle engine, and the exhaust gases from the first to fourth cylinder reach the single air-fuel ratio sensor 56. Accordingly, the unit combustion cycle period is a period corresponding to an elapse of a 720 degree crank angle.

(3) The first control apparatus obtains an average value of the average values AveΔAF, each of which is obtained for each of a plurality of the unit combustion cycle periods, and adopts the obtained average value as the air-fuel ratio imbalance indicating value RIMB (imbalance determination parameter). The air-fuel ratio imbalance indicating value RIMB may also be referred to as an inter-cylinder air-fuel ratio imbalance ratio indicating value, or an imbalance ratio indicating value. It should be noted that the air-fuel ratio imbalance indicating value RIMB is not limited to the value obtained as described above, and may be obtained according to various manners described later.

The air-fuel ratio imbalance indicating value RIMB (value correlated to the detected air-fuel ratio changing rate ΔAF) obtained as described above is a value which becomes larger as the "degree of the non-uniformity among the cylinder-by-cylinder air-fuel ratios" becomes larger. The reason for this will next be described.

The exhaust gases from the cylinders successively reach the air-fuel ratio sensor 56 in the order of ignition (accordingly, in the order of exhaust). In a case where the non-uniformity among the cylinder-by-cylinder air-fuel ratios is not present (there is no difference among the cylinder-by-cylinder air-fuel ratios), the air-fuel ratios of the exhaust gases, which are discharged from the cylinders and reach the air-fuel ratio sensor 56, are approximately equal to one another. Accordingly, the detected air-fuel ratio abyfs when there is no difference among the cylinder-by-cylinder air-fuel ratios varies as indicated by a broken line C1 shown in (B) of FIG. 7, for example. That is, in the case where there is no air-fuel ratio non-uniformity among the cylinders, a waveform of the output value Vabyfs of the air-fuel ratio sensor 56 is generally flat. Consequently, as shown by a broken line C3 in (C) of FIG. 7, an absolute value of the detected air-fuel ratio changing rate ΔAF is small, when there is no difference among the cylinder-by-cylinder air-fuel ratios.

In contrast, when a characteristic of the "fuel injection valve 33 for injecting the fuel to a specific cylinder (e.g., the first cylinder)" becomes a characteristic that the "injection valve injects a greater amount of the fuel compared to the instructed fuel injection amount", the difference among the cylinder-by-cylinder air-fuel ratios becomes large. That is, a great difference is produced between the air-fuel ratio of the specific cylinder (the air-fuel ratio of the imbalanced cylinder) and the air-fuel ratios of the remaining cylinders (the air-fuel ratios of the un-imbalanced (balanced) cylinders).

Figure 7:
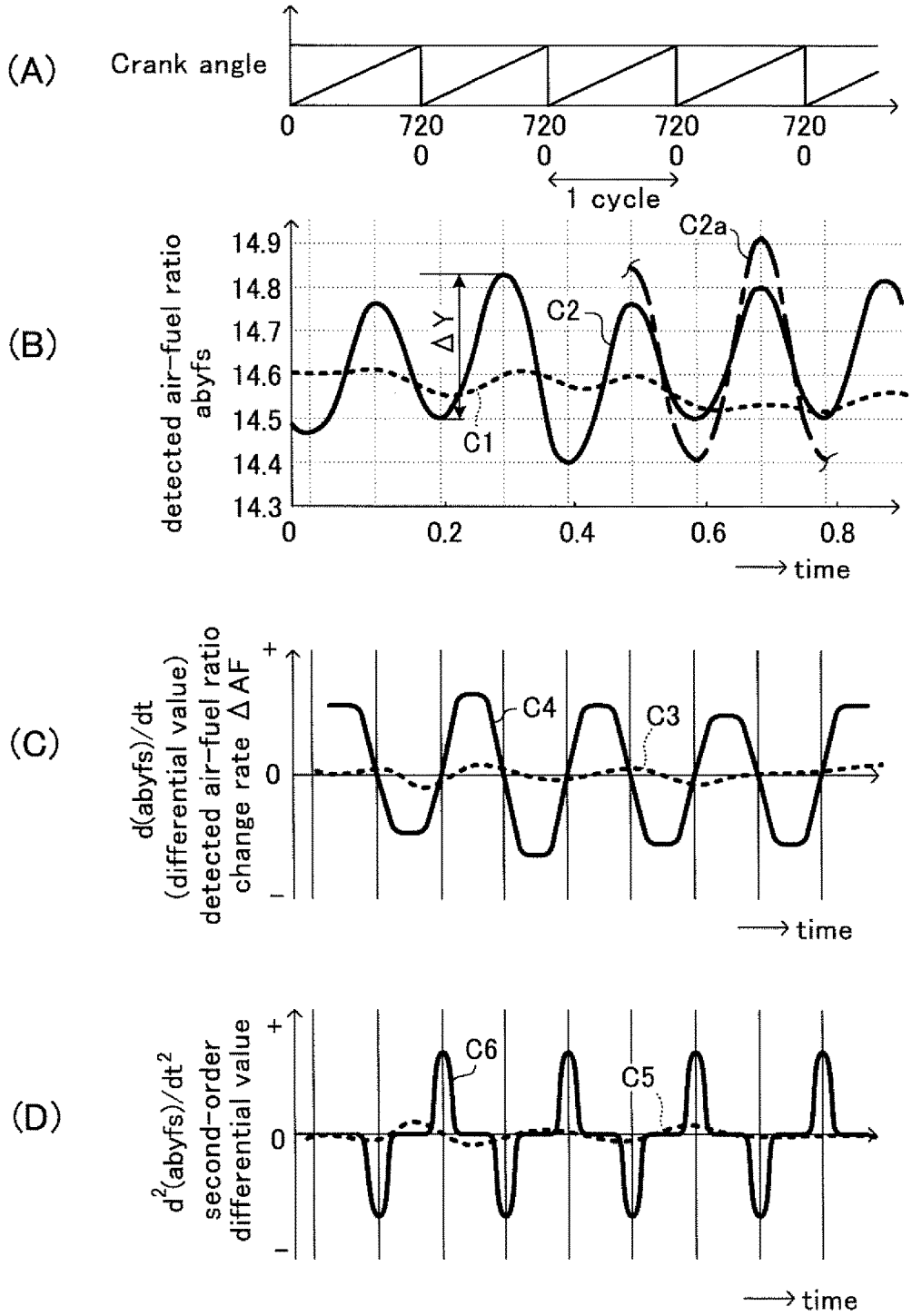
FIG. 7 is a timeline chart showing behaviors of various values correlated to an air-fuel ratio imbalance indicating value, when an inter-cylinder air-fuel ratio imbalance state is occurring (degree of the non-uniformity among the cylinder-by-cylinder air-fuel ratios is large), and when the inter-cylinder air-fuel ratio imbalance state is not occurring (degree of the non-uniformity among the cylinder-by-cylinder air-fuel ratios is small).

Accordingly, for example, as shown by the solid line C2 in (B) of FIG. 7, the detected air-fuel ratio abyfs when the inter-cylinder air-fuel ratio imbalance state has been occurring varies/fluctuates greatly, every unit combustion cycle period. Therefore, the absolute value of the detected air-fuel ratio changing rate ΔAF is large when the inter-cylinder air-fuel ratio imbalance state is occurring, as shown by the solid line C4 in (C) of FIG. 7.

Further, the absolute value |ΔAF| of the detected air-fuel ratio changing rate ΔAF fluctuates/varies more greatly, as the air-fuel ratio of the imbalanced cylinder deviates more greatly from the air-fuel ratio of the un-imbalanced cylinder. For example, assuming that the detected air-fuel ratio abyfs varies as shown by the solid line C2 in (B) of FIG. 7 when the magnitude of the difference between the air-fuel ratio of the imbalanced cylinder and the air-fuel ratio of the un-imbalanced cylinder is a first value, the detected air-fuel ratio abyfs varies as shown by the alternate long and short dash line C2 a in (B) of FIG. 7 when the magnitude of the difference between the air-fuel ratio of the imbalanced cylinder and the air-fuel ratio of the un-imbalanced cylinder is a "second value larger than the first value."

Figure 8:
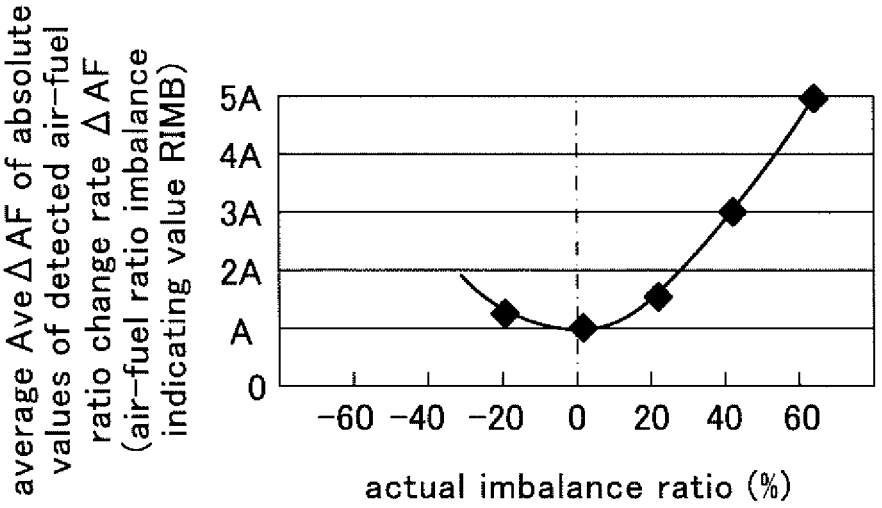
FIG. 8 is a graph showing a relationship between an actual imbalance ratio and the air-fuel ratio imbalance indicating value correlated to a detected air-fuel ratio changing rate.

Accordingly, as shown in FIG. 8, a value (air-fuel ratio imbalance indicating value RIMB) correlated to the average value AveΔAF of the absolute values |ΔAF| of the detected air-fuel ratio changing rate ΔAF during a "plurality of the unit combustion cycle periods" becomes larger as the actual imbalance ratio becomes greater (that is, as the air-fuel ratio of the imbalanced cylinder deviates more greatly from the air-fuel ratio of the un-imbalanced cylinder). That is, the air-fuel ratio imbalance indicating value RIMB becomes larger as the degree of the non-uniformity among the cylinder-by-cylinder air-fuel ratios becomes greater.

It should be noted that the abscissa axis of the graph shown in FIG. 8 is an "imbalance rate (ratio)." The imbalance ratio is a value "α" when an amount of the fuel supplied to the un-imbalanced cylinder is equal to "1" and an amount of the fuel supplied to the imbalanced cylinder is equal to "1+α." The imbalance ratio is typically expressed in the form of α·100%. As understood from FIG. 8, the air-fuel ratio imbalance indicating value RIMB is symmetric with respect to 0% of the imbalance ratio. That is, for example, the air-fuel ratio imbalance indicating value RIMB when the imbalance ratio is equal to +20% is roughly equal to the air-fuel ratio imbalance indicating value RIMB when the imbalance ratio is equal to −20%.

After the first control apparatus obtains the air-fuel ratio imbalance indicating value RIMB, it compares the air-fuel ratio imbalance indicating value RIMB with the imbalance determination threshold RIMBth. The first control apparatus determines that the inter-cylinder air-fuel ratio imbalance state has occurred when the air-fuel ratio imbalance indicating value RIMB is larger than the imbalance determination threshold RIMBth. In contrast, the first control apparatus determines that the inter-cylinder air-fuel ratio imbalance state has not occurred when the air-fuel ratio imbalance indicating value RIMB is smaller than the imbalance determination threshold RIMBth.

It should also be noted that the thus obtained air-fuel ratio imbalance indicating value RIMB becomes equal to a reference (base) value ("0" in this case) when the non-uniformity among the cylinder-by-cylinder air-fuel ratios is not present, and becomes larger (a magnitude of a difference between air-fuel ratio imbalance indicating value RIMB and the reference value becomes larger) as the degree of the non-uniformity among the cylinder-by-cylinder air-fuel ratios becomes larger.

(Actual Operation)

<Fuel injection amount control>

Figure 9:
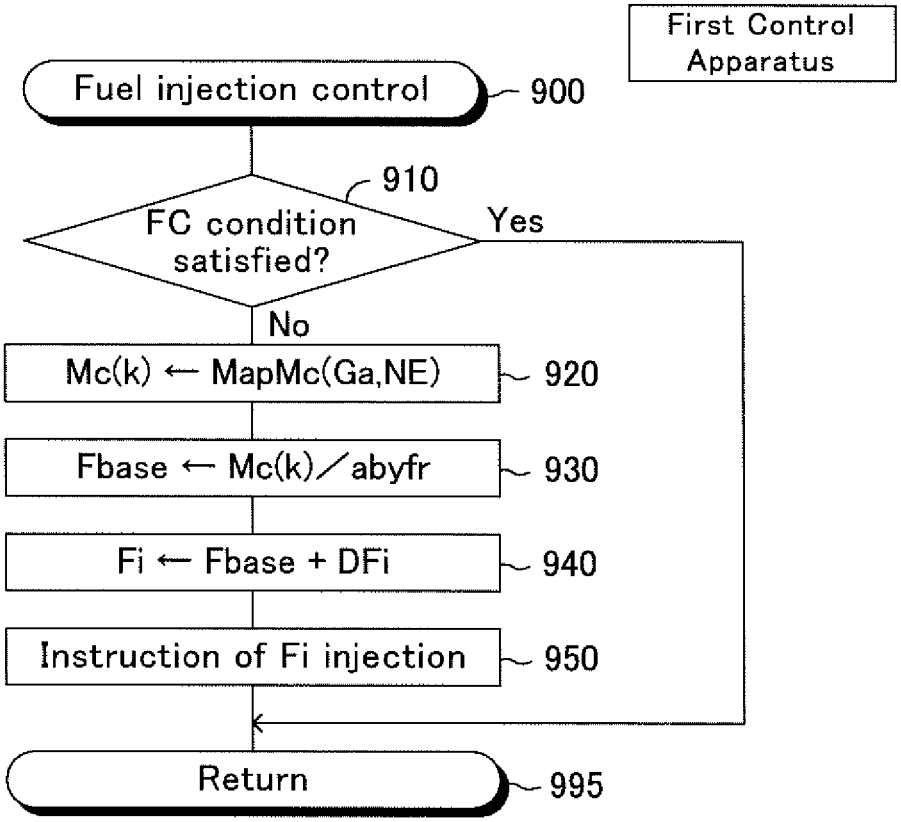
FIG. 9 is a flowchart showing a routine executed by a CPU of a fuel injection amount control apparatus (first control apparatus) according to a first embodiment of the present invention.

The CPU of the first control apparatus is designed to repeatedly execute a fuel injection control routine shown in FIG. 9 for an arbitrary cylinder, each time the crank angle of the arbitrary cylinder becomes a predetermined crank angle before the intake top dead center. The predetermined crank angle is, for example, BTDC 90° CA (90° crank angle before the intake top dead center). The cylinder whose crank angle becomes equal to the predetermined crank angle is also referred to as a "fuel injection cylinder." The CPU calculates the instructed fuel injection amount Fi, and instructs the fuel injection, by the fuel injection control routine.

When the crank angle of the arbitrary cylinder becomes equal to the predetermined crank angle, the CPU starts processing from step 900 to proceed to step 910, at which it determines whether or not a fuel cut condition (hereinafter, expressed as a "FC condition") is satisfied.

It is assumed here that the FC condition is not satisfied. Under this assumption, the CPU sequentially executes processes of step 920 to step 950 one after another, and proceeds to step 995 to end the present routine tentatively.

Step 920: The CPU obtains an "in-cylinder intake air amount Mc(k)" which is an "amount of an air introduced into the fuel injection cylinder in one intake stroke of the fuel injection cylinder", on the basis of the "intake air flow rate Ga measured by the air-flow meter 51, the engine rotational speed NE obtained based on the signal from the crank position sensor 54, and a look-up table MapMc." The in-cylinder intake air amount Mc(k) is stored in the RAM, while being related to the intake stroke of each cylinder. The in-cylinder intake air amount Mc(k) may be calculated based on a well-known air model (model constructed according to laws of physics describing and simulating a behavior of an air in the intake passage).

Step 930: The CPU obtains a base fuel injection amount Fbase by dividing the in-cylinder intake air amount Mc(k) by the target air-fuel ratio abyfr. The target air-fuel ratio abyfr has been set at a predetermined base air-fuel ratio which is within the window of the catalyst 43. The base air-fuel ratio may be changed to a value in the vicinity of the stoichiometric air-fuel ratio, based on the intake air amount Ga, the degree of the deterioration of the catalyst 43, and so on. In the present example, the target air-fuel ratio abyfr is set at the stoichiometric air-fuel ratio stoich. Accordingly, the base fuel injection amount Fbase is a feedforward amount of the fuel injection amount nominally required to realize/attain the stoichiometric air-fuel ratio stoich. This step 930 constitutes a feedforward control section (base fuel injection amount calculation section) to have the air-fuel ratio of the mixture supplied to the engine coincide with the target air-fuel ratio abyfr.

Step 940: The CPU corrects the base fuel injection amount Fbase with a main feedback amount DFi. More specifically, the CPU calculates the instructed fuel injection amount (final fuel injection amount) Fi by adding the main feedback amount DFi to the base fuel injection amount Fbase. The main feedback amount DFi is an air-fuel ratio feedback amount to have the air-fuel ratio of the engine coincide with the target air-fuel ratio abyfr, and is obtained based on an actual detected air-fuel ratio abyfsact into which the output value Vabyfs of the upstream air-fuel ratio sensor 56 is converted. The way to calculate the main feedback amount DFi will be described later.

Step 950: The CPU sends the injection instruction signal to the "fuel injection valve 33 corresponding to the fuel injection cylinder" so as to have the fuel injection valve 33 inject a "fuel of the instructed fuel injection amount Fi."

Consequently, the fuel is injected from the fuel injection valve 33, the amount of the injected fuel being an amount required based on the calculation (or estimated to be required) to have the air-fuel ratio of the engine become equal to the target air-fuel ratio abyfr. That is, the steps from step 920 to step 950 constitutes an instructed fuel injection amount control section to control the instructed fuel injection amount Fi in such a manner that the "air-fuel ratio of the mixture supplied to the combustion chambers 21 of a plurality of the cylinders (two or more of the cylinders, all of the cylinders in the present example) which discharge gases reaching the air-fuel ratio sensor 56" becomes equal to the target air-fuel ratio abyfr.

On the other hand, if the FC condition is satisfied when the CPU executes the process of step 910, the CPU makes a "Yes" determination at step 910 to directly proceed to step 995, at which the CPU ends the present routine tentatively. In this case, since the fuel injection process of step 950 is not executed, the fuel cut control (fuel supply stop control) is carried out.

<Calculation of the main feedback amount>

Figure 10:
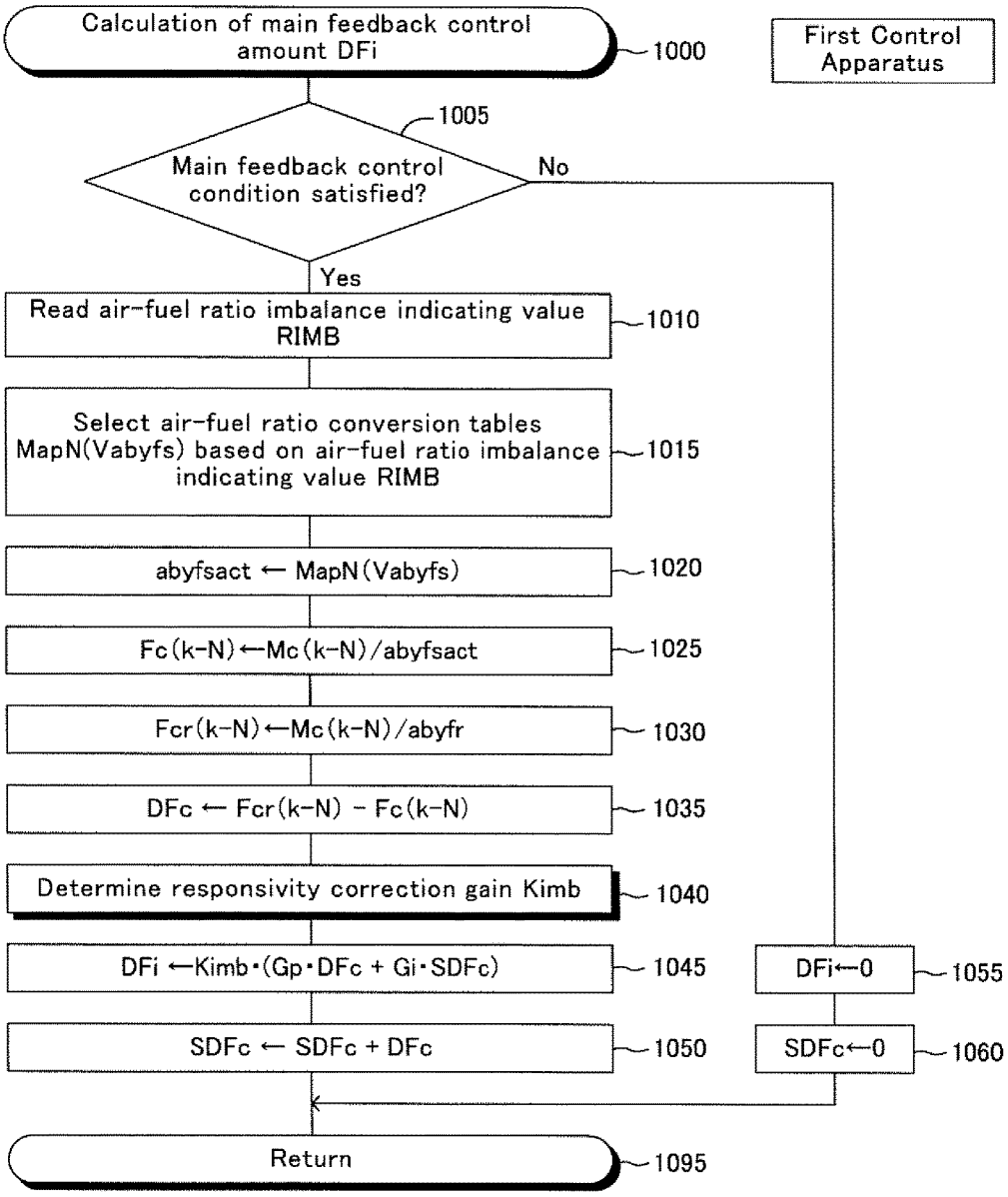
FIG. 10 is a flowchart showing a routine executed by the CPU of the first control apparatus.

The CPU repeatedly executes a "routine for the calculation of the main feedback amount" shown by a flowchart in FIG. 10, every time a predetermined time period elapses. Accordingly, at an appropriate timing, the CPU starts the process from step 1000 to proceed to step 1005, at which the CPU determines whether or not a "main feedback control condition (upstream air-fuel ratio feedback control condition)" is satisfied.

The main feedback control condition is satisfied when all of the following conditions are satisfied.

(A1) The upstream air-fuel ratio sensor 56 has been activated.

(A2) The load KL of the engine is smaller than or equal to a threshold value KLth.

(A3) The fuel cut control is not being performed.

It should be noted that the load KL is a load rate obtained based on the following formula (1). The accelerator pedal operation amount Accp can be used in place of the load rate KL. In the formula (1), Mc is the in-cylinder intake air amount, ρ is an air density (unit is (g/l), L is a displacement of the engine 10 (unit is (l)), and "4" is the number of cylinders of the engine 10.

$$KL=(Mc/(\rho\cdot L/4))\cdot 100\% \quad (1)$$

The description continues assuming that the main feedback control condition is satisfied. In this case, the CPU makes a "Yes" determination at step 1005 to sequentially execute processes from step 1010 to step 1050 described below one after another, and then proceeds to step 1095 to end the present routine tentatively.

Step 1010: The CPU reads out the air-fuel imbalance indicating value RIMB which is separately calculated in an "air-fuel imbalance indicating value calculation routine" described later. As described above, the air-fuel imbalance indicating value RIMB is a value which becomes larger as the degree of the non-uniformity among the cylinder-by-cylinder air-fuel ratios becomes larger.

Step 1015: The CPU selects, among a plurality of the "air-fuel ratio conversion tables "Map1(Vabyfs)-Map4(Vabyfs)", one air-fuel ratio conversion table MapN(Vabyfs) which is related to (associated with) an air-fuel ratio imbalance indicating value which is closest to the air-fuel ratio imbalance indicating value RIMB read out at step 1010.

Step 1020: The CPU obtains the actual detected air-fuel ratio abyfsact by applying the present output value Vabyfs of the upstream air-fuel ratio sensor 56 to the "selected air-fuel ratio conversion table MpaN(Vabyfs)." This step enables to calculate the actual detected air-fuel ratio abyfsact in such a manner that the actual detected air-fuel ratio abyfsact coincides with the true air-fuel ratio, regardless of what the degree of the non-uniformity of the cylinder-by-cylinder air-fuel ratios.

Step 1025: According to a formula (2) described below, the CPU obtains an "in-cylinder fuel supply amount Fc(k−N)" which is an "amount of the fuel actually supplied to the combustion chamber 21 for a cycle at a timing N cycles before the present time." That is, the CPU obtains the in-cylinder fuel supply amount Fc(k−N) through dividing the "in-cylinder intake air amount Mc(k−N) which is the in-cylinder intake air amount for the cycle the N cycles (i.e., N·720° crank angle) before the present time" by the "actual detected air-fuel ratio abyfsact."

$$Fc(k-N)=Mc(k-N)/abyfsact \quad (2)$$

The reason why the cylinder intake air amount Mc(k−N) for the cycle N cycles before the present time is divided by the actual detected air-fuel ratio abyfsact in order to obtain the in-cylinder fuel supply amount Fc(k−N) is because the "exhaust gas generated by the combustion of the mixture in the combustion chamber 21" requires time "corresponding to the N cycles" to reach the air-fuel ratio sensor 56.

Step 1030: The CPU obtains a "target in-cylinder fuel supply amount Fcr(k−N)" which is a "fuel amount supposed to be supplied to the combustion chamber 21 for the cycle the N cycles before the present time," according to a formula (3) described below. That is, the CPU obtains the target in-cylinder fuel supply amount Fcr(k−N) by dividing the in-cylinder intake air amount Mc(k−N) for the cycle the N cycles before the present time by the target air-fuel ratio abyfr.

$$Fcr(k-N)=Mc(k-N)/abyfr \quad (3)$$

Step 1035: The CPU obtains an "error DFc of the in-cylinder fuel supply amount", according to a formula (4) described below. That is, the CPU obtains the error DFc of the in-cylinder fuel supply amount by subtracting the in-cylinder fuel supply amount Fc(k−N) from the target cylinder fuel supply amount Fcr(k−N). The error DFc of the in-cylinder fuel supply amount represents excess and deficiency of the fuel supplied to the cylinder for the cycle the N cycles before the present time. The error DFc of the in-cylinder fuel supply amount is one of values which corresponds to (is correlated to) a difference between the actual detected air-fuel ratio abyfsact and the target air-fuel ratio abyfr.

$$DFc=Fcr(k-N)-Fc(k-N) \quad (4)$$

Step 1040: The CPU determines a responsivity correction gain Kimb by executing a routine shown in FIG. 11. The routine shown in FIG. 11 will be described later. The responsivity correction gain Kimb is calculated so as to increase within a range larger than "1" as the air-fuel ratio imbalance indicating value RIMB becomes larger, in a predetermined period from a point in time at which the actual detected air-fuel ratio abyfsact changed to an "air-fuel ratio leaner than the stoichiometric air-fuel ratio stoich" from an "air-fuel ratio richer than the stoichiometric air-fuel ratio stoich" and when the actual detected air-fuel ratio abyfsact is still the "air-fuel ratio leaner than the stoichiometric air-fuel ratio stoich." The responsivity correction gain Kimb is set to "1", in a period which is not the predetermined period from the point in time at which the actual detected air-fuel ratio abyfsact changed to the "air-fuel ratio leaner than the stoichiometric air-fuel ratio stoich" from the "air-fuel ratio richer than the stoichiometric air-fuel ratio stoich", or when the actual detected air-fuel ratio abyfsact is the "air-fuel ratio richer than the stoichiometric air-fuel ratio stoich." The responsivity correction gain Kimb is a gain to compensate for the asymmetric responsivity of the output value Vabyfs.

The actual detected air-fuel ratio abyfsact is calculated so as to coincide with the true air-fuel ratio at steps from step 1010 to step 1020. However, in a case in which the non-uniformity among the cylinder-by-cylinder air-fuel ratios is occurring, a change rate of the output value Vabyfs (rich-lean inversion responsivity) when the true air-fuel ratio of the exhaust gas has changed to the "air-fuel ratio leaner than the stoichiometric air-fuel ratio stoich" from the "air-fuel ratio richer than the stoichiometric air-fuel ratio stoich" (i.e., rich-lean inversion time point) is smaller than a change rate of the output value Vabyfs (lean-rich inversion responsivity) when the true air-fuel ratio of the exhaust gas has changed to the "air-fuel ratio richer than the stoichiometric air-fuel ratio stoich" from the "air-fuel ratio leaner than the stoichiometric air-fuel ratio stoich" (i.e., lean-rich inversion time point). This is because, the output value Vabyfs is affected by hydrogen which is produced in a great amount due to the occurrence of the non-uniformity among cylinder-by-cylinder air-fuel ratios.

In other words, even in a case in which the true air-fuel ratio of the exhaust gas is in the vicinity of the stoichiometric air-fuel ratio, since a "larger amount of hydrogen" is present in the vicinity of the upstream air-fuel ratio sensor 56 as the degree of the non-uniformity among the cylinder-by-cylinder air-fuel ratios becomes larger, the output value Vabyfs rapidly decreases due to the presence of the great amount of hydrogen upon the lean-rich inversion time point, and the output value Vabyfs gradually increases due to the presence of the great amount of hydrogen upon the rich-lean inversion time point.

Step 1045: The CPU obtains the main feedback amount DFi, according to a formula (5) described below. In the formula (5) below, Gp is a predetermined proportion gain, and Gi is a predetermined integration gain. Further, the "value SDFc" in the formula (5) is an "integrated value of the error DFc of the in-cylinder fuel supply amount." The value SDFc is one of the values, each being correlated to the difference between the actual detected air-fuel ratio abyfsact and the target air-fuel ratio abyfr. Therefore, the value (Gp·DFc+Gi·SDFc) is one of the values, each being correlated to the difference between the actual detected air-fuel ratio abyfsact and the target air-fuel ratio abyfr. In this manner, the CPU calculates the "main feedback amount DFi" based on a proportional-integral control to have the actual detected air-fuel ratio abyfsact coincide with the target air-fuel ratio abyfr.

$$DFi=Kimb\cdot(Gp\cdot DFc+Gi\cdot SDFc) \quad (5)$$

Step 1050: The CPU obtains a new integrated value SDFc of the error of the in-cylinder fuel supply amount by adding the error DFc of the in-cylinder fuel supply amount obtained at step 1035 described above to the current/present integrated value SDFc of the error of the in-cylinder fuel supply amount.

As described above, the main feedback amount DFi is obtained based on the proportional-integral control. The main feedback amount DFi is reflected in (onto) the instructed fuel injection amount Fi by the process of step 940 shown in FIG. 9.

To the contrary, if the main feedback control condition is not satisfied at the time of determination at the step 1005 shown in FIG. 10, the CPU makes a "No" determination at step 1005 so as to proceed to step 1055 to set the value of the main feedback amount DFi to (at) "0." Subsequently, the CPU stores "0" into the integrated value SDFc of the error of the in-cylinder fuel supply amount at step 1060. Thereafter, the CPU proceeds to step 1095 to end the present routine tentatively. As described above, when the main feedback control condition is not satisfied, the main feedback amount DFi is set to (at) "0." Accordingly, the correction on the base fuel injection amount Fbase with the main feedback amount DFi is not performed.

<Calculation of the responsivity correction gain Kimb>

Figure 11:
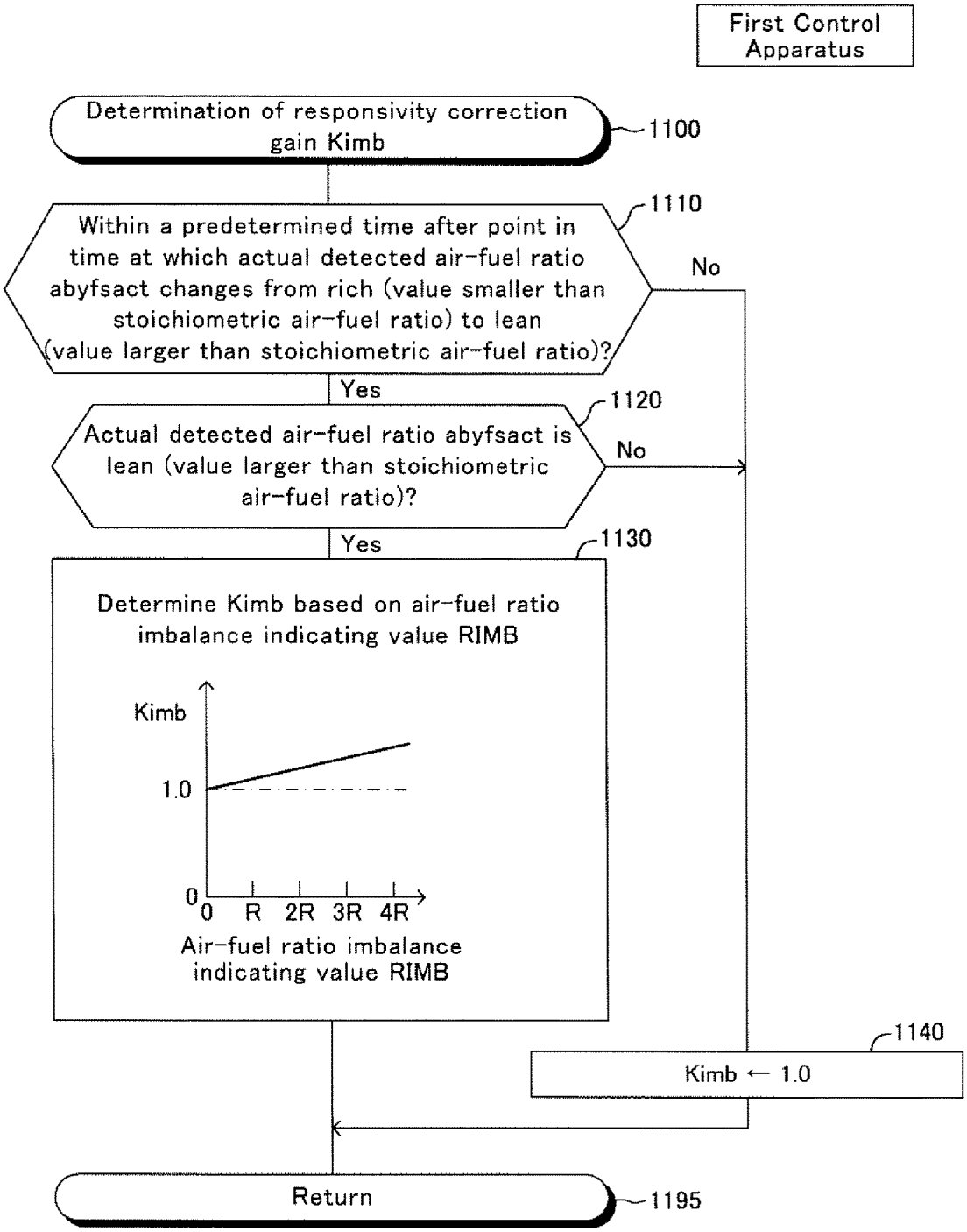
FIG. 11 is a flowchart showing a routine executed by the CPU of the first control apparatus.

As described above, when the CPU proceeds to step 1040 shown in FIG. 10, the CPU executes the processes of the responsivity correction gain Kimb calculation routine shown in FIG. 11. That is, when the CPU proceeds to step 1040 shown in FIG. 10, the CPU proceeds to step 1100 shown in FIG. 11. At next step 1110, the CPU determines whether the present point in time is within the predetermined time from the time point (rich-lean inversion time point) at which the actual detected air-fuel ratio abyfsact has changed to the air-fuel ratio leaner than the stoichiometric air-fuel ratio stoich from the air-fuel ratio richer than the stoichiometric air-fuel ratio stoich.

When the present point in time is within the predetermined time from the rich-lean inversion time point, the CPU makes a "Yes" determination at step 1110 to proceed to step 1120, at which the CPU determines whether or not the actual detected air-fuel ratio abyfsact is leaner than the stoichiometric air-fuel ratio stoich.

When the actual detected air-fuel ratio abyfsact is still leaner than the stoichiometric air-fuel ratio stoich, the CPU makes a "Yes" determination at step 1120 to proceed to step 1130 to determine the responsivity correction gain Kimb in such a manner that the responsivity correction gain Kimb becomes larger in a range larger than "1" as the air-fuel ratio imbalance indicating value RIMB read out at step 1010 shown in FIG. 10 becomes larger. Thereafter, the CPU proceeds to step 1045 shown in FIG. 10 via step 1195.

In contrast, when the present point in time is not within the predetermined time from the rich-lean inversion time point, the CPU makes a "No" determination at step 1110 to proceed to step 1140, at which the CPU sets the value of the responsivity correction gain Kimb to "1." Thereafter, the CPU proceeds to step 1045 shown in FIG. 10 via step 1195.

Further, if the actual detected air-fuel ratio abyfsact has already changed to an air-fuel ratio richer than the stoichiometric air-fuel ratio stoich even when the present point in time is within the predetermined time from the rich-lean inversion time point, the CPU makes a "No" determination at step 1120 to proceed to step 1140, at which the CPU sets the value of the responsivity correction gain Kimb to "1." Thereafter, the CPU proceeds to step 1045 shown in FIG. 10 via step 1195.

<Obtaining the air-fuel ratio imbalance indicating value, and determining the inter-cylinder air-fuel ratio imbalance>

Next will be described processes for performing the "air-fuel ratio imbalance indicating value obtainment and inter-cylinder air-fuel ratio imbalance determination." The CPU is configured so as to execute a routine shown by a flowchart in FIG. 12 every elapse of 4 ms (a predetermined constant sampling time ts).

Accordingly, at an appropriate timing, the CPU starts process from step 1200 to proceed to step 1205, at which the CPU determines whether or not a value of a parameter obtaining permission flag Xkyoka is "1."

The value of the parameter obtaining permission flag Xkyoka is set to (at) "1," if a parameter obtaining condition described later is satisfied when the absolute crank angle CA coincides with 0° crank angle, and is set to (at) "0" immediately after the parameter obtaining condition becomes unsatisfied.

The parameter obtaining condition is satisfied when all of conditions (conditions C1 to C5) described below are satisfied. In other words, the parameter obtaining condition is not satisfied when at least any one of the following conditions (conditions C1 to C5) is unsatisfied. It should be noted that conditions for the parameter obtaining condition are not limited to the following conditions C1 to C5.

(Condition C1)

The intake air flow rate Ga obtained from the air-flow meter 51 is within a predetermined range. That is, the intake air flow rate Ga is larger than or equal to a low side intake air flow rate threshold GaLoth, and is smaller than or equal to a high side intake air flow rate threshold GaHith. Owing to this condition C1, a "degradation of an accuracy of the air-fuel ratio imbalance indicating value RIMB" due to a change in the responsivity of the output value Vabyfs caused by the intake air flow rate Ga can be avoided.

(Condition C2)

The engine rotational speed NE is within a predetermined range. That is, the engine rotational speed NE is larger than or equal to a low side engine rotational speed threshold NELoth, and is smaller than or equal to a high side engine rotational speed NE threshold NEHith.

(Condition C3)

The cooling water temperature THW is higher than or equal to a cooling water temperature threshold THWth.

(Condition C4)

The main feedback control condition is satisfied.

(Condition C5)

The fuel cut control is not being performed.

Here, it is assumed that the value of the parameter obtaining permission flag Xkyoka is "1." In this case, the CPU makes a "Yes" determination at step 1205 to proceed to step 1210, at which the CPU reads the output value Vabyfs of the upstream air-fuel ratio sensor 56.

Subsequently, the CPU proceeds to step 1215 to obtain the virtual detected air-fuel ratio abyfsvir by applying the output value Vabyfs read at step 1210 to the air-fuel ratio conversion table Map1(Vabyfs) shown in FIG. 5. That is, the CPU converts the output value Vabyfs into the air-fuel ratio (virtual detected air-fuel ratio abyfsvir) under the presumption that the non-uniformity among the cylinder-by-cylinder air-fuel ratios is not occurring, regardless of the degree of the non-uniformity among the cylinder-by-cylinder air-fuel ratios (i.e., regardless of the air-fuel ratio imbalance indicating value RIMB).

It should be noted that the CPU stores the virtual detected air-fuel ratio abyfsvir which was obtained in the previous execution of the present routine as a previous virtual detected air-fuel ratio abyfsvirold, before executing the process of the step 1215. That is, the previous virtual detected air-fuel ratio abyfsvirold is the virtual detected air-fuel ratio abyfsvir 4 ms (the sampling time ts) before the present time. An initial value of the previous virtual detected air-fuel ratio abyfsvirold is set at a value corresponding to the stoichiometric air-fuel ratio in the initial routine described above.

Subsequently, the CPU proceeds to step 1220, at which the CPU, (A) obtains the detected air-fuel ratio changing rate ΔAF, (B) renews a cumulated value SAFD of an absolute value |ΔAF| of the detected air-fuel ratio changing rate ΔAF, and (C) renews a cumulated number counter Cn showing how many times the absolute value |ΔAF| of the detected air-fuel ratio changing rate ΔAF is accumulated (integrated) to the cumulated value SAFD.

The ways in which these values are renewed will next be described more specifically.

(A) Obtainment of the Detected Air-Fuel Ratio Changing Rate ΔAF:

The detected air-fuel ratio changing rate ΔAF (differential value d(abyfsvir)/dt) is a base data (base indicating amount) for the air-fuel ratio imbalance indicating value RIMB. The CPU obtains the detected air-fuel ratio changing rate ΔAF by subtracting the previous virtual detected air-fuel ratio abyfsvirold from the present virtual detected air-fuel ratio abyfsvir. That is, when the present virtual detected air-fuel ratio abyfsvir is expressed as abyfsvir(n), and the previous virtual detected air-fuel ratio abyfsvirold is expressed as abyfsvir(n−1), the CPU obtains the "present detected air-fuel ratio changing rate ΔAF(n)" at step 1220 according to a formula (6) described below.

$$\Delta AF(n)=abyfsvir(n)-abyfsvir(n-1) \tag{6}$$

(B) Renewal of the Cumulated Value SAFD of the Absolute Value |ΔAF| of the Detected Air-Fuel Ratio Changing Rate ΔAF:

The CPU obtains the present cumulated value SAFD(n) according to a formula (7) described below. That is, the CPU updates the cumulated value SAFD by adding the absolute value |ΔAF(n)| of the presently detected air-fuel ratio changing rate ΔAF(n) obtained as described above to the previous cumulated value SAFD(n−1) when the CPU proceeds to step 1220.

$$SAFD(n)=SAFD(n-1)+|\Delta AF(n)| \tag{7}$$

The reason why the "absolute value |ΔAF(n)| of the presently detected air-fuel ratio changing rate" is added to the cumulated value SAFD is that the detected air-fuel ratio changing rate ΔAF(n) can become both a positive value and a negative value, as understood from (B) and (C) in FIG. 7. It should be noted that the cumulated value SAFD is set to (at) "0" in the initial routine.

(C) Renewal of the Cumulated Number Counter Cn Showing how Many Times the Absolute Value |ΔAF| of the Detected Air-Fuel Ratio Changing Rate ΔAF is Accumulated to the Cumulated Value SAFD:

The CPU increments a value of the counter Cn by "1" according to a formula (8) described below. Cn(n) represents the counter Cn after the renewal, and Cn(n−1) represents the counter Cn before the renewal. The value of the counter Cn is set at "0" in the initial routine described above, and is also set to (at) "0" at step 1260 and step 1265, described later. The value of the counter Cn therefore represents the number of data of the absolute value |ΔAF| of the detected air-fuel ratio changing rate ΔAF which has been accumulated in the cumulated value SAFD.

$$Cn(n)=Cn(n-1)+1 \tag{8}$$

Subsequently, the CPU proceeds to step 1225 to determine whether or not the crank angle CA (absolute crank angle CA) measured with reference to the top dead center of the compression stroke of the reference cylinder (in the present example, the first cylinder) reaches 720° crank angle. When the absolute crank angle CA is less than 720° crank angle, the CPU makes a "No" determination at step 1225 to directly proceed to step 1295, at which the CPU ends the present routine tentatively.

It should be noted that step 1225 is a step to define the smallest unit period for obtaining an average of the absolute values |ΔAF| of the detected air-fuel ratio changing rate ΔAF. Here, the "720° crank angle which is the unit combustion cycle period" corresponds to the smallest unit period. The smallest unit period may obviously be shorter than the 720° crank angle, however, may preferably be a time period longer than or equal to a period having an integral multiple of the sampling time ts. Further, it is preferable that the smallest unit period be the time period having an integral (natural number) multiple of the unit combustion cycle period.

Meanwhile, if the absolute crank angle CA reaches 720° crank angle when the CPU executes the process of step 1225, the CPU makes a "Yes" determination at step 1225 to proceed to step 1230.

The CPU, at step 1230:

(D) calculates an average value AveΔAF of the absolute values |ΔAF| of the detected air-fuel ratio changing rates ΔAF, (E) renews a cumulated value Save of the average value AveΔAF, and (F) renews a cumulated number counter Cs.

The ways in which these values are renewed will next be described more specifically.

(D) Calculation of the Average Value AveΔAF of the Absolute Values |ΔAF| of the Detected Air-Fuel Ratio Changing Rates ΔAF:

The CPU calculates the average value AveΔAF of the absolute values |ΔAF| of the detected air-fuel ratio changing rates ΔAF through dividing the cumulated value SAFD by a value of the counter Cn, according to a formula (9) described below. Thereafter, the CPU sets both the cumulated value SAFD and the value of the counter Cn to (at) "0."

$$\text{AveΔAF}=SAFD/Cn \tag{9}$$

(E) Renewal of the Cumulated Value Save of the Average Value AveΔAF:

The CPU obtains the present cumulated value Save(n) according to a formula (10) described below. That is, the CPU renews the cumulated value Save by adding the present average value AveΔAF obtained as described above to the previous cumulated value Save(n−1) when the CPU proceeds to step 1230. The value of the cumulated value Save(n) is set to (at) "0" in the initial routine described above as well as at step 1260 described later.

$$\text{Save}(n)=\text{Save}(n-1)+\text{AveΔAF} \tag{10}$$

(F) Renewal of the Cumulated Number Counter Cs:

The CPU increments a value of the counter Cs by "1" according to a formula (11) described below. Cs(n) represents the counter Cs after the renewal, and Cs(n−1) represents the counter Cs before the renewal. The value of the counter Cs is set to (at) "0" in the initial routine described above as well as at step 1260 described later. The value of the counter Cs therefore represents the number of data of the average value AveΔAF which has been accumulated in the cumulated value Save.

$$Cs(n)=Cs(n-1)+1 \tag{11}$$

Subsequently, the CPU proceeds to step 1235 to determine whether or not the value of the counter Cs is larger than or equal to a threshold value Csth. When the value of the counter Cs is less than the threshold value Csth, the CPU makes a "No" determination at step 1235 to directly proceed to step 1295, at which the CPU ends the present routine tentatively. It should be noted that the threshold value Csth is a natural number, and is preferably larger than or equal to 2.

Meanwhile, if the value of the counter Cs is larger than or equal to the threshold value Csth when the CPU executes the process of step 1235, the CPU makes a "Yes" determination at step 1235 to proceed to step 1240. At step 1240, the CPU obtains the air-fuel ratio imbalance indicating value RIMB (=air-fuel ratio fluctuation indicating amount AFD) through dividing the cumulated value Save by the value of the counter Cs (=Csth), according to a formula (12) described below. The air-fuel ratio imbalance indicating value RIMB is a value obtained by averaging the average values AveΔAF, each of which is the average of the absolute values |ΔAF| of the detected air-fuel ratio changing rates ΔAF for each combustion cycle period, over a plurality (Csth) of the unit combustion cycle periods. The air-fuel ratio imbalance indicating value RIMB is stored in the back up RAM as a learning value.

$$RIMB=AFD=\text{Save}/Csth \tag{12}$$

It should be noted that the CPU may obtain a weighted average by applying the learning value RIMBgaku (=RIMBgaku(n−1)) which has been stored in the backup RAM and the presently obtained air-fuel ratio imbalance indicating value RIMB to a formula (13) described below, and store the weighted average RIMBgaku(n) in the backup RAM as a new learning value RIMBgaku. In the formula (13), β is a predetermined value which is larger than 0 and smaller than 1.

$$RIMBgaku(n)=\beta\cdot RIMBgaku(n-1)+(1-\beta)\cdot RIMB \tag{13}$$

Subsequently, the CPU proceeds to step 1245 to determine whether or not the air-fuel ratio imbalance indicating value RIMB is larger than the imbalance determination threshold RIMBth. That is, the CPU determines whether or not the inter-cylinder air-fuel ratio imbalance state has occurred at step 1245.

When the air-fuel ratio imbalance indicating value RIMB is larger than the imbalance determination threshold RIMBth, the CPU makes a "Yes" determination at step 1245 to proceed to step 1250, at which the CPU sets a value of an imbalance occurrence flag XIMB to "1." That is, the CPU determines that the inter-cylinder air-fuel-ratio imbalance state has occurred. Furthermore, the CPU may turn on a warning lamp which is not shown. It should be noted that the value of the imbalance occurrence flag XIMB is stored in the backup RAM. Subsequently, the CPU proceeds to step 1260.

In contrast, if the value of the air-fuel ratio imbalance indicating value RIMB is smaller than the imbalance determination threshold RIMBth when the CPU executes the process of step 1245, the CPU makes a "No" determination at step 1245 to proceed to step 1255, at which the CPU sets the value of the imbalance occurrence flag XIMB to "2." That is, the CPU memorizes the "fact that it has been determined that the inter-cylinder air-fuel-ratio imbalance state has not occurred as a result of the inter-cylinder air-fuel-ratio imbalance determination." Subsequently, the CPU proceeds to step 1260.

Subsequently, the CPU proceeds to step 1260 to set (or clear) "each of the values (e.g., ΔAF, SAFD, Cn, AveΔAF, Save, Cs, and so on) used for the calculation of the air-fuel ratio imbalance indicating value RIMB" to (at) "0". Thereafter, the CPU proceeds to step 1295 to end the present routine tentatively.

If the value of the parameter obtaining permission flag Xkyoka is not "1" when the CPU proceeds to step 1205, the CPU makes a "No" determination at step 1205 to proceed to step 1265. At step 1265, the CPU sets (or clears) "each of the values (e.g., ΔAF, SAFD, Cn, and so on) used for the calculation of the average value AveΔAF" to (at) "0". Thereafter, the CPU proceeds to step 1295 to end the present routine tentatively.

Figure 12:
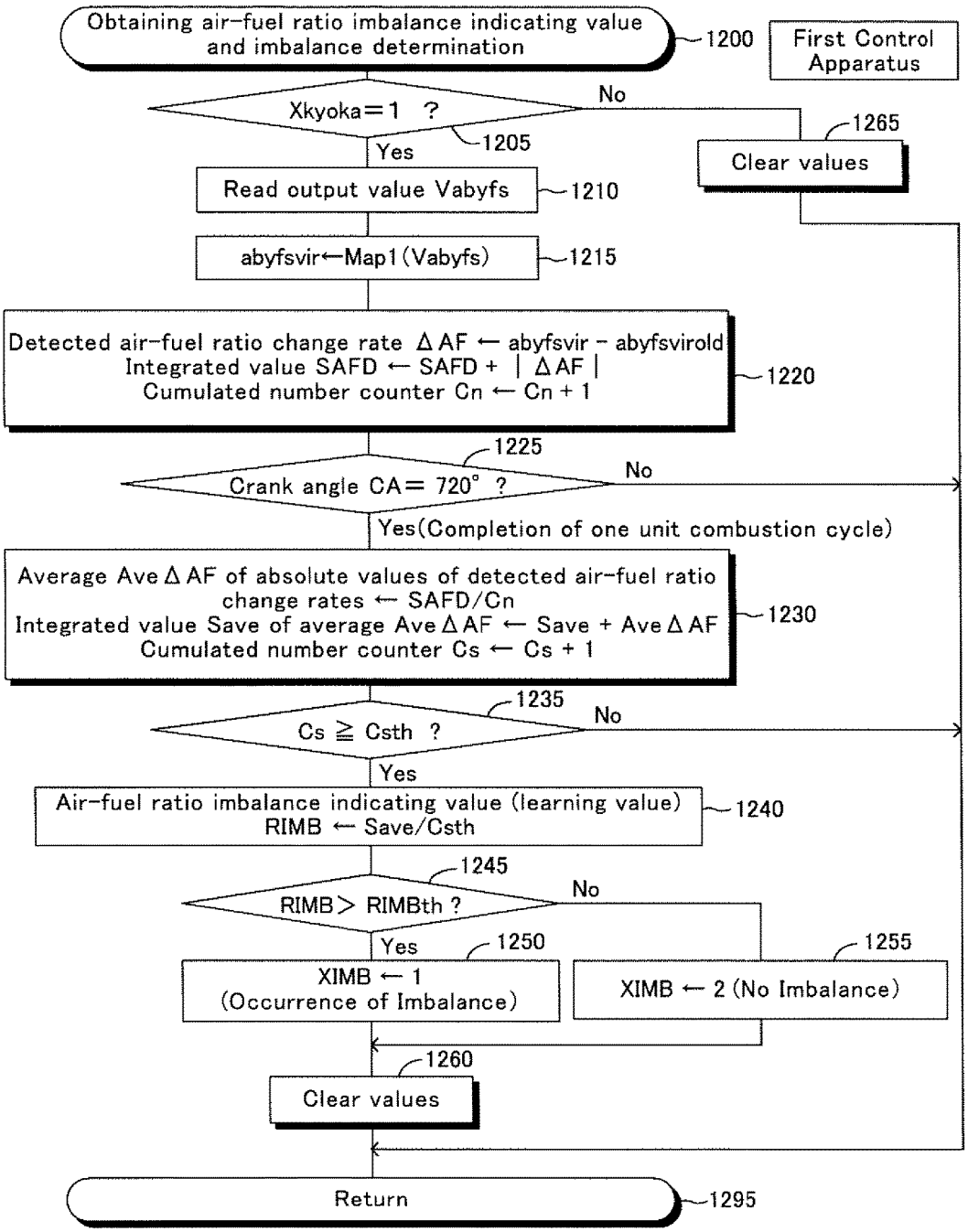
FIG. 12 is a flowchart showing a routine executed by the CPU of the first control apparatus.

As described above, the first control apparatus comprises:

an actual detected air-fuel ratio obtaining section configured so as to obtain the actual detected air-fuel ratio abyfsact by converting the actual output value Vabyfs of the air-fuel ratio sensor 56 into the air-fuel ratio (step 1020 shown in FIG. 10);

an instructed fuel injection amount calculation section configured so as to calculate the instructed fuel injection amount Fi by performing the feedback correction on an amount of the fuel injected from a plurality of the fuel injection valves 33 based on the actual detected air-fuel ratio abyfsact in such a manner that the actual detected air-fuel ratio abyfsact becomes equal to the target air-fuel ratio abyfr (steps from step 920 to step 950 shown in FIG. 9 (especially step 940), and steps from step 1025 to step 1050 shown in FIG. 10); and an air-fuel ratio imbalance indicating value obtaining section configured so as to obtain the air-fuel ratio imbalance indicating value RIMB (routine shown in FIG. 12).

Further, the actual detected air-fuel ratio obtaining section is configured so as to obtain the actual detected air-fuel ratio abyfsact by converting the "actual output value Vabyfs of the air-fuel ratio sensor 56" into the "air-fuel ratio which becomes leaner (larger)" as the obtained air-fuel ratio imbalance indicating value RIMB becomes larger (steps from step 1010 to step 1020 shown in FIG. 10, and the table shown in FIG. 5).

This apparatus can compensate for the "shift of the output value Vabyfs of the air-fuel ratio sensor 56 toward the rich side" caused by the non-uniformity among the cylinder-by-cylinder air-fuel ratios and the preferential diffusion of hydrogen. That is, the actual detected air-fuel ratio abyfsact is made come closer to the true air-fuel ratio. Consequently, the degree of the erroneous lean correction is reduced, so that the increase of the discharge amount of NOx can be avoided.

Furthermore, the instructed fuel injection amount calculation section calculates a feedback correction term (main feedback amount DFi) by multiplying a value (Gp·DFc+Gi·SDFc) correlated to a difference between the actual detected air-fuel ratio abyfsact and the target air-fuel ratio abyfr by a predetermined gain (responsivity correction gain Kimb) (step 1045 shown in FIG. 10), carries out the feedback correction using (based on) the feedback term, and sets the gain (responsivity correction gain Kimb) to a larger value in the period after rich-lean inversion time point than one in the period after lean-rich inversion time point (routine shown in FIG. 11).

Further, the instructed fuel injection amount calculation section sets the gain (responsivity correction gain Kimb) in such a manner that a difference between the gain (responsivity correction gain Kimb) set in the period after rich-lean inversion time point and the gain (responsivity correction gain Kimb) set in the period after lean-rich inversion time point becomes larger as the air-fuel ratio imbalance indicating value RIMB becomes larger (step 1130 and step 1140, shown in FIG. 11).

According to this configuration, it can be avoided that the "center of the feedback control deviates from the target air-fuel ratio abyfr due to the asymmetric responsivity of the air-fuel ratio sensor 56 between the lean-rich inversion time point and the rich-lean inversion time point."

<Second Embodiment>

Next, there will be described a control apparatus according to a second embodiment of the present invention (hereinafter, simply referred to as a "second control apparatus").

The first control apparatus described above comprises a plurality of tables (Map1(Vabyfs)-Map4(abyfs)); selects a table suitable for the actual air-fuel ratio imbalance indicating value RIMB among those tables; and obtains the actual detected air-fuel ratio abyfsact by applying the actual output value Vabyfs to the selected table.

Figure 13:
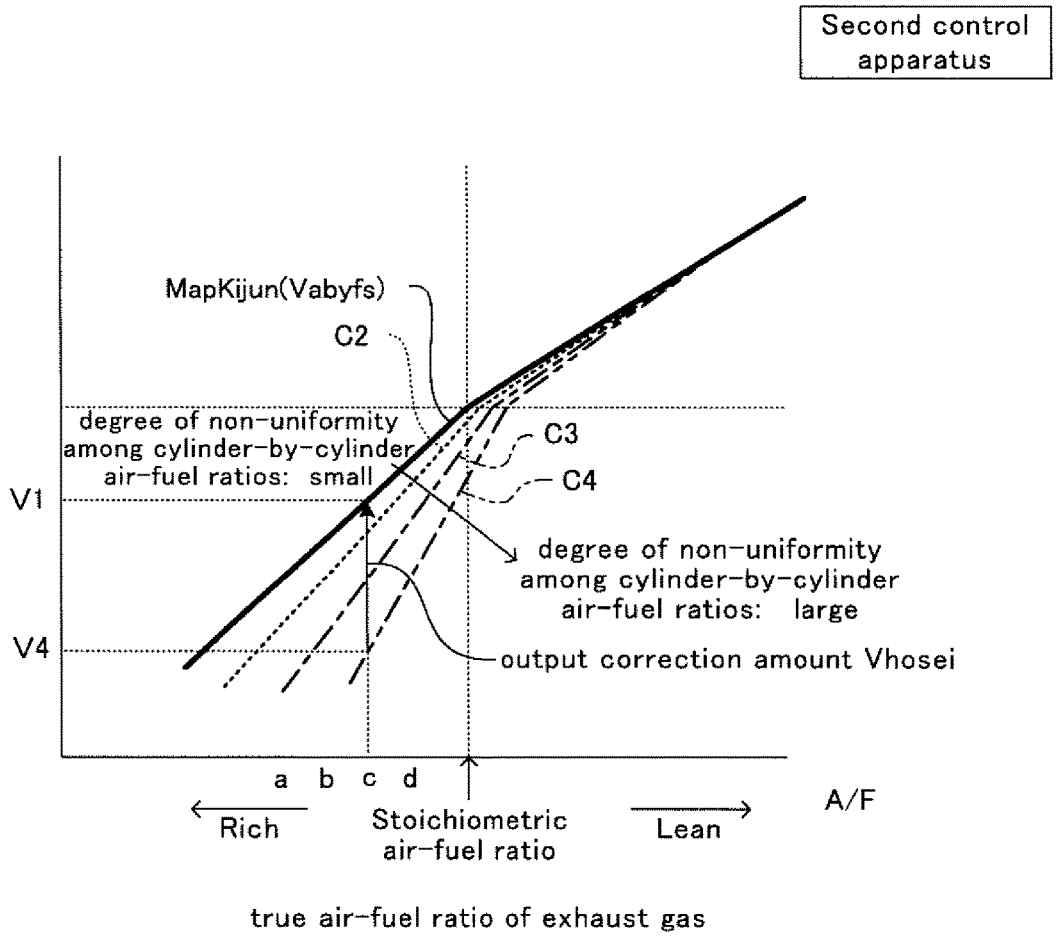
FIG. 13 is a graph showing a relationship between the air-fuel ratio of the exhaust gas and the output value of the air-fuel ratio sensor.

In contrast, the second control apparatus comprises an "air-fuel ratio conversion table MapKijun(Vabyfs)" shown in FIG. 13 only. The air-fuel ratio conversion table MapKijun(Vabyfs) is the same as the air-fuel ratio conversion table Map1(Vabyfs). That is, the air-fuel ratio conversion table MapKijun(Vabyfs) is a table which defines a "relationship between the output value Vabyfs and the true air-fuel ratio of the exhaust gas" in the case in which the non-uniformity among the cylinder-by-cylinder air-fuel ratios is not present (the air-fuel ratio imbalance indicating value RIMB is equal to "0"). The air-fuel ratio conversion table MapKijun(Vabyfs) is simply referred to as a "base (reference) table MapKijun(Vabyfs)." It should be noted that the base table MapKijun(Vabyfs) can be replaced with (by) a function which defines the "relationship between the output value Vabyfs and the actual detected air-fuel ratio abyfsact which is converted using the base table MapKijun(Vabyfs)." This function is referred to as a base function, for convenience.

The second control apparatus obtains the actual output value Vabyfs and the actual air-fuel ratio imbalance indicating value RIMB. As described above, the actual output value Vabyfs varies depending on the air-fuel ratio imbalance indicating value RIMB, even when the true air-fuel ratio of the exhaust gas is a "certain specific air-fuel ratio." For example, as shown in FIG. 13, when the true air-fuel ratio of the exhaust gas is "c", the output value Vabyfs is the value V1 if the air-fuel ratio imbalance indicating value RIMB is "0", and the output value Vabyfs is the value V4 if the air-fuel ratio imbalance indicating value RIMB is a "certain large value."

In view of the above, the second control apparatus determines, based on the obtained output value Vabyfs and the obtained air-fuel ratio imbalance indicating value RIMB, an output correction amount Vhosei to correct the value V4 to have the value V4 become the value V1 (output correction amount Vhosei for correcting the actual output value Vabyfs to have the actual output Vabyfs change into the "output value Vabyfs (obtained) when the air-fuel ratio imbalance indicating value RIMB is "0"). Further, the second control apparatus obtains a corrected output value Vafhoseigo by correcting the actual output value of the air-fuel ratio sensor based on the determined output correction amount Vhosei, and obtains the actual detected air-fuel ratio abyfsact by applying the obtained corrected output value Vafhoseigo to the base table MapKijun(Vabyfs) (i.e., by substituting the corrected output value Vafhoseigo into a variable Vabyfs of the base table MapKijun(Vabyfs)). The output correction amount Vhosei may be obtained in advance based on data that are obtained by experiments, the data being the "relationship between the output value Vabyfs and the true air-fuel ratio of the exhaust gas" while changing the air-fuel ratio imbalance indicating value RIMB into each of a various values, and the "relationship between the output value Vabyfs and the true air-fuel ratio of the exhaust gas" when the air-fuel ratio imbalance indicating value RIMB is "0."

(Actual Operation)

The CPU of the second control apparatus executes the routines shown in FIGS. 9, 11, and 12. Further, the second control apparatus executes a main feedback calculation routine shown in FIG. 14 in place of the routine shown in FIG. 10. The routines shown in FIGS. 9, 11, and 12 have already been described. Accordingly, the routine shown in FIG. 14 will next be described. It should be noted that each step in FIG. 14 at which the same process is performed as each step in FIG. 10 is given the same numeral as one given to such step in FIG. 10.

Figure 14:
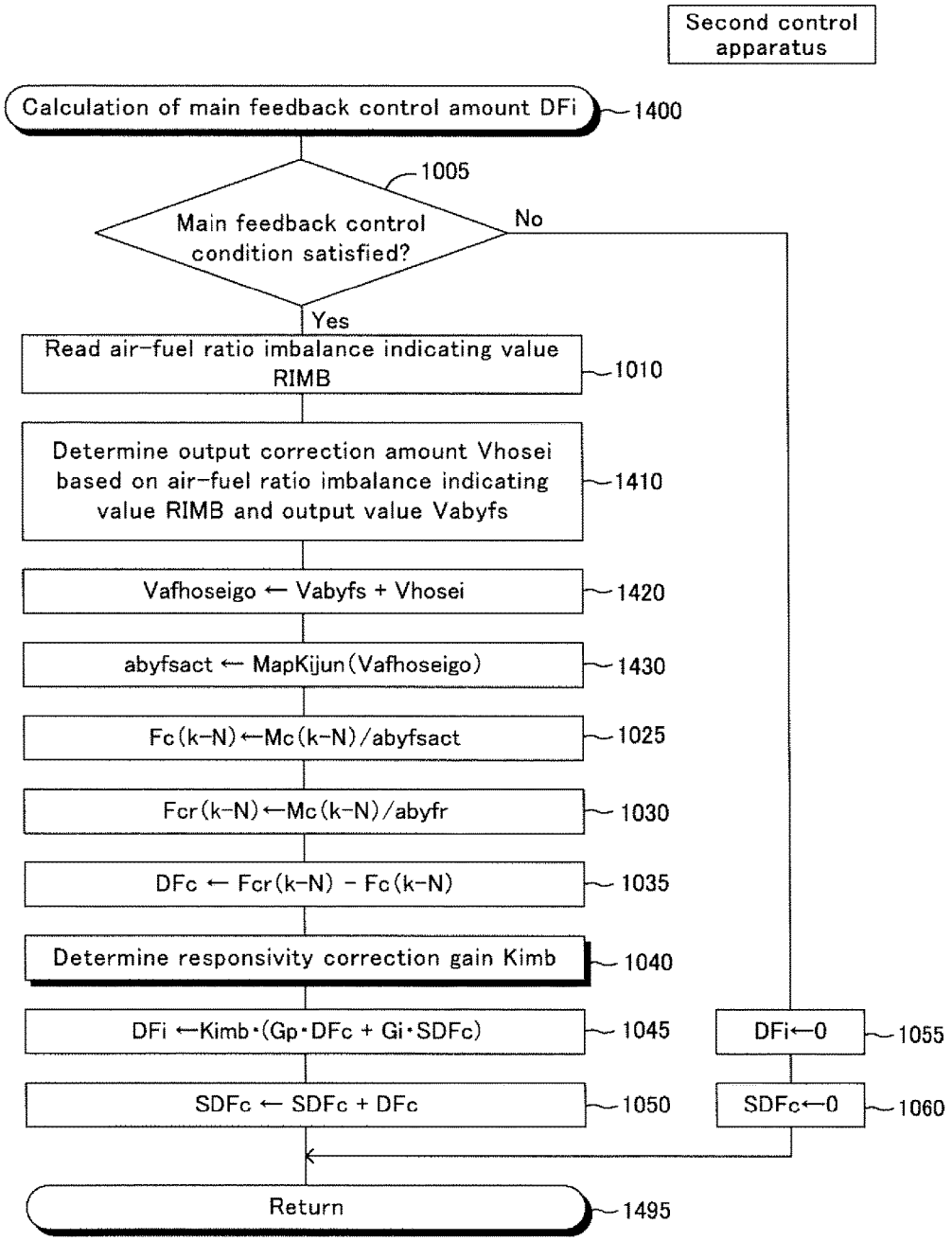
FIG. 14 is a flowchart showing a routine executed by a CPU of a fuel injection amount control apparatus (second control apparatus) according to a second embodiment of the present invention.

The CPU executes the routine shown in FIG. 14 at an appropriate time point similar to the time point at which the routine shown in FIG. 10 is executed. Accordingly, at an appropriate timing, the CPU starts the process from step 1400. At this time, if the main feedback control condition is satisfied, the CPU proceeds from step 1005 to step 1010, at which the CPU reads out the air-fuel ratio imbalance indicating value RIMB.

The CPU sequentially executes processes of steps from step 1410 to step 1430, described below, one after another. Thereafter, the CPU executes the processes of steps from step 1025 to step 1050, described above, and then ends the present routine tentatively.

Step 1410: The CPU determines the output correction amount Vhosei based on the air-fuel ratio imbalance indicating value RIMB and the output value Vabyfs. In actuality, the CPU determines the output correction amount Vhosei by applying the air-fuel ratio imbalance indicating value RIMB which was read at step 1010 and the present output value Vabyfs to a "table (output correction amount table) which is stored in the ROM and defines a relationship between (among) the air-fuel ratio imbalance indicating value RIMB, the output value Vabyfs, and the output correction amount Vhosei."

According to the table, the output correction amount Vhosei is determined so as to become larger as the air-fuel ratio imbalance indicating value RIMB becomes larger. Further, the output correction amount Vhosei is determined so as to become larger as the output value Vabyfs becomes larger.

Step 1420: The CPU obtains the corrected output value Vafhoseigo by correcting the output value Vabyfs with the output correction amount Vhosei. More specifically, the CPU obtains, as the corrected output value Vafhoseigo, a value obtained by adding the output correction amount Vhosei to the output value Vabyfs. It should be noted that the CPU may obtain corrected output value Vafhoseigo by multiplying the output value Vabyfs by the output correction amount Vhosei. In this case, the output correction amount Vhosei is set as a ratio of the corrected output value Vafhoseigo to the output value Vabyfs.

Step 1430: The CPU obtains the actual detected air-fuel ratio abyfsact by applying the corrected output value Vafhoseigo to the base table MapKijun(Vabyfs). Thereafter, the CPU of the second control apparatus carries out the main feedback control similarly to the CPU of the first control apparatus.

As described above, similarly to the first control apparatus, the second control apparatus comprises the instructed fuel injection amount calculation section, and the air-fuel ratio imbalance indicating value obtaining section.

Further, the second control apparatus comprises the actual detected air-fuel ratio obtaining section similar to the actual detected air-fuel ratio obtaining section of the first control apparatus (that is, a section to obtain the actual detected air-fuel ratio abyfsact by converting the actual output value Vabyfs into the air-fuel ratio which becomes leaner as the obtained air-fuel ratio imbalance indicating value RIMB becomes larger) (step 1010, steps from step 1410 to step 1430, shown in FIG. 14).

The actual detected air-fuel ratio obtaining section of the second control apparatus is configured so as to:

include the base table MapKijun(Vabyfs) (or an equivalent base function) which defines the "relationship between the output value Vabyfs and the true air-fuel ratio" when "there is no non-uniformity among the cylinder-by-cylinder air-fuel ratios" (refer to FIG. 13);

obtain, based on the obtained air-fuel ratio imbalance indicating value RIMB and the actual output value Vabyfs, the "output correction amount Vhosei for correcting the actual output value Vabyfs to become the output value when there is no non-uniformity of the cylinder-by-cylinder air-fuel ratios among a plurality of the cylinders" by correcting the actual output value Vabyfs to become the leaner output value as the air-fuel ratio imbalance indicating value RIMB becomes larger (refer to step 1410 shown in FIG. 14, and FIG. 13);

obtain the corrected output value Vafhoseigo by correcting the actual output value Vabyfs based on the obtained output correction amount Vhosei (step 1420 shown in FIG. 14); and obtain the actual detected air-fuel ratio abyfsact by applying the obtained corrected output value Vafhoseigo to the base table MapKijun(Vabyfs) (or the base function) (step 1430 shown in FIG. 14).

According to the configuration described above, the actual detected air-fuel ratio abyfsact is made closer to the true air-fuel ratio. Therefore, the degree of the erroneous lean correction is reduced, so that the increase of the discharge amount of NOx can be avoided.

<Third Embodiment>

Next, there will be described a control apparatus according to a third embodiment of the present invention (hereinafter, simply referred to as a "third control apparatus"). The third control apparatus is different from the first control apparatus in that the third control apparatus uses an "electromotive-force-type oxygen concentration sensor (well-known concentration-cell-type oxygen concentration sensor using the solid electrolyte such as stabilized zirconia) which is the same as the downstream air-fuel ratio sensor 57" serving as the upstream air-fuel ratio sensor 56 so as to perform the main feedback control.

Figure 15:
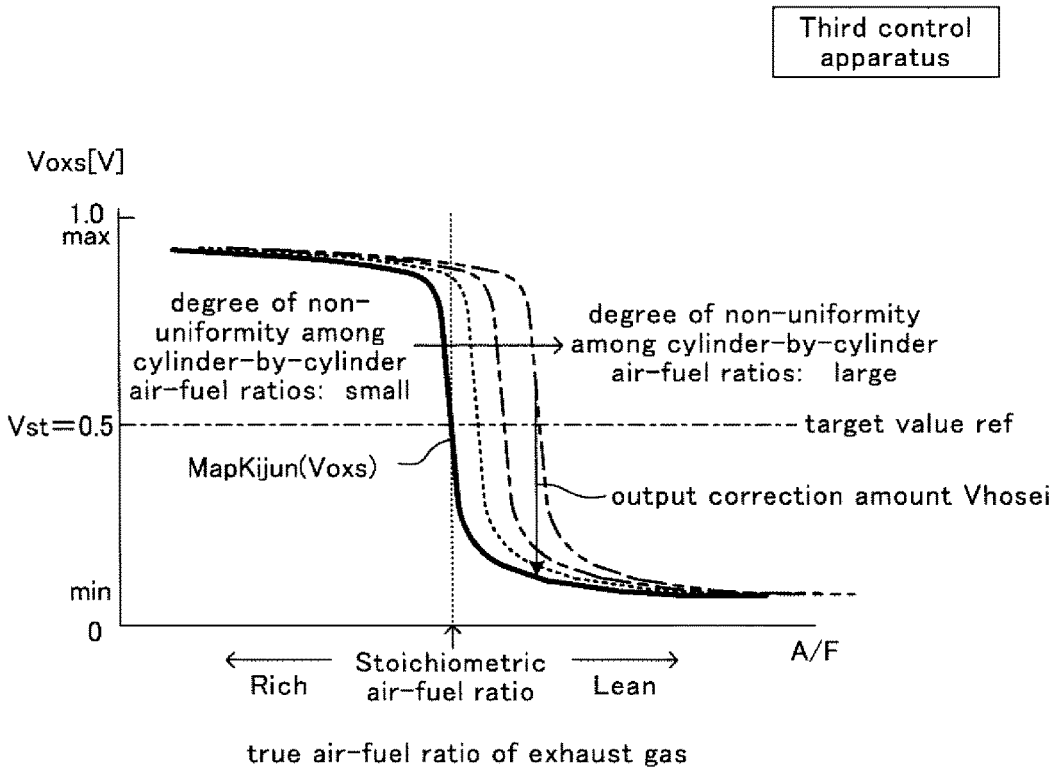
FIG. 15 is a graph showing a relationship between the air-fuel ratio of the exhaust gas and an output value of an air-fuel ratio sensor which is an "electro-motive-force-type oxygen concentration sensor."

As described above, the electro-motive-force-type oxygen concentration sensor also includes the porous layer. Accordingly, when the electro-motive-force-type oxygen concentration sensor is disposed between the exhaust gas aggregated portion HK and the upstream catalyst 43, the output value Voxs of the electro-motive-force-type oxygen concentration sensor is affected by the preferential diffusion of hydrogen. This causes the output value Voxs with respect to the true air-fuel ratio of the exhaust gas to vary depending on the degree of the non-uniformity among the cylinder-by-cylinder air-fuel ratios, as shown in FIG. 15.

Generally, when the electro-motive-force-type oxygen concentration sensor is used as the "upstream air-fuel ratio sensor for the main feedback control", the air-fuel ratio feedback control is carried out in such a manner that the output value Voxs coincides with a "target value Vref which is set at the value Vst corresponding to the stoichiometric air-fuel ratio." Accordingly, if no correction is made on the output value Voxs, an average of the true air-fuel ratio obtained as a result of the feedback control shifts toward the air-fuel ratio which becomes leaner with respect to the stoichiometric air-fuel ratio as the degree of the non-uniformity among the cylinder-by-cylinder air-fuel ratios becomes larger. That is, the erroneous lean correction occurs.

In view of the above, the third control apparatus determines, based on the obtained output value Voxs and the obtained air-fuel ratio imbalance indicating value RIMB, the output correction amount Vhosei for correcting the actual output value Voxs to become an output value Voxs when the air-fuel ratio imbalance indicating value RIMB is "0." Further, the third control apparatus obtains the corrected output value Vafhoseigo by correcting the obtained output value Voxs with (by) the determined output correction amount Vhosei. Thereafter, the third control apparatus performs the feedback control based on the corrected output value Vafhoseigo in such a manner that the corrected output value Vafhoseigo coincides with the "target value Vref corresponding to the target air-fuel ratio abyfr." The output correction amount Vhosei may be obtained in advance based on data that are obtained by experiments, the data being the "relationship between the output value Voxs and the true air-fuel ratio of the exhaust gas" while changing the air-fuel ratio imbalance indicating value RIMB into each of a various values, and the "relationship between the output value Voxs and the true air-fuel ratio of the exhaust gas" when the air-fuel ratio imbalance indicating value RIMB is "0."

(Actual Operation)

The CPU of the third control apparatus executes the routines shown in FIGS. 9, and 12. Note that the CPU reads out the output value Voxs at step 1210 shown in FIG. 12, and omits step 1215. Further, the CPU replaces the virtual detected air-fuel ratio abyfsvir at step 1220 with (by) the "output value Voxs", and replaces the previous virtual detected air-fuel ratio abyfsvirold with (by) the "previous output value Voxsold."

Figure 16:
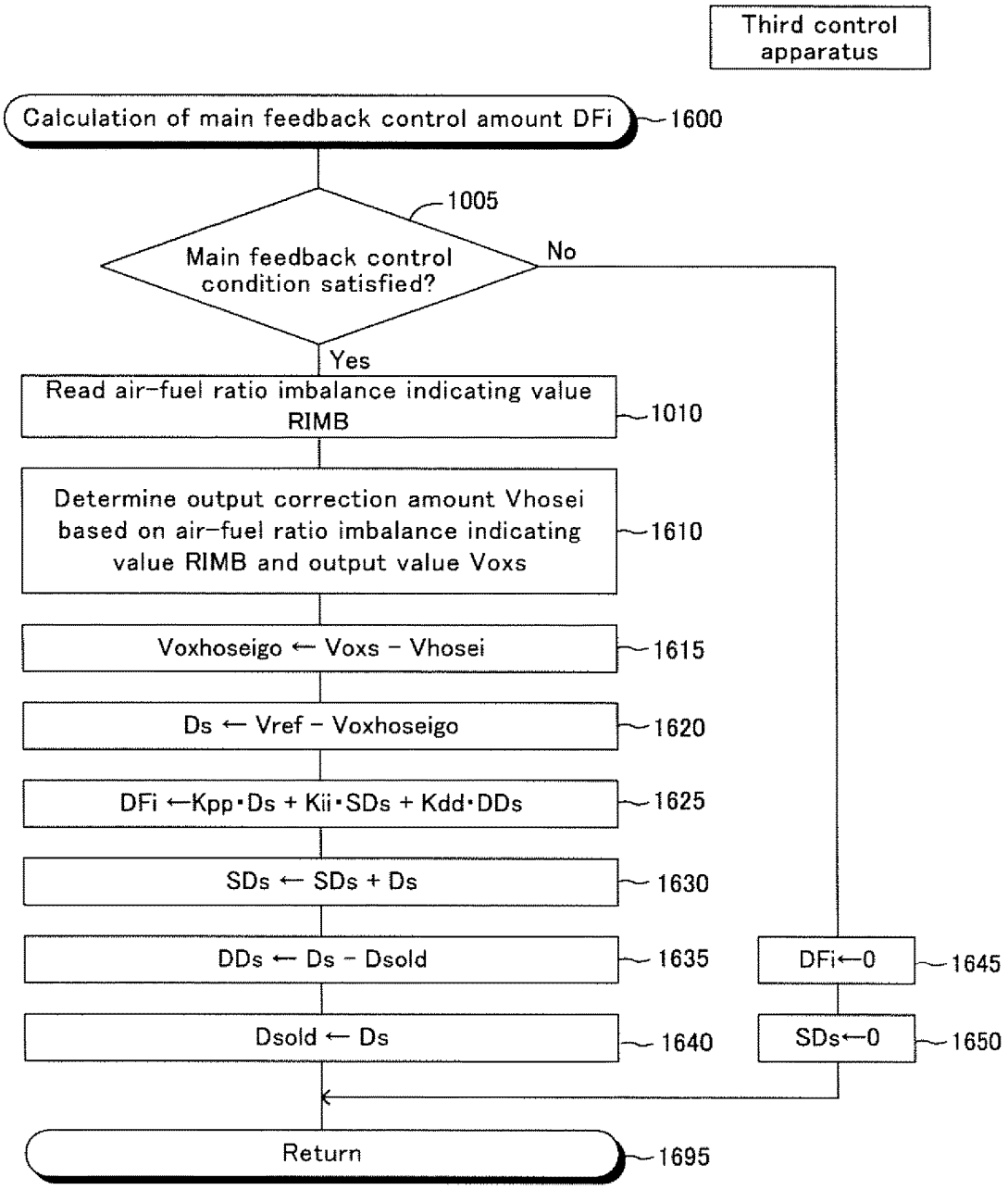
FIG. 16 is a flowchart showing a routine executed by a CPU of a fuel injection amount control apparatus (third control apparatus) according to a third embodiment of the present invention.

In addition, the CPU of the third control apparatus executes a main feedback calculation routine shown in FIG. 16 in place of the routine shown in FIG. 10. The routines shown in FIGS. 9 and 12 have already been described. Accordingly, the routine shown in FIG. 16 will next be described. It should be noted that each step in FIG. 16 at which the same process is performed as each step in FIG. 10 is given the same numeral as one given to such step in FIG. 10.

The CPU executes the routine shown in FIG. 16 at an appropriate time point similar to the time point at which the routine shown in FIG. 10 is executed. Accordingly, at an appropriate timing, the CPU starts the process from step 1600. At this time, if the main feedback control condition is satisfied, the CPU proceeds from step 1005 to step 1010, at which the CPU reads out the air-fuel ratio imbalance indicating value RIMB.

Thereafter, the CPU sequentially executes processes of steps from step 1610 to step 1640, described below, one after another, and ends the present routine tentatively.

Step 1610: The CPU determines the output correction amount Vhosei based on the air-fuel ratio imbalance indicating value RIMB and the output value Voxs. In actuality, the CPU determines the output correction amount Vhosei by applying the air-fuel ratio imbalance indicating value RIMB which was read at step 1010 and the present output value Voxs to a "table (output correction amount table) which is stored in the ROM and defines a relationship between (among) the air-fuel ratio imbalance indicating value RIMB, the output value Voxs, and the output correction amount Vhosei."

Step 1615: The CPU obtains the corrected output value Voxhoseigo by correcting the output value Voxs with the output correction amount Vhosei. More specifically, the CPU obtains, as the corrected output value Voxhoseigo, a value obtained by subtracting the output correction amount Vhosei from the output value Voxs.

Step 1620: The CPU obtains the output error amount Ds by subtracting the "corrected output value Voxhoseigo" from the "target value Vref." The target value Vref is set at the value Vst (e.g., 0.5 V) corresponding to the stoichiometric air-fuel ratio.

Step 1625: The CPU obtains the main feedback amount DFi, according to a formula (14) described below. In the formula (14) below, Kpp is a predetermined proportion gain (proportion constant), Kii is a predetermined integration gain (integration constant), and Kdd is a predetermined differential gain (differential constant). The SDs is an integrated value of the output error amount Ds, and the DDs is a differential value of the output error amount Ds.

$$DFi=Kpp\cdot Ds+Kii\cdot SDs+Kdd\cdot DDs \quad (14)$$

Step 1630: The CPU obtains a new integrated value SDs of the output error amount by adding the "output error amount Ds obtained at step 1620" to the "current integrated value SDs of the output error amount."

Step 1635: The CPU obtains a new differential value DDs by subtracting a "previous output error amount Dsold which is the output error amount Ds calculated when the present routine was executed at a previous time" from the "output error amount Ds calculated at step 1620".

Step 1640: The CPU stores the "output error amount Ds calculated at step 1620" as the "previous output error amount Dsold."

In this way, the CPU calculate the "main feedback amount DFi" according to a proportional-integral-differential (PID) control to have/make the output value Voxs of the electromotive-force-type oxygen concentration sensor which is disposed at the position at which the upstream air-fuel ratio sensor 56 is disposed coincide with the target value Vref.

In contrast, if the main feedback control condition is not satisfied when the CPU executes the process of step 1005, the CPU makes a "No" determination at step 1005 to executes processes of step 1645 and step 1650 described below, and thereafter, the CPU proceeds to step 1695 to end the present routine tentatively.

Step 1645: The CPU sets the main feedback amount DFi to (at) "0."

Step 1650: The CPU sets the integrated value SDs of the output error amount to (at) "0."

As described above, the third control apparatus comprises the instructed fuel injection amount calculation section calculates the instructed fuel injection amount Fi by performing, based on the actual output value Voxs of the air-fuel ratio sensor (electro-motive-force-type oxygen concentration sensor which is disposed at the position at which the upstream air-fuel ratio sensor 56 is disposed), the feedback correction on the amount of the fuel injected from a plurality of the fuel injection valves 33 in such a manner that the "value based on the actual output value Voxs" coincides with the target value Vref (refer to the routine shown in FIG. 16, and the routine shown in FIG. 9). The instructed fuel injection amount calculation section is configured so as to obtain the corrected output value Voxhoseigo by correcting the "actual output value Voxs of the air-fuel ratio sensor" to be a value in the leaner side as the air-fuel ratio imbalance indicating value RIMB becomes larger (step 1010, steps from step 1610 to step 1615, shown in FIG. 16), and so as to perform the feedback correction based on the corrected output value Voxhoseigo (steps from step 1615 to step 1640, shown in FIG. 16).

According to the configuration described above, the corrected output value Voxhoseigo becomes a "value corresponding to the true air-fuel ratio." Therefore, the degree of the erroneous lean correction is reduced, so that the increase of the discharge amount of NOx can be avoided.

It should be noted that. similarly to the first control apparatus, the third control apparatus may store air-fuel ratio conversion tables defining the "relationship between the output value Voxs and the true air-fuel ratio of the exhaust gas" that are indicated by "a solid line, a broken line, an alternate long and short dash line, and an alternate long and two short dashes line" shown in FIG. 15, with linking the "air-fuel ratio imbalance indicating value RIM"; select an air-fuel ratio conversion table which corresponds to (matches) the actual air-fuel ratio imbalance indicating value RIMB among those tables; and obtain the actual detected air-fuel ratio abyfsact by applying the actual output value Voxs to the selected air-fuel ratio conversion table. In this case, the CPU executes a routine similar to the routine shown in FIG. 10 to calculate the main feedback amount DFi.

As described above, each of the fuel injection amount control apparatuses according to each of the embodiments of the present invention can avoid/prevent the erroneous lean correction which occurs when the degree of the non-uniformity among the cylinder-by-cylinder air-fuel ratios becomes larger. Accordingly, the air-fuel ratio of the exhaust gas can come closer to the target air-fuel ratio, and thus, the amount of discharged substances such as NOx can be decreased.

The present invention is not limited to the above-described embodiments, and may be modified in various manners without departing from the scope of the present invention. For example, the air-fuel imbalance indicating value obtaining section may obtain the air-fuel ratio imbalance indicating value RIMB as follows.

(A) As described above, the imbalance indicating value obtaining section is configured so as to obtain, as the air-fuel ratio imbalance indicating value RIMB, the value which becomes larger as the variation (amplitude of the fluctuation) of the air-fuel ratio of the exhaust gas passing through the position at which the upstream air-fuel ratio sensor 56 is disposed becomes larger, based on the output value Vabyfs (or the output value Voxs).

More specifically, in this case, the imbalance indicating value obtaining section may be configured as follows. It should be noted that a value correlated to a value X may mean a value varying depending on the value X, such as an average of absolute values of a plurality of the values X obtained in a predetermined period (e.g., the unit combustion cycle period, or the time period having an integral (natural number) multiple of the unit combustion cycle period), and a difference between a maximum value and a minimum value of the value X in the predetermined period.

(A-1)

The imbalance indicating value obtaining section may be configured so as to obtain a differential value d(Vabyfs)/dt of the output value Vabyfs of the upstream air-fuel ratio sensor 56 (the output value Voxs when the upstream air-fuel ratio sensor 56 is the electro-motive-force-type oxygen concentration sensor) with respect to time, and obtain, as the air-fuel ratio imbalance indicating value RIMB, a value correlated to the obtained differential value d(Vabyfs)/dt.

One example of the values correlated to the obtained differential value d(Vabyfs)/dt is an average of the absolute values of a plurality of the differential values d(Vabyfs)/dt obtained in the unit combustion cycle period or a period having a time length of an integral (natural number) multiple of the unit combustion cycle period. Another example of the values correlated to the obtained differential value d(Vabyfs)/dt is a value obtained averaging maximum values over a plurality of the unit combustion cycles, each maximum value being obtained among the absolute values of a plurality of the obtained differential values d(Vabyfs)/dt in the unit combustion cycle period.

(A-2)

As described above, the imbalance indicating value obtaining section is configured so as to obtain a differential value d(abyfsvir)/dt of the virtual detected air-fuel ratio abyfsvir represented by the output value Vabyfs of the upstream air-fuel ratio sensor 56 with respect to time, and obtain, as the air-fuel ratio imbalance indicating value RIMB, a value correlated to the obtained differential value d(abyfsvir)/dt.

One example of the values correlated to the obtained differential value d(abyfsvir)/dt is an average of the absolute values of a plurality of the differential values d(abyfsvir)/dt obtained in the unit combustion cycle period or a period having a time length of an integral (natural number) multiple of the unit combustion cycle period (refer to the routine shown in FIG. 12). Another example of the values correlated to the obtained differential value d(abyfsvir)/dt is a value which is obtained by averaging maximum values over a plurality of the unit combustion cycles, each maximum value being obtained among the absolute values of a plurality of the differential values d(abyfsvir)/dt obtained in the unit combustion cycle.

(A-3)

The imbalance indicating value obtaining section may be configured so as to obtain a second order differential value $d^2(Vabyfs)/dt^2$ with respect to time of the output value Vabyfs of the upstream air-fuel ratio sensor 56 (the output value Voxs when the upstream air-fuel ratio sensor 56 is the electro-motive-force-type oxygen concentration sensor), and obtain, as the air-fuel ratio imbalance indicating value RIMB, a value correlated to the obtained second order differential value $d^2(Vabyfs)/dt^2$. Since the output value Vabyfs and the virtual detected air-fuel ratio abyfsvir are proportional to each other (refer to FIG. 5), the second order differential value $d^2(Vabyfs)/dt^2$ indicates the same inclination as a second order differential value $d^2(abyfsvir)/dt^2$ of the virtual detected air-fuel ratio abyfsvir with respect to time. Accordingly, the second order differential value $d^2(Vabyfs)/dt^2$ becomes relatively small as shown by the broken line C5 of (D) of FIG. 7 when the difference among the cylinder-by-cylinder air-fuel ratios is small, and becomes relatively large as shown by the solid line C6 of (D) of FIG. 7 when the difference among the cylinder-by-cylinder air-fuel ratios is large.

It should be noted that the second order differential value $d^2(Vabyfs)/dt^2$ may be obtained by obtaining the differential value d(Vabyfs)/dt by subtracting the output value Vabyfs constant sampling time before from the current output value Vabyfs, and by subtracting the differential values d(Vabyfs)/dt constant sampling time before from the newly obtained differential values d(Vabyfs)/dt.

One example of the values correlated to the obtained second order differential value $d^2(Vabyfs)/dt^2$ is an average of the absolute values of a plurality of the second order differential values $d^2(Vabyfs)/dt^2$ obtained in the unit combustion cycle period or a period having a time length of an integral (natural number) multiple of the unit combustion cycle period. Another example of the values correlated to the obtained second order differential value $d^2(Vabyfs)/dt^2$ is a value which is obtained by averaging maximum values over a plurality of the unit combustion cycles, each maximum value being obtained among the absolute values of a plurality of the obtained second order differential value $d^2(Vabyfs)/dt^2$ in the unit combustion cycle.

(A-4)

The imbalance indicating value obtaining section may be configured so as to obtain a second order differential value $d^2(abyfsvir)/dt^2$ with respect to time of the virtual detected air-fuel ratio abyfsvir represented by the output value Vabyfs of the upstream air-fuel ratio sensor 56, and obtain, as the air-fuel ratio imbalance indicating value RIMB, a value correlated to the obtained second order differential value $d^2(abyfs)/dt^2$. The second order differential value $d^2(abyfsvir)/dt^2$ becomes relatively small as shown by a broken line C5 in (D) of FIG. 7 when the difference among the cylinder-by-cylinder air-fuel ratios is small, and becomes relatively large as shown by a solid line C6 in (D) of FIG. 7 when the difference among the cylinder-by-cylinder air-fuel ratios is large.

It should be noted that the second order differential value $d^2(abyfsvir)/dt^2$ may be obtained by subtracting the detected air-fuel ratio changing rate ΔAF obtained a constant sampling time before from the detected air-fuel ratio changing rate ΔAF obtained at step 1220 shown in FIG. 12.

One example of the values correlated to the obtained second order differential value $d^2(abyfsvir)/dt^2$ is an average of the absolute values of a plurality of the second order differential values $d^2(abyfsvir)/dt^2$ obtained in the unit combustion cycle period or a period having a time length of an integral (natural number) multiple of the unit combustion cycle period. Another example of the values correlated to the obtained second order differential value $d^2(abyfsvir)/dt^2$ is a value which is obtained by averaging maximum values over a plurality of the unit combustion cycles, each maximum value being obtained among the absolute values of a plurality of the second order differential values $d^2(abyfsvir)/dt^2$ obtained in the unit combustion cycle.

It should be noted that each of the values correlated to "the differential values d(Vabyfs)/dt, the differential values d(abyfsvir)/dt, the second order differential value $d^2(Vabyfs)/dt^2$, and the second order differential value $d^2(abyfsvir)/dt^2$" is affected by the intake air amount Ga, but is unlikely to be affected by the engine rotational speed NE. This is because, as described above, a flow rate of the exhaust gas inside of the protective cover of the air-fuel ratio sensor 56 varies depending on a flow rate of the exhaust gas EX flowing in the vicinity of the through holes of the protective cover (and thus, the intake air amount (flow rate) Ga). Accordingly, those values are preferable parameters for the base indicating value of the air-fuel ratio imbalance indicating value RIMB, since they can indicate/represent the degree of the non-uniformity among the cylinder-by-cylinder air-fuel ratios without being affected by the engine rotational speed NE.

(A-5)

The imbalance indicating value obtaining section may be configured so as to obtain, as the air-fuel ratio imbalance indicating value RIMB, a value correlated to a difference ΔX between a maximum value and a minimum value of the output value Vabyfs of the upstream air-fuel ratio sensor 56 (the output value Voxs when the upstream air-fuel ratio sensor 56 is the electro-motive-force-type oxygen concentration sensor) in a predetermined period (e.g., period having a time length of an integral (natural number) multiple of the unit combustion cycle period), or a value correlated to a difference ΔY between a maximum value and a minimum value of the virtual detected air-fuel ratio abyfsvir represented by the output value Vabyfs of the upstream air-fuel ratio sensor 56 in the predetermined period. As is clear from the solid line C2 and the broken line C1 shown in (B) of FIG. 7, the difference ΔY (absolute value of ΔY) becomes larger as the degree of the non-uniformity among the cylinder-by-cylinder air-fuel ratios becomes larger. Therefore, the difference ΔX (absolute value of ΔX) becomes larger as the degree of the non-uniformity among the cylinder-by-cylinder air-fuel ratios becomes larger. One example of the values correlated to the difference ΔX (or ΔY) is an average of the absolute values of a plurality of the differences ΔX (or ΔY) obtained in the unit combustion cycle period or a period having a time length of an integral (natural number) multiple of the unit combustion cycle period.

(A-6)

The imbalance indicating value obtaining section may be configured so as to obtain, as the air-fuel ratio imbalance indicating value RIMB, a value correlated to a trace/trajectory length of the output value Vabyfs of the upstream air-fuel ratio sensor 56 (the output value Voxs when the upstream air-fuel ratio sensor 56 is the electro-motive-force-type oxygen concentration sensor) in a predetermined period, or a value correlated to a trace/trajectory length of the virtual detected air-fuel ratio abyfsvir represented by the output value Vabyfs of the upstream air-fuel ratio sensor 56 in the predetermined period. As is apparent from (B) of FIG. 7, those trace/trajectory lengths become larger as the difference among the cylinder-by-cylinder air-fuel ratios becomes larger. For example, the value correlated to the trace/trajectory length is an average of absolute values of a plurality of the trace/trajectory lengths obtained in the unit combustion cycle period or a period having a time length of an integral (natural number) multiple of the unit combustion cycle period.

It should be noted that the trace/trajectory length of the virtual detected air-fuel ratio abyfsvir may be obtained by obtaining the virtual detected air-fuel ratio abyfsvir every elapse of a constant sampling time ts, and accumulating an absolute value of a difference between the virtual detected air-fuel ratio abyfsvir and the virtual detected air-fuel ratio abyfsvirold which was obtained the constant sampling time ts before, for example.

(B) The imbalance indicating value obtaining section may be configured so as to obtain, as the air-fuel ratio imbalance indicating value, a value (rotational speed fluctuation correlated value) which becomes larger as a variation of the rotational speed of the engine 10 becomes larger. The rotational speed fluctuation correlated value may be obtained by obtaining an absolute value of a change amount ΔNE of the engine rotational speed NE every elapse of a constant sampling time, and averaging a plurality of the absolute values of the change amounts ΔNE in the unit combustion cycle period, for example.

Further, the first control apparatus may select, among the air-fuel ratio conversion table Map1(Vabyfs)—the air-fuel ratio conversion table Map4(Vabyfs), two of the air-fuel ratio conversion table MapN1(Vabyfs) and the air-fuel ratio conversion table MapN2(Vabyfs), that are linked to an air-fuel ratio imbalance indicating value which is the closest to the obtained air-fuel ratio imbalance indicating value RIMB and an air-fuel ratio imbalance indicating value which is the second closest to the obtained air-fuel ratio imbalance indicating value RIMB, respectively, and obtain the actual detected air-fuel ratio abyfsact by applying an interpolation method to two of air-fuel ratios that are obtained using those two of the air-fuel ratio conversion tables.

Further, each of the fuel injection amount control apparatuses for an internal combustion engine of the embodiments according to the present invention may additionally performs an air-fuel ratio feedback control (sub feedback control) based on the output value Voxs of the downstream air-fuel ratio sensor 57. In this case, the control apparatus may obtain a sub feedback amount KSFB according to a PID control in such a manner that the output value Voxs coincides with a value corresponding to the base air-fuel ratio (e.g., value Vst corresponding to the stoichiometric air-fuel ratio), and correct the target air-fuel ratio abyfr based on the sub feedback amount KSFB.

Further, the above described responsivity correction gain Kimb may be set to (at) "1" in the predetermined period from the point in time at which actual detected air-fuel ratio abyfsact changed to the "air-fuel ratio leaner than the stoichiometric air-fuel ratio stoich" from the "air-fuel ratio richer than the stoichiometric air-fuel ratio stoich" and when the actual detected air-fuel ratio abyfsact is still the "air-fuel ratio leaner than the stoichiometric air-fuel ratio stoich", and may be set to (at) a value which decreases within a range smaller than "1" as the air-fuel ratio imbalance indicating value RIMB becomes larger, in the period which is not the period from the point in time at which the actual detected air-fuel ratio abyfsact changed to the "air-fuel ratio leaner than the stoichiometric air-fuel ratio stoich" from the "air-fuel ratio richer than the stoichiometric air-fuel ratio stoich" or when the actual detected air-fuel ratio abyfsact is the "air-fuel ratio richer than the stoichiometric air-fuel ratio stoich."

Further, step 1110 shown in FIG. 11 may be replaced with (by) step at which the CPU determines whether or not the present point in time is within a predetermined time from the time point at which the output value Vabyfs has changed to a value smaller than the value Vstoich corresponding to the stoichiometric air-fuel ratio from a value larger than the value Vstoich (refer to FIG. 5).

Furthermore, each of the control apparatuses described above may be applied to a V-type engine. In such a case, the V-type engine may comprise right bank upstream catalyst disposed at a position downstream of an exhaust gas merging (aggregated) portion of two or more of cylinders belonging to a right bank. In addition, the V-type engine may comprise a left bank upstream catalyst disposed at a position downstream of an exhaust gas merging portion of two or more of cylinders belonging to a left bank.

Further, the V-type engine may comprise an upstream air-fuel ratio sensor for the right bank and a downstream air-fuel ratio sensor for the right bank disposed upstream and downstream of the right bank upstream catalyst, respectively, and may comprise upstream air-fuel ratio sensor for the left bank and a downstream air-fuel ratio sensor for the left bank disposed upstream and downstream of the left bank upstream catalyst, respectively.

Each of the upstream air-fuel ratio sensors, similarly to the air-fuel ratio sensor 56, is disposed between the exhaust gas merging portion of each of the banks and the upstream catalyst of each of the banks. In this case, a main feedback control for the right bank and a sub feedback for the right bank are performed. A main feedback control for the left bank and a sub feedback for the left bank are independently performed.

In this case, the control apparatus may obtain an air-fuel ratio imbalance indicating value RIMB for the right bank based on the output value of the upstream air-fuel ratio sensor for the right bank, and may obtain an actual detected air-fuel ratio abyfsact for the right bank. Similarly, the control apparatus may obtain an air-fuel ratio imbalance indicating value RIMB for the left bank based on the output value of the upstream air-fuel ratio sensor for the left bank, and may obtain an actual detected air-fuel ratio abyfsact for the left bank.

In addition, the control apparatus according to each of the embodiments described above obtains the actual detected air-fuel ratio abyfsact, without discriminating between a case in which the air-fuel ratio of the imbalanced cylinder deviates toward the rich side with respect to the stoichiometric air-fuel ratio stoich and a case in which the air-fuel ratio of the imbalanced cylinder deviates toward the lean side with respect to the stoichiometric air-fuel ratio stoich. This is because, the degrees of the erroneous lean correction in those cases are the same as each other, if the absolute values of the imbalance ratios are the same as each other in those cases (i.e., the air-fuel ratio imbalance indicating value RIMB are the same as each other in those cases).

In contrast, even when the air-fuel ratio imbalance indicating value RIMB is a "certain same value", the first control apparatus may be configured so as to select an air-fuel ratio conversion table when the air-fuel ratio of the imbalanced cylinder deviates toward the rich side with respect to the stoichiometric air-fuel ratio stoich different from an air-fuel ratio conversion table when the air-fuel ratio of the imbalanced cylinder deviates toward the lean side with respect to the stoichiometric air-fuel ratio stoich, or vice versa, and may obtain the actual detected air-fuel ratio abyfsact based on the selected air-fuel ratio conversion table.

It should be noted that it can be determined whether the air-fuel ratio of the imbalanced cylinder deviates toward the rich side or the lean side with respect to the stoichiometric air-fuel ratio stoich, based on the fluctuation of the engine rotational speed (the fluctuation becomes larger when the air-fuel ratio of the imbalanced cylinder deviates toward the lean side with respect to the stoichiometric air-fuel ratio stoich than when air-fuel ratio of the imbalanced cylinder deviates toward the rich side with respect to the stoichiometric air-fuel ratio stoich), or based on the following method.

The CPU obtains an average PAF of the "differential values d(abyfsvir)/dt, each of which is positive" among the differential values d(abyfsvir)/dt in the unit combustion cycle.

The CPU obtains an average NAF of absolute values of the "differential values d(abyfsvir)/dt, each of which is negative" among the differential values d(abyfsvir)/dt in the unit combustion cycle.

The CPU determines that the air-fuel ratio of the imbalanced cylinder deviates toward the rich side with respect to the stoichiometric air-fuel ratio stoich when the average NAF is larger than the average PAF.

The CPU determines that the air-fuel ratio of the imbalanced cylinder deviates toward the lean side with respect to the stoichiometric air-fuel ratio stoich when the average NAF is smaller than the average PAF.

The invention claimed is:

1. A fuel injection amount control apparatus comprising:

a multi-cylinder internal combustion engine;

a three way catalyst which is disposed in an exhaust passage of said engine and at a position downstream of an exhaust gas aggregated portion into which exhaust gases discharged from a plurality of cylinders of said engine merge;

an air-fuel ratio sensor, which is disposed in said exhaust passage and at a position between said exhaust gas aggregated portion and said catalyst, which includes an air-fuel ratio detection element, an exhaust-gas-side electrode layer and a reference-gas-side electrode layer that are formed so as to face to each other across said air-fuel ratio detection element, and a porous layer which covers said exhaust-gas-side electrode layer, and which outputs an output value corresponding to an amount of oxygen and an amount of unburnt substances that are contained in an exhaust gas that has reached said exhaust-gas-side electrode layer via said porous layer, said gas being included in an exhaust gas passing through said position at which said air-fuel ratio sensor is disposed;

a plurality of fuel injection valves, each of which is configured so as to inject a fuel to be contained in a mixture supplied to each of combustion chambers of a plurality of said cylinders in an amount corresponding to an instructed fuel injection amount; and an electric controller configured to:

obtain an actual detected air-fuel ratio based on an actual output value (Vabyfs) of said air-fuel ratio sensor;

calculate said instructed fuel injection amount by performing, based on said actual detected air-fuel ratio, a feedback correction on said amount of said fuel injected from a plurality of said fuel injection valves in such a manner that said actual detected air-fuel ratio coincides with a target air-fuel ratio; and obtain an air-fuel ratio imbalance indicating value which becomes larger as a degree of a non-uniformity among a plurality of said cylinders of cylinder-by-cylinder air-fuel ratios, each of which is an air-fuel ratio of said mixture supplied to each of said combustion chambers of a plurality of said cylinders, becomes larger, wherein, said electric controller is configured to:

obtain said actual detected air-fuel ratio by converting said actual output value (Vabyfs) of said air-fuel ratio sensor into an air-fuel ratio which becomes leaner as said obtained air-fuel ratio imbalance indicating value becomes larger;

obtain a virtual detected air-fuel ratio (abyfsvir) by converting said actual output value (Vabyfs) of said air-fuel ratio sensor into an air-fuel ratio based on a relationship between said output value of said air-fuel ratio sensor and a true air-fuel ratio only when there is no non-uniformity among a plurality of said cylinders of said cylinder-by-cylinder air-fuel ratios; and obtain said air-fuel ratio imbalance indicating value using said obtained virtual detected air-fuel ratio (abyfsvir).

2. A fuel injection amount control apparatus comprising:

a multi-cylinder internal combustion engine;

a three way catalyst which is disposed in an exhaust passage of said engine and at a position downstream of an exhaust gas aggregated portion into which exhaust gases discharged from a plurality of cylinders of said engine merge;

an air-fuel ratio sensor, which is disposed in said exhaust passage and at a position between said exhaust gas aggregated portion and said catalyst, which includes an air-fuel ratio detection element, an exhaust-gas-side electrode layer and a reference-gas-side electrode layer that are formed so as to face to each other across said air-fuel ratio detection element, and a porous layer which covers said exhaust-gas-side electrode layer, and which outputs an output value corresponding to an amount of oxygen and an amount of unburnt substances that are contained in an exhaust gas that has reached said exhaust-gas-side electrode layer via said porous layer, said gas being included in an exhaust gas passing through said position at which said air-fuel ratio sensor is disposed;

a plurality of fuel injection valves, each of which is configured so as to inject a fuel to be contained in a mixture supplied to each of combustion chambers of a plurality of said cylinders in an amount corresponding to an instructed fuel injection amount; and an electric controller configured to:

obtain an actual detected air-fuel ratio based on an actual output value (Vabyfs) of said air-fuel ratio sensor;

calculate said instructed fuel injection amount by performing, based on said actual detected air-fuel ratio, a feedback correction on said amount of said fuel injected from a plurality of said fuel injection valves in such a manner that said actual detected air-fuel ratio coincides with a target air-fuel ratio; and obtain an air-fuel ratio imbalance indicating value which becomes larger as a degree of a non-uniformity among a plurality of said cylinders of cylinder-by-cylinder air-fuel ratios, each of which is an air-fuel ratio of said mixture supplied to each of said combustion chambers of a plurality of said cylinders, becomes larger, wherein, said electric controller is configured to:

obtain said actual detected air-fuel ratio by converting said actual output value (Vabyfs) of said air-fuel ratio sensor into an air-fuel ratio which becomes leaner as said obtained air-fuel ratio imbalance indicating value becomes larger;

calculate a feedback correction term by multiplying a value correlated to a difference between said actual detected air-fuel ratio and said target air-fuel ratio by a predetermined gain:

carry out said feedback correction using said feedback term; and set said gain to a larger value in a period after rich-lean inversion time point than a value in a period after lean-rich inversion time point, wherein said period after rich-lean inversion time point being a time period until a predetermined time elapses from a rich-lean inversion time point at which said actual detected air-fuel ratio has changed from an air-fuel ratio richer than a stoichiometric air-fuel ratio to an air-fuel ratio leaner than said stoichiometric air-fuel ratio, and said period after lean-rich inversion time point being a time period until a predetermined time elapses from a lean-rich inversion time point at which said actual detected air-fuel ratio has changed from an air-fuel ratio leaner than said stoichiometric air-fuel ratio to an air-fuel ratio richer than said stoichiometric air-fuel ratio.

3. The fuel injection amount control apparatus according to claim 2, wherein, said electric controller is configured so as to set said gain in such a manner that a difference between said gain set in said period after rich-lean inversion time point and said gain set in said period after lean-rich inversion time point becomes larger as said air-fuel ratio imbalance indicating value becomes larger.

4. The fuel injection amount control apparatus according to claim 1, wherein, said electric controller is configured to:

include a plurality of tables or functions, each defining a relationship between said output value of said air-fuel ratio sensor and a true air-fuel ratio for each of a plurality of said air-fuel ratio imbalance indicating values;

select a table or a function, corresponding to said obtained air-fuel ratio imbalance indicating value, out of a plurality of said tables or said functions; and obtain said actual detected air-fuel ratio by applying said actual output value (Vabyfs) of said air-fuel ratio sensor to said selected table or said selected function.

5. The fuel injection amount control apparatus according to claim 1, wherein, said electric controller is configured to:

include a base table or a base function, which defines a relationship between said output value of said air-fuel ratio sensor and a true air-fuel ratio when there is no non-uniformity among a plurality of said cylinders of said cylinder-by-cylinder air-fuel ratios;

obtain, based on said obtained air-fuel ratio imbalance indicating value and said actual output value (Vabyfs) of said air-fuel ratio sensor, an output correction amount for correcting said actual output value (Vabyfs) of said air-fuel ratio sensor to be an output value when there is no non-uniformity among a plurality of said cylinders of said cylinder-by-cylinder air-fuel ratios by changing said actual output value (Vabyfs) of said air-fuel ratio sensor into an output value which is in a leaner side as said air-fuel ratio imbalance indicating value becomes larger;

obtain a corrected output value by correcting said actual output value (Vabyfs) of said air-fuel ratio sensor based on said obtained output correction amount; and obtain said actual detected air-fuel ratio by applying said obtained corrected output value to said base table or said base function.

6. The fuel injection amount control apparatus according to claim 1, wherein, said electric controller is configured to obtain a differential value d(abyfsvir)/dt of said virtual detected air-fuel ratio (abyfsvir) with respect to time, and obtain, as said air-fuel ratio imbalance indicating value, a value correlated to said obtained differential value d(abyfsvir)/dt.

7. The fuel injection amount control apparatus according to claim 1, wherein, said electric controller is configured to obtain a second order differential value $d^2$(Vabyfs)/$dt^2$ of said virtual detected air-fuel ratio (abyfsvir) with respect to time, and obtain, as said air-fuel ratio imbalance indicating value, a value correlated to said obtained second order differential value $d^2$(Vabyfs)/$dt^2$.

8. The fuel injection amount control apparatus according to claim 1, wherein, said electric controller is configured to obtain a value correlated to a trajectory length of said virtual detected air-fuel ratio (abyfsvir) in a predetermined period, as said air-fuel ratio imbalance indicating value.

9. The fuel injection amount control apparatus according to claim 1, wherein, said electric controller is configured to obtain said air-fuel ratio imbalance indicating value using an actual output proportional value (k·Vabyfs) which is directly proportional to said actual output value (Vabyfs) of said air-fuel ratio sensor.

10. The fuel injection amount control apparatus according to claim 9, wherein, said electric controller is configured to obtain a differential value d(k·Vabyfs)/dt of said actual output proportional value (k·Vabyfs) with respect to time, and obtain, as said air-fuel ratio imbalance indicating value, a value correlated to said obtained differential value d(k·Vabyfs)/dt.

11. The fuel injection amount control apparatus according to claim 9, wherein, said electric controller is configured to obtain a second order differential value $d^2$(Vabyfs)/$dt^2$ of said actual output proportional value (k·Vabyfs) with respect to time, and obtain, as said air-fuel ratio imbalance indicating value, a value correlated to said obtained second order differential value $d^2$(Vabyfs)/$dt^2$.

12. The fuel injection amount control apparatus according to claim 9, wherein, said electric controller is configured to obtain a value correlated to a trajectory length of said actual output proportional value (k·Vabyfs) in a predetermined period, as said air-fuel ratio imbalance indicating value.

13. A fuel injection amount control apparatus comprising:

a multi-cylinder internal combustion engine;

a three way catalyst which is disposed in an exhaust passage of said engine and at a position downstream of an exhaust gas aggregated portion into which exhaust gases discharged from a plurality of cylinders of said engine merge;

an air-fuel ratio sensor, which is disposed in said exhaust passage and at a position between said exhaust gas aggregated portion and said catalyst, which includes an air-fuel ratio detection element, an exhaust-gas-side electrode layer and a reference-gas-side electrode layer that are formed so as to face to each other across said air-fuel ratio detection element, and a porous layer which covers said exhaust-gas-side electrode layer, and which outputs an output value (Voxs) corresponding to an amount of oxygen and an amount of unburnt substances that are contained in an exhaust gas that has reached said exhaust-gas-side electrode layer via said porous layer, said gas being included in an exhaust gas passing through said position at which said air-fuel ratio sensor is disposed;

a plurality of fuel injection valves, each of which is configured so as to inject a fuel to be contained in a mixture supplied to each of combustion chambers of a plurality of said cylinders in an amount corresponding to an instructed fuel injection amount; and an electric controller configured to:

calculate said instructed fuel injection amount by performing, based on an actual output value (Vabyfs) of said air-fuel ratio sensor, a feedback correction on said amount of said fuel injected from a plurality of said fuel injection valves in such a manner that said actual output of said air-fuel ratio sensor coincides with a target air-fuel value;

obtain an air-fuel ratio imbalance indicating value which becomes larger as a degree of a non-uniformity among a plurality of said cylinders of cylinder-by-cylinder air-fuel ratios, each of which is an air-fuel ratio of said mixture supplied to each of said combustion chambers of a plurality of said cylinders, becomes larger, wherein, said electric controller is configured to:

obtain a corrected output value by correcting said actual output value (Vabyfs) of said air-fuel ratio sensor to be a value in a leaner side as said air-fuel ratio imbalance indicating value becomes larger;

perform said feedback correction based on said corrected output value; and obtain said air-fuel ratio imbalance indicating value using an actual output proportional value (k·Voxs) which is a value directly proportional to said actual output value (Vabyfs) of said air-fuel ratio sensor.

14. The fuel injection amount control apparatus according to claim 13, wherein, said electric controller is configured to:

obtain, based on said obtained air-fuel ratio imbalance indicating value and said actual output value (Vabyfs) of said air-fuel ratio sensor, an output correction amount for correcting said actual output value (Vabyfs) of said air-fuel ratio sensor to be an output value when there is no non-uniformity among a plurality of said cylinders of said cylinder-by-cylinder air-fuel ratios by changing said actual output value (Vabyfs) of said air-fuel ratio sensor into an output value which is in a leaner side as said air-fuel ratio imbalance indicating value becomes larger; and obtain said corrected output value by correcting said actual output value (Vabyfs) of said air-fuel ratio sensor based on said obtained output correction amount.

15. The fuel injection amount control apparatus according to claim 13, wherein, said electric controller is configured to obtain a differential value d(k·Voxs)/dt of said actual output proportional value (k·Voxs) with respect to time, and obtain, as said air-fuel ratio imbalance indicating value, a value correlated to said obtained differential value d(k·Voxs)/dt.

16. The fuel injection amount control apparatus according to claim 13, wherein, said electric controller is configured to obtain a second order differential value $d^2(Voxs)/dt^2$ of said actual output proportional value (k·Voxs) with respect to time, and obtain, as said air-fuel ratio imbalance indicating value, a value correlated to said obtained second order differential value $d^2(Voxs)/dt^2$.

17. The fuel injection amount control apparatus according to claim 13, wherein, said electric controller is configured to obtain a value correlated to a trajectory length of said actual output proportional value (k·Voxs) in a predetermined period, as said air-fuel ratio imbalance indicating value.

18. The fuel injection amount control apparatus according to claim 2, wherein, said electric controller is configured to:

include a plurality of tables or functions, each defining a relationship between said output value of said air-fuel ratio sensor and a true air-fuel ratio for each of a plurality of said air-fuel ratio imbalance indicating values;

select a table or a function, corresponding to said obtained air-fuel ratio imbalance indicating value, out of a plurality of said tables or said functions; and obtain said actual detected air-fuel ratio by applying said actual output value (Vabyfs) of said air-fuel ratio sensor to said selected table or said selected function.

19. The fuel injection amount control apparatus according to claim 2, wherein, said electric controller is configured to:

include a base table or a base function, which defines a relationship between said output value of said air-fuel ratio sensor and a true air-fuel ratio when there is no non-uniformity among a plurality of said cylinders of said cylinder-by-cylinder air-fuel ratios;

obtain, based on said obtained air-fuel ratio imbalance indicating value and said actual output value (Vabyfs) of said air-fuel ratio sensor, an output correction amount for correcting said actual output value (Vabyfs) of said air-fuel ratio sensor to be an output value when there is no non-uniformity among a plurality of said cylinders of said cylinder-by-cylinder air-fuel ratios by changing said actual output value (Vabyfs) of said air-fuel ratio sensor into an output value which is in a leaner side as said air-fuel ratio imbalance indicating value becomes larger;

obtain a corrected output value by correcting said actual output value (Vabyfs) of said air-fuel ratio sensor based on said obtained output correction amount; and obtain said actual detected air-fuel ratio by applying said obtained corrected output value to said base table or said base function.

* * * * *